US011472657B2

(12) United States Patent
Izawa et al.

(10) Patent No.: US 11,472,657 B2
(45) Date of Patent: Oct. 18, 2022

(54) PAPER SHEET ACCUMULATION DRUM, PAPER SHEET ACCUMULATION DEVICE, AND PAPER SHEET PROCESSING DEVICE

(71) Applicant: JAPAN CASH MACHINE CO., LTD., Osaka (JP)

(72) Inventors: Shinya Izawa, Osaka (JP); Yuki Ishihara, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 49 days.

(21) Appl. No.: 16/961,150

(22) PCT Filed: Oct. 9, 2018

(86) PCT No.: PCT/JP2018/037512
§ 371 (c)(1),
(2) Date: Jul. 9, 2020

(87) PCT Pub. No.: WO2019/142411
PCT Pub. Date: Jul. 25, 2019

(65) Prior Publication Data

US 2020/0339372 A1 Oct. 29, 2020

(30) Foreign Application Priority Data

Jan. 16, 2018 (JP) ..... JP2018-004871

(51) Int. Cl.
*B65H 29/51* (2006.01)
*B65H 5/28* (2006.01)

(52) U.S. Cl.
CPC ..... *B65H 29/51* (2013.01); *B65H 5/28* (2013.01)

(58) Field of Classification Search
CPC ..... B65H 29/51; B65H 5/28; B65H 29/006; B65H 29/008; B65H 29/12; B65H 29/125;
(Continued)

(56) References Cited

U.S. PATENT DOCUMENTS 2,965,026 A * 12/1960 Woodward ..... B41F 22/00 101/420
3,888,267 A * 6/1975 Gautschi ..... G07F 7/04 271/3.21
(Continued)

FOREIGN PATENT DOCUMENTS

CA 2096987 11/1993
CN 102930638 A 2/2013
(Continued)

OTHER PUBLICATIONS

IP Australia, Examination report No. 1 for standard patent application dated May 20, 2021 in Australian Application No. 2018402553, 5 pages.
(Continued)

*Primary Examiner* — Thomas A Morrison
(74) *Attorney, Agent, or Firm* — Masuvalley & Partners; Peter R. Martinez

(57) ABSTRACT

In a drum-type paper sheet accumulation device that sequentially supplies paper sheets to an outer circumferential surface of a payout drum, accumulates the paper sheets by winding the paper sheets in a stacked state, and returns the paper sheets all at once, a technique is provided which can keep a linear velocity of a paper sheet located at an outermost circumference of the payout drum constant and can maintain an arranged state of the paper sheets without any particular speed control. A paper sheet accumulation drum 105 that stacks and accumulates paper sheets supplied one by one on an outer circumferential surface thereof while
(Continued)

D–D rotating, includes a plurality of retractable members 280 that are arranged on a paper sheet accumulation portion of the outer circumferential surface in a predetermined circumferential arrangement, are configured to be retractable between a most protruding position protruding radially outward and a retreat position retreating from the most protruding position radially inward, are each elastically biased in a protruding direction, and each come into contact with a paper sheet surface on an outer surface. The paper sheets are accumulated to spread over the retractable members.

6 Claims, 42 Drawing Sheets

(58) Field of Classification Search
CPC .... B65H 2301/41; G07D 11/10; G07D 11/12; G07D 11/13; G07D 11/14; G07D 11/16; G07D 11/165; G07D 11/17; G07D 11/18; G07D 11/22; G07D 11/00
See application file for complete search history.

(56) References Cited

U.S. PATENT DOCUMENTS

| | | | | |
|---|---|---|---|---|
| 4,043,548 | A * | 8/1977 | Pollich | B41F 22/00 226/76 |
| 4,822,018 | A * | 4/1989 | Hain | B65H 29/51 271/3.2 |
| 5,735,516 | A | 4/1998 | Gerlier et al. | |
| 8,678,387 | B2 * | 3/2014 | Taniguchi | B65H 5/26 271/275 |
| 9,457,980 | B2 * | 10/2016 | Kuypers | B65H 31/36 |
| 2003/0171199 | A1 | 9/2003 | Bryant et al. | |
| 2012/0326384 | A1 | 12/2012 | Arikata et al. | |
| 2016/0167913 | A1 | 6/2016 | Xiao et al. | |

FOREIGN PATENT DOCUMENTS

| | | | |
|---|---|---|---|
| DE | 1193517 | B | 5/1965 |
| DE | 10305315 | A1 | 9/2003 |
| DE | 102005036304 | A1 | 2/2007 |
| JP | S50-131598 | A | 10/1975 |
| JP | 61-130547 | U | 8/1986 |
| JP | H06-32514 | A | 2/1994 |
| JP | 2814249 | B2 | 8/1998 |
| JP | H10508962 | A | 9/1998 |
| JP | 2008-016062 | A | 1/2008 |

OTHER PUBLICATIONS

WIPO, Japan International Search Authority, International Search Report (with English translation) and Written Opinion dated Nov. 6, 2018 in International Patent Application No. PCT/JP2018/037512, 8 pages.
Extended European Search Report dated Sep. 16, 2021 in European Patent Application No. 18901765.0, 7 pages.
Intellectual Property India, Indian Examination Report with English translation dated Dec. 14, 2020 in Indian Application No. 202037022181, 5pages.

* cited by examiner

B–B

C–C

D–D

PAPER SHEET ACCUMULATION DRUM, PAPER SHEET ACCUMULATION DEVICE, AND PAPER SHEET PROCESSING DEVICE

RELATED APPLICATIONS

This application is the U.S. National Phase of and claims priority to International Patent Application No. PCT/JP2018/037512, International Filing Date Oct. 9, 2018, entitled Paper Sheet Accumulation Drum, Paper Sheet Accumulation Device, And Paper Sheet Processing Device; which claims benefit of Japanese Application No. JP2018-004871 filed Jan. 16, 2018 entitled Drum For Accumulating Paper Sheets, Device For Accumulating Paper Sheets, And Device For Processing Paper Sheets; both of which are incorporated herein by reference in their entireties.

FIELD

The present invention relates to improvement of a paper sheet processing device provided in a paper sheet handling apparatus such as an automatic vending machine, a paper sheet accumulation device provided in the paper sheet processing device, and a paper sheet accumulation drum.

BACKGROUND

As a banknote processing device provided in a banknote handling apparatus that has a function of providing various types of goods or services by receiving a banknote inserted by a customer, for example, an automatic vending machine, a game medium lending machine in a game place, a depositing/dispensing apparatus, and a money changer, there is known a circulation type that can successively take in, accommodate, and dispense a plurality of kinds of banknotes.

This type of banknote processing device includes a payout accumulation device that once accumulates a rejected banknote receipt of which is rejected by a discrimination unit and a banknote to be returned because of cancellation occurring after insertion of that banknote, and then pays out the banknotes to a return port.

As the payout accumulation device, there is known a device that once winds the banknotes inserted by a customer on a drum outer circumference to temporarily hold the banknotes and returns the banknotes at once when cancellation occurs or the customer forgets to take the banknotes, as disclosed in Patent Literature 1 (Japanese Patent Application Laid-open No. H06-32514), Patent Literature 2 (Japanese Patent No. 2814249), Patent Literature 3 (Japanese Patent No. 4563435), and Patent Literature 4 (Japanese Patent Application National Publication No. H10-508962).

However, because this device is configured to pay out a plurality of banknotes all at once after sequentially stacking them on an outer circumferential surface of a cylindrical drum having a constant outer circumferential length and a constant outer diameter, the outer diameter (the circumference) of the drum including the thickness of the banknotes increases with increase of the number of the stacked banknotes, so that the peripheral speed of an outermost banknote increases. Therefore, in a case where the transport speed of a banknote introduced to the drum is constant, a timing at which leading ends of an already-stacked banknote on the outer circumference of the drum and a following banknote are made coincident with each other is sequentially deviated, causing a misalignment between stacked banknotes.

In order to solve these problems, it is necessary to execute speed-adjustment control in such a manner that the peripheral speed of the drum is sequentially decelerated in accordance with increase of the number of the stacked banknotes to coincide with the transport speed of a banknote. However, in practice, the increase amount of the outer diameter and the increase amount of the peripheral speed are not constant because of various factors, for example, a difference of a thickness, a creased degree such as folding crease, and the like between banknotes. Therefore, high-accuracy control of the peripheral speed of the drum is extremely difficult, making a control program complicated.

These problems occur not only in the banknote processing device but also in a paper sheet processing device that handles paper sheets other than banknotes, for example, tickets, cash vouchers, and securities.

CITATION LIST

Patent Literatures

Patent Literature 1: Japanese Patent Application Laid-open No. H06-32514

Patent Literature 2: Japanese Patent No. 2814249

Patent Literature 3: Japanese Patent No. 4563435

Patent Literature 4: Japanese Patent Application National Publication No. H10-508962

SUMMARY

Technical Problem

The present invention has been made in view of the above problems, and it is an object of the present invention to provide a technique in a drum-type paper sheet accumulation device that, in a case where it is determined that paper sheets temporarily held after being inserted are to be transferred (returned, discharged), sequentially supplies the paper sheets to an outer circumferential surface of a payout drum, accumulates the paper sheets by winding the paper sheets in a stacked state, and thereafter transfers the paper sheets all at once. Even if the number of the paper sheets accumulated on the outer circumference of the payout drum is increased, the technique can keep a linear velocity of a paper sheet located at an outermost circumference of the payout drum constant and can maintain an arranged state of the paper sheets without any particular speed control.

Solution to Problem

In order to achieve the above object, a paper sheet accumulation drum according to the invention of claim 1 is a paper sheet accumulation drum that stacks and accumulates paper sheets supplied one by one on an outer circumferential surface thereof while rotating, comprising a plurality of retractable members that are provided on a paper sheet accumulation portion of the outer circumferential surface in a predetermined circumferential arrangement, are each configured to be retractable between a most protruding position protruding radially outward and a retreat position retreating from the most protruding position radially inward, are each elastically biased in a protruding direction, and each come into contact with a paper sheet surface on an outer surface, wherein the paper sheets are accumulated to spread over the retractable members.

Advantageous Effects of Invention

According to the present invention, it is possible to provide a technique in a drum-type paper sheet accumulation device that sequentially supplies paper sheets to an outer circumferential surface of a payout drum, accumulates the paper sheets by winding the paper sheets in a stacked state, and thereafter discharges the paper sheets all at once.

DESCRIPTION OF EMBODIMENTS

Figure 1A:
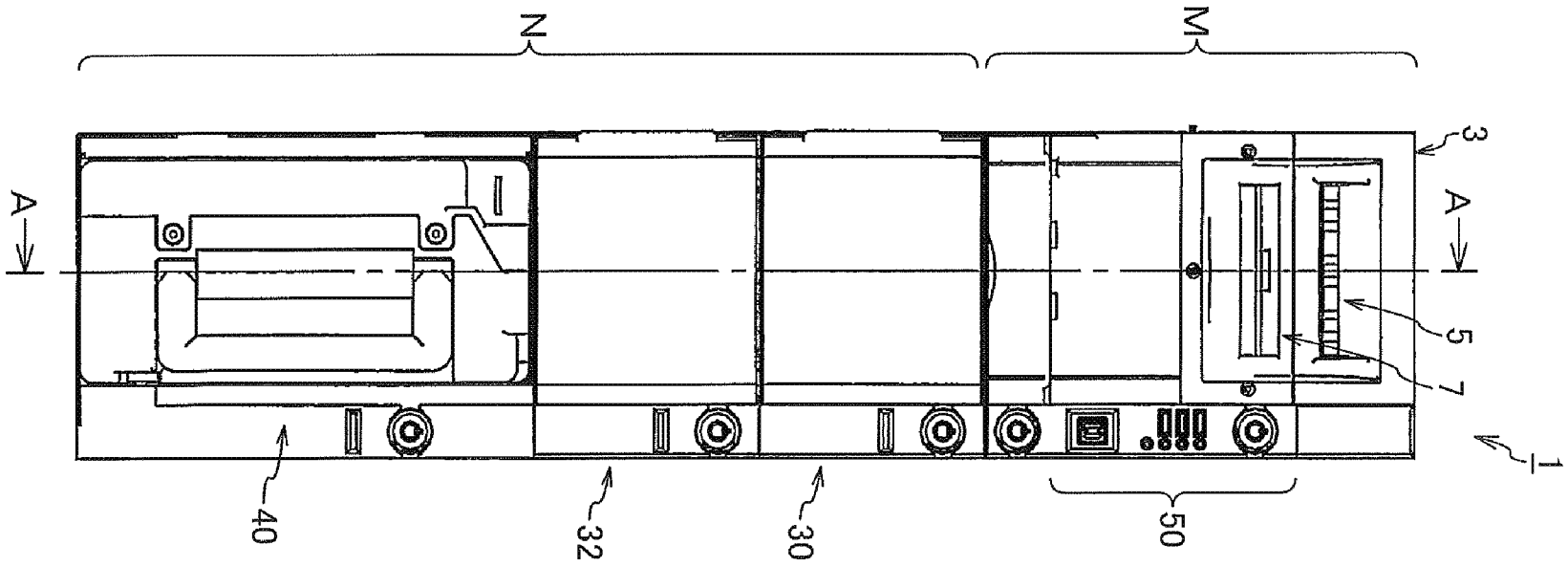
FIGS. 1(*a*) and (*b*) are respectively a front view and a cross-sectional view taken along a line A-A of a paper sheet (banknote) processing device including a paper sheet accumulation device according to an embodiment of the present invention.

The present invention will be explained below in detail with embodiments illustrated in the drawings.

[Configuration of Banknote Processing Device]

Figure 1B:
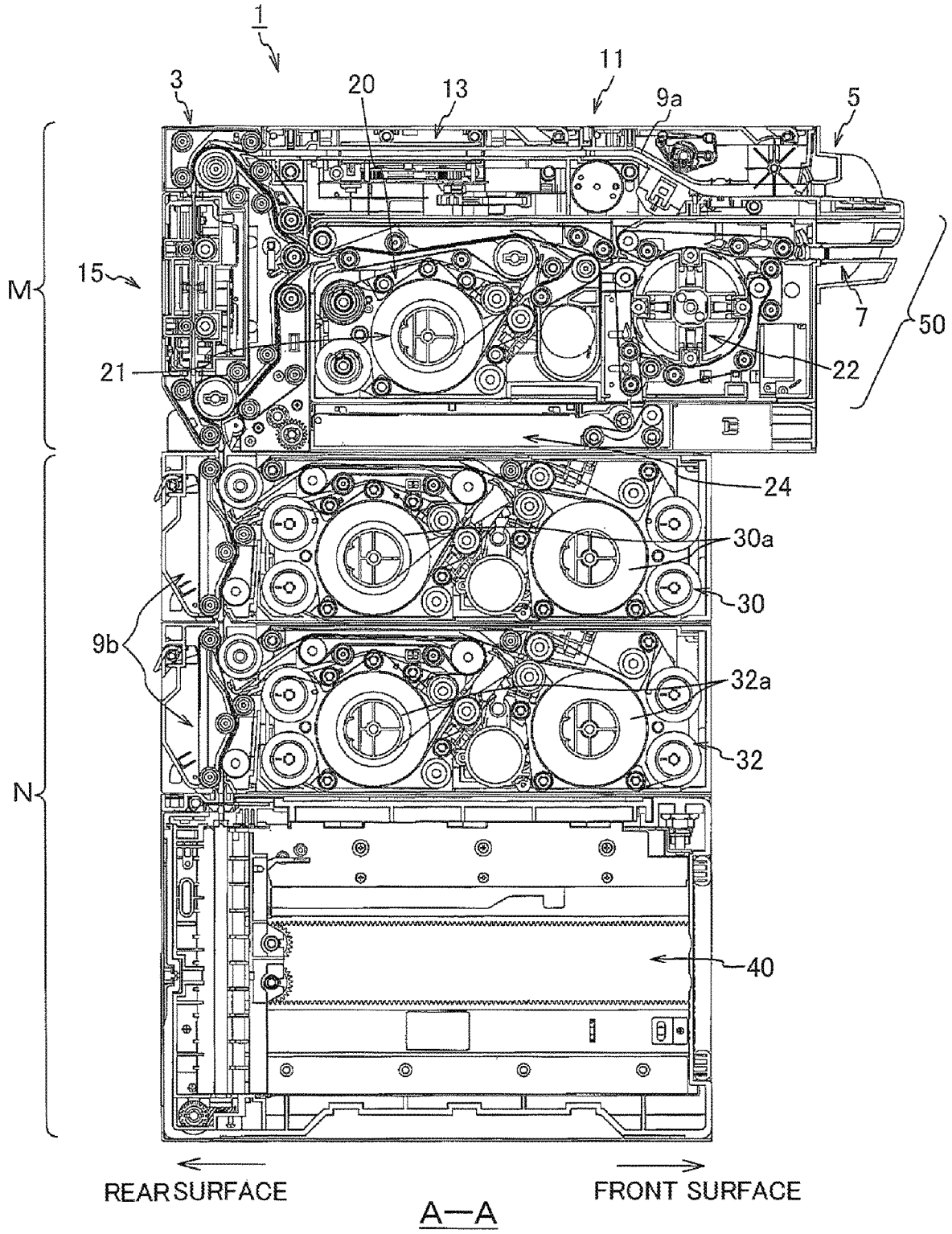

FIGS. 1(*a*) and (*b*) are respectively a front view and a cross-sectional view taken along a line A-A of a paper sheet (banknote) processing device including a paper sheet accumulation device according to an embodiment of the present invention.

Although the present embodiment describes a device that processes banknotes as an example of paper sheets, a paper sheet accumulation drum, a paper sheet accumulation device, and a paper sheet processing device of the present invention can be applied to a device that processes general paper sheets other than banknotes, for example, cash vouchers, tickets, and securities.

Further, although the present embodiment describes a device that processes a banknote to be returned, it is not limited to the banknote to be returned. The present embodiment can be also applied to a general device that accumulates banknotes on an outer circumference of a payout drum and then transfers the banknotes to another place.

A circulation-type banknote processing device (hereinafter, "banknote processing device") 1 illustrated in FIG. 1 is a unit that is provided in or together with a banknote handling apparatus, such as an automatic vending machine, a ticket-vending machine, a game medium lending machine in a game place, a depositing/dispensing apparatus, and a money changer, and performs a process of receiving banknotes and a process of paying out banknotes as change or the like.

Figure 2A:
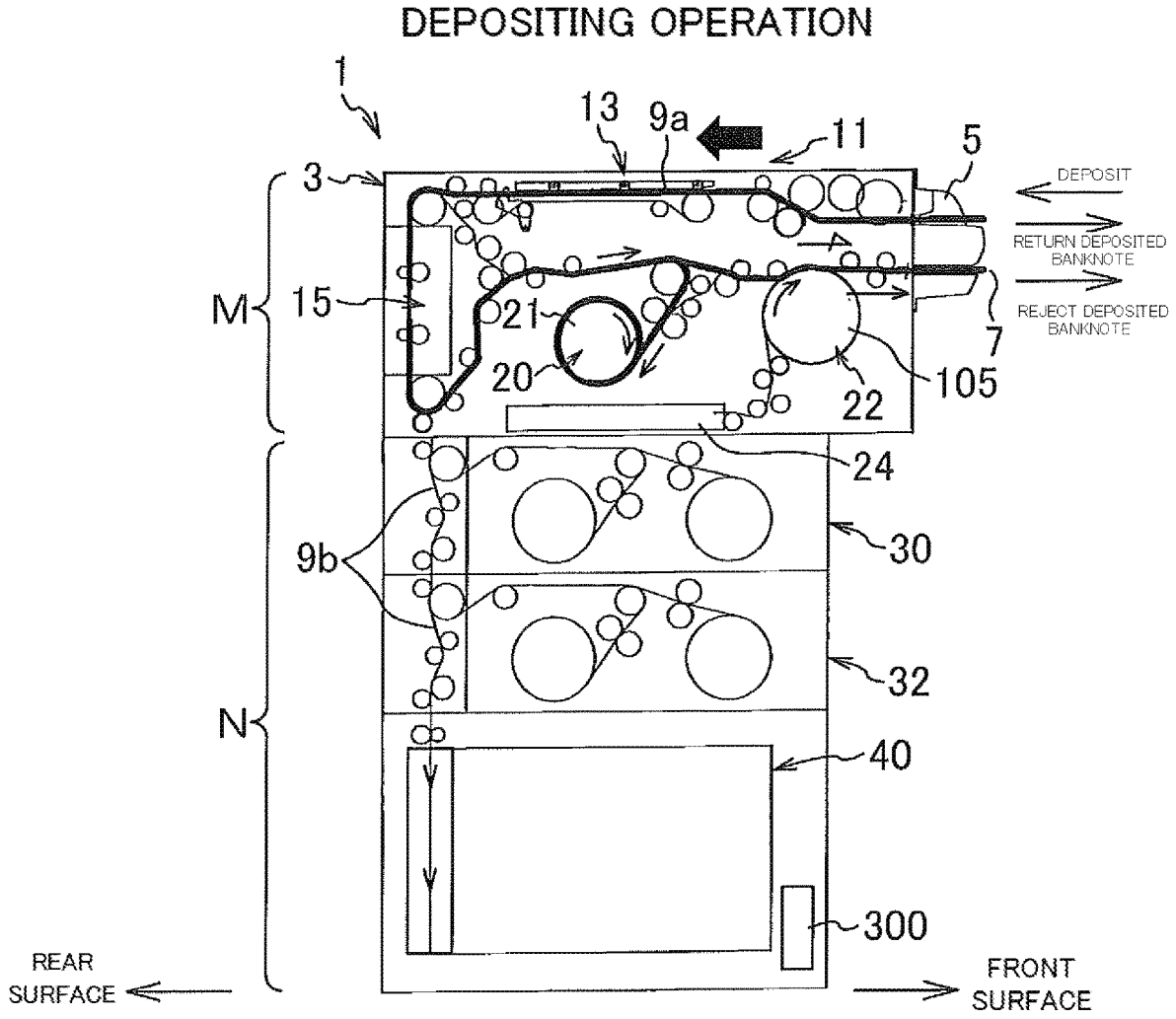
FIGS. 2(*a*) and (*b*) are explanatory diagrams illustrating a depositing operation and a determining operation of the banknote processing device.
Figure 2B:
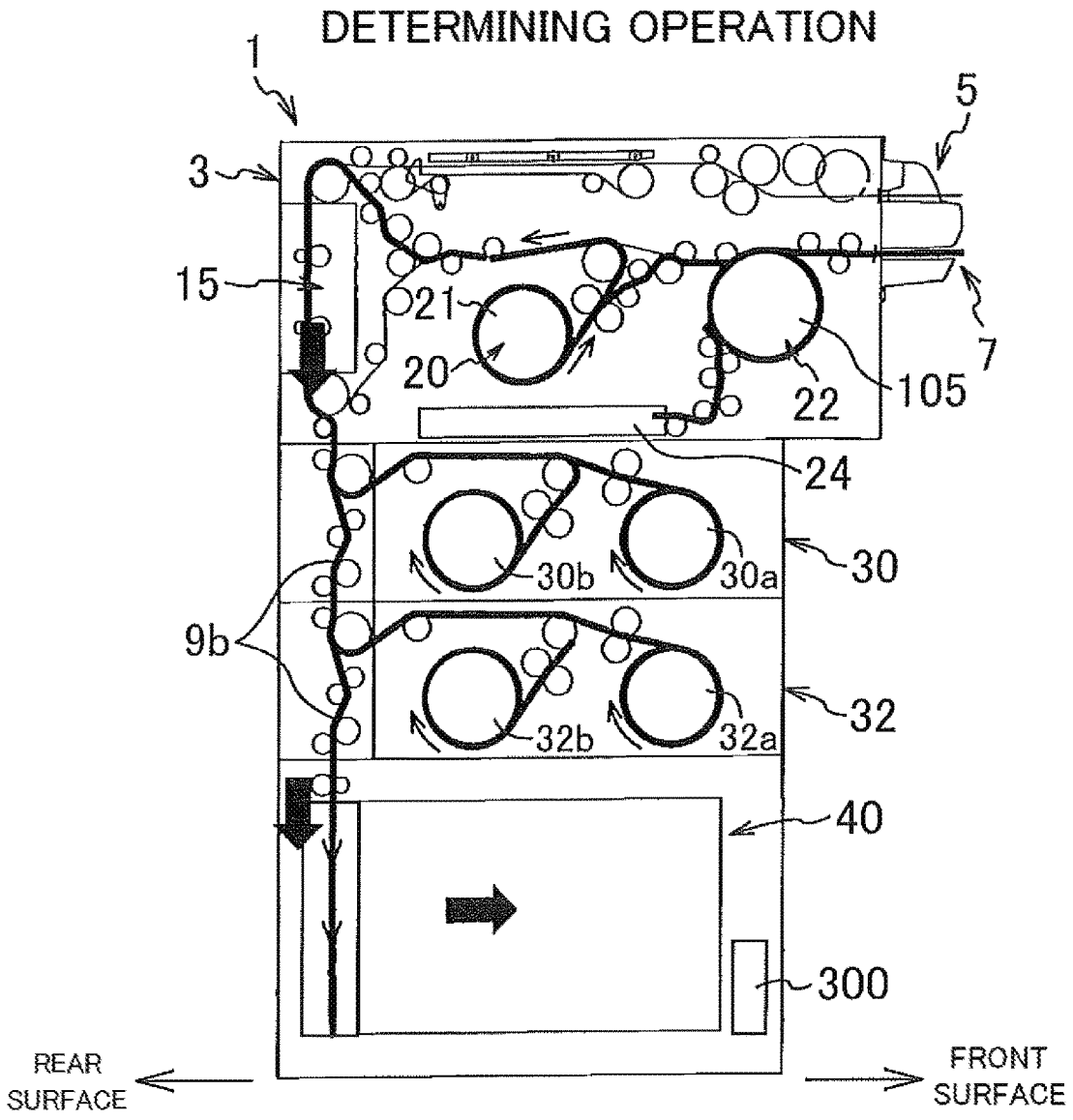
Figure 3A:
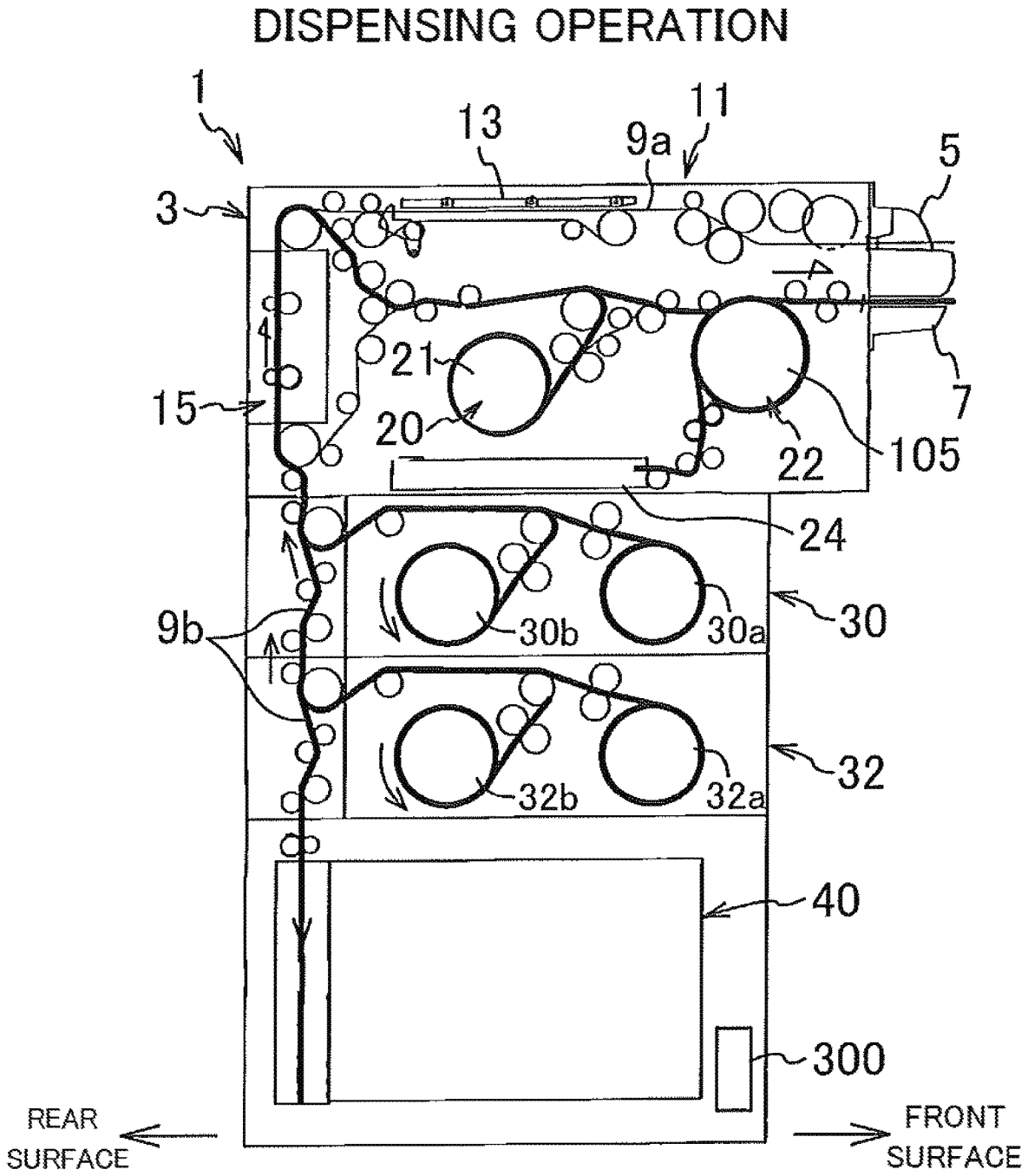
FIGS. 3(*a*) and (*b*) are explanatory diagrams illustrating a dispensing operation and a collecting operation of the banknote processing device.
Figure 3B:
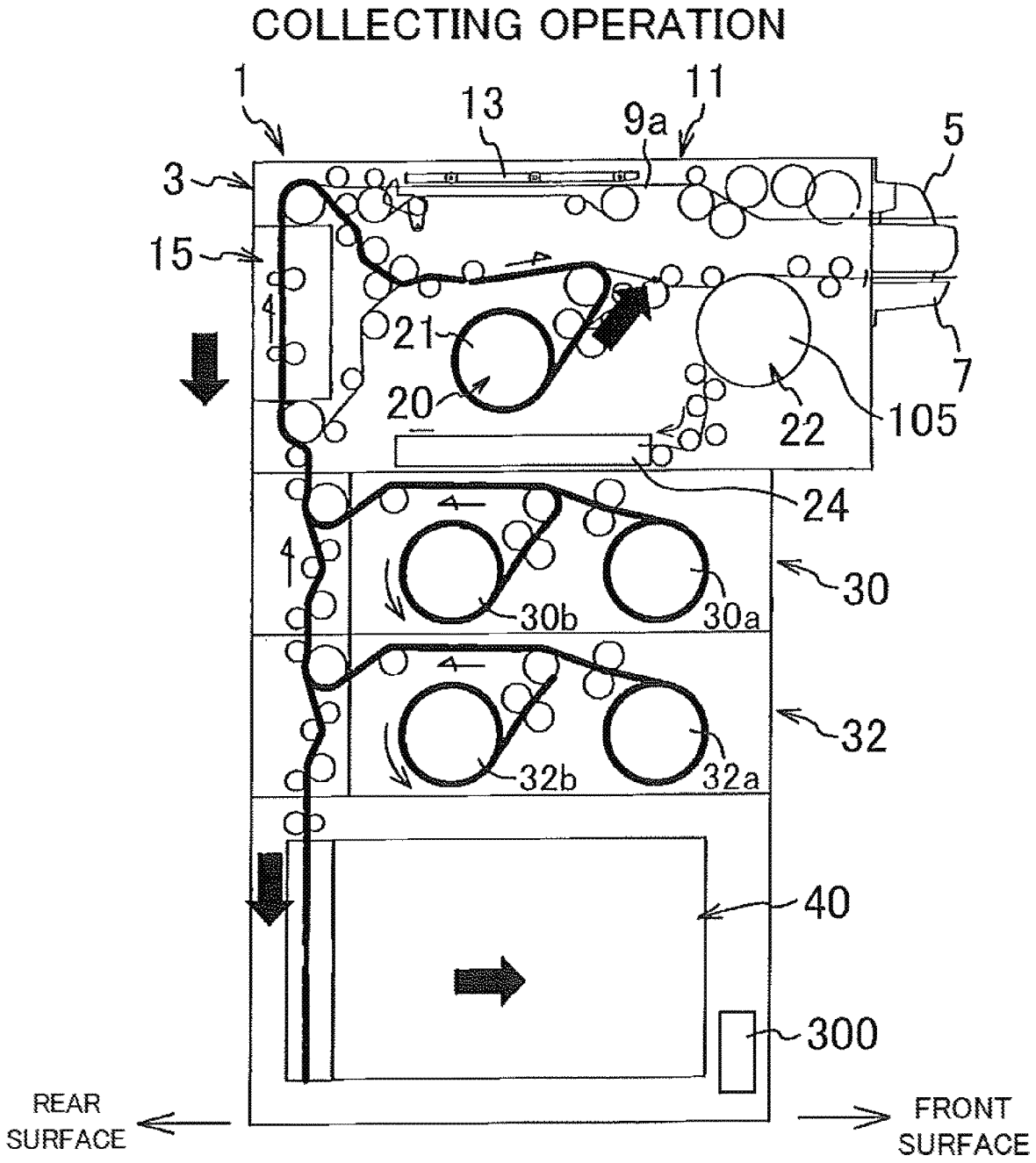

The banknote processing device 1 is generally configured to include a case 3 that forms an outer case, a deposit/dispense processing unit M that transports a banknote deposited into the case on a required route within the device and discharges the banknote to outside of the device, a banknote accommodation unit N that accommodates therein a banknote transported from the banknote deposit/dispense processing unit M and receives/sends a banknote from/to the banknote deposit/dispense processing unit M, a transport mechanism that transports a banknote through various routes, and a control unit (CPU, MPU, ROM, RAM, and the like) 300 that controls various objects to be controlled (FIGS. 2 and 3).

The deposit/dispense processing unit M includes a depositing/dispensing slot 5 that receives a batch of banknotes up to 30 sheets including different denominations at once and serves as a return slot when a deposited banknote is to be returned, a return slot 7 that serves as a dispensing slot for banknotes up to 30 sheets and as a deposit-rejected return slot, a batch deposit unit 11 that separates each banknote from a batch of banknotes inserted and set through the depositing/dispensing slot 5 and introduces the separated banknote into a device main body along a deposited-banknote transport path 9*a*, a centering unit 13 that is arranged on a downstream side of the batch deposit unit 11 and aligns the width-direction position of a transported banknote with the center of a transport path, a discrimination unit 15 that is arranged on a downstream side of the centering unit and determines the denomination of the deposited banknote, whether the deposited banknote is genuine, and the like together with an optical sensor and/or a magnetic sensor, an escrow unit (a temporarily holding unit) 20 that temporarily holds the deposited banknote after passing through the discrimination unit up to 30 sheets, sends out the deposited banknote to respective accommodation units or a collection container described later when receiving of the deposited banknote is determined, and sends out the deposited banknote to a payout accumulation unit (a payout accumulation device) 22 at the time of cancelling and returning in response to a return request or the like, the payout accumulation unit (a returned-banknote accumulation device) 22 that accumulates a banknote to be returned which is transported from the escrow unit and a rejected banknote (hereinafter, "returned banknote") and pays out the banknotes to the return slot 7, and a forgotten-banknote accommodation unit (a banknote holding unit) 24 that, in a case where the returned banknote paid out from the payout accumulation unit 22 to the return slot 7 has not been collected by a customer after a predetermined time has passed, accommodates the returned banknote sent back by the payout accumulation unit, as a forgotten banknote.

The banknote accommodation unit N includes first and second circulation-type accommodation units 30 and 32 each of which, when receiving of deposited banknotes is determined, accommodates the banknotes that are sent out one by one from the escrow unit 20 and are transported on an accommodated-banknote transport path 9*b*, for each denomination to be freely receivable and dispensable, and a collection container (a collected banknote accommodation unit) 40 that is attached in an accommodation space 3*a* provided below the second circulation-type accommodation unit 32 to be detachable from a front side, collects all denominations from the circulation-type accommodation units at the business-closing time or the like, and collects a large-denomination banknote not used as change and an extra banknote that cannot be accommodated in each circulation-type accommodation unit.

The transport mechanism includes a motor, a solenoid, a pulley, a belt, and a gate, for example, for generating and transmitting a driving force for transporting a banknote along each of the transport paths 9*a* and 9*b* and other transport paths.

The control unit 300 controls objects to be controlled, for example, the deposit/dispense processing unit M, the banknote accommodation unit N, and the transport mechanism.

The maximum number of sheets of banknotes that can be handled by the depositing/dispensing slot 5 and the return slot 7 are merely an example.

The first and second circulation-type accommodation units 30 and 32 in the present example each include two circulation drums 30*a* or 32*a* each of which can accommodate up to 60 sheets. Each of the circulation drums 30*a* and 32*a* accommodates a banknote between stacked portions of a single long tape spirally wound on an outer circumferential surface thereof, and is a type suitable for circulation. However, this type is merely an example.

[Various Operations of Banknote Processing Device]

Next, the outline of a depositing operation, a determining operation, a dispensing operation, and a collecting operation in the banknote processing device 1 illustrated in FIG. 1 that includes the payout accumulation unit (a returned-banknote accumulation device) 22 according to the present invention is described referring to FIGS. 2 and 3.

FIGS. 2(*a*) and (*b*) are explanatory diagrams illustrating the depositing operation and the determining operation of the banknote processing device, and FIGS. 3(*a*) and (*b*) are explanatory diagrams illustrating the dispensing operation and the collecting operation.

First, in the depositing operation in FIG. 2(*a*), when one banknote or a plurality of banknotes is/are inserted through the depositing/dispensing slot 5, the control unit 300 that receives a signal from a sensor that has detected the banknotes operates a transport mechanism to take in the banknotes by using the batch deposit unit 11 and the deposited-banknote transport path 9*a*. The batch deposit unit 11 picks up an uppermost banknote one by one of a batch of banknotes set in the depositing/dispensing slot 5 and transports the picked banknote to the centering unit 13. The banknote transported to the centering unit is subjected to centering, is then moved to the discrimination unit 15, and is subjected to discrimination. A banknote that is determined by the discrimination unit 15 as being acceptable is transported to the escrow unit 20, is wound on an outer circumference of an escrow drum 21 one by one to be temporarily held, and waits for determination of deposit. When a rejected banknote that is determined by the discrimination unit as being not acceptable is a banknote inserted through the depositing/dispensing slot 5 one by one, the rejected banknote is discharged to outside of the device through the return slot 7 as it is. Meanwhile, when a banknote in a plurality of sheets inserted at once is rejected, that banknote is accumulated in the payout accumulation unit 22 once (one to a plurality of sheets), and is then discharged to the outside through the return slot 7 collectively to be returned. Further, when a customer requests return of a banknote by operating a cancel button (not illustrated), banknotes temporarily held in the escrow unit 20 are sent out to the payout accumulation unit 22 one by one and are accumulated in a stacked state by being wound on a rotating payout drum 105 one by one. When accumulation of all banknotes inserted by the customer on the outer circumference of the payout drum is completed, the payout drum 105 rotates in a payout direction to cause a banknote batch to protrude to the outside through the return port 7 and be returned, thereby prompting the customer to receive the batch.

When the banknote batch to be returned caused to protrude to the outside of the device through the return slot 7 has not been collected by the customer after a predetermined time passes, the payout drum is rotated in a return direction to send back the banknote batch to the inside of the device, so that the banknote batch is accommodated as forgotten banknotes in the forgotten-banknote accommodation unit 24.

In the determining operation in FIG. 2(*b*), when deposit of the deposited banknotes temporarily held in the escrow unit 20 is determined, the banknotes are sent out from the escrow unit one by one. A banknote used as change is accommodated in either one of the circulation-type accommodation units 30 and 32 for each domination via the accommodated-banknote transport path 9*b*. A banknote not used as change is accommodated in the collection container 40.

In the dispensing operation in FIG. 3(*a*), when a banknote is paid out as change, a banknote accommodated in the circulation-type accommodation unit 30 or 32 is taken out and is discriminated by the discrimination unit 15. When the banknote is a returnable banknote, it is accumulated in the payout accumulation unit 22 once (one to a plurality of sheets) and accumulated banknotes are then paid out all at once through the return slot 7 as change.

Meanwhile, a banknote discriminated as being not returnable by the discrimination unit 15 is temporarily stored in the escrow unit 22 and is then transferred to and accommodated in the collection container 40.

In the collecting operation in FIG. 3(*b*), banknotes accommodated in the circulation-type accommodation units 30 and 32 are accumulated in the escrow unit 20 once at the business-closing time, for example, and are then accommodated in the collection container 40.

[Configuration of Payout Accumulation Unit]

The payout accumulation unit (the payout accumulation device) 22 is described in detail below.

Figure 4A:
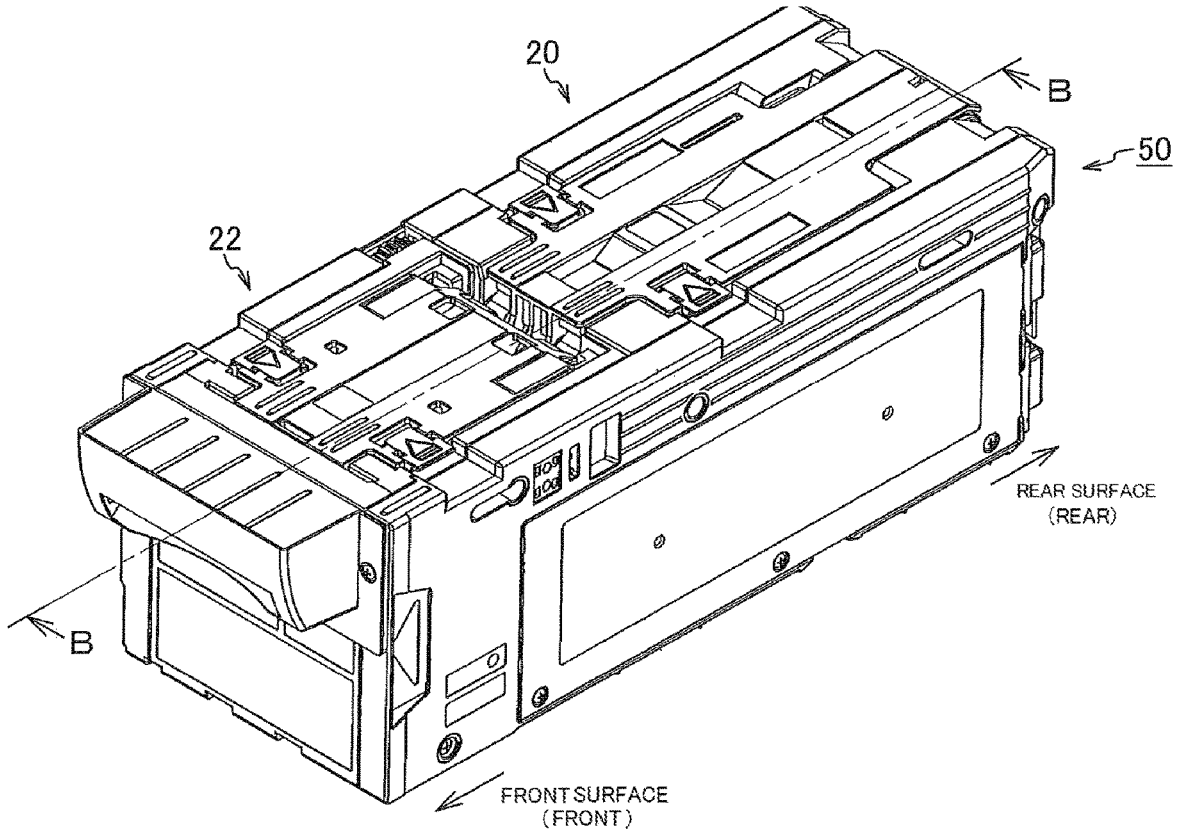
FIGS. 4(*a*), (*b*), and (*c*) are a perspective view of an appearance and a cross-sectional view taken along a line B-B of an escrow/accumulation unit and a perspective view illustrating an appearance and a configuration of a payout accumulation unit alone.
Figure 4B:
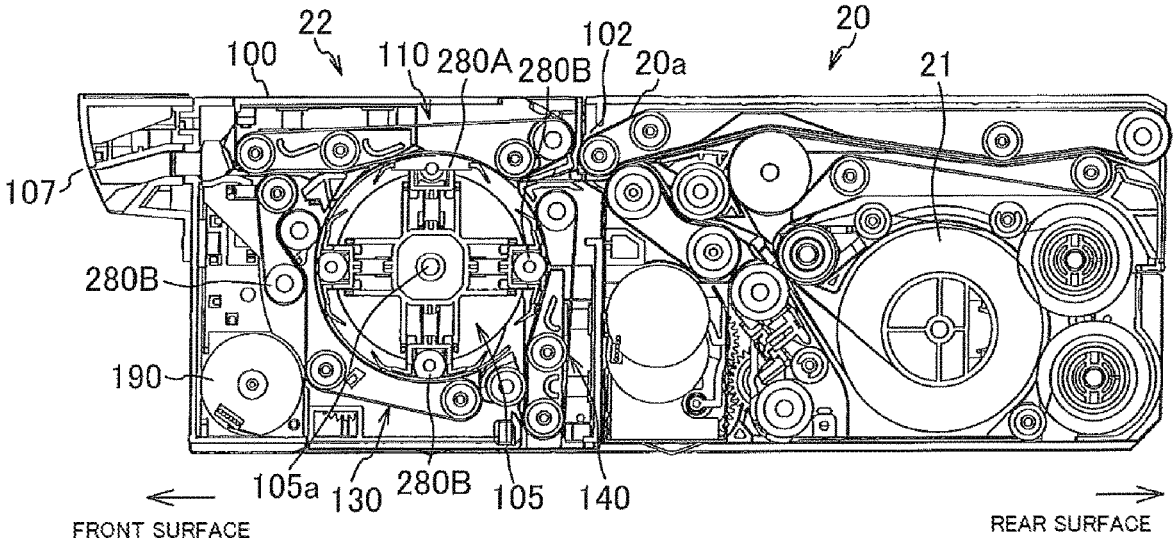
Figure 4C:
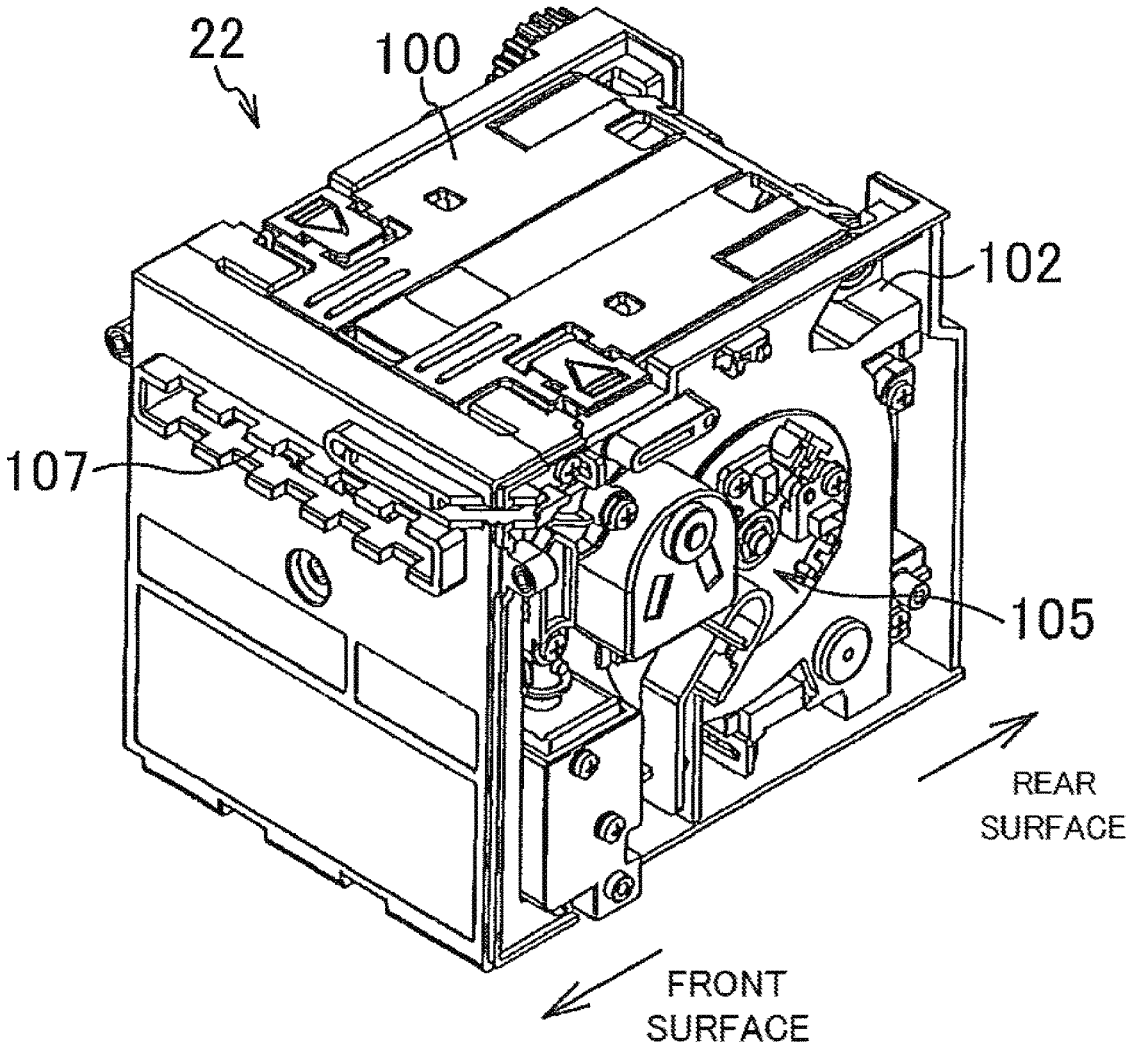
Figure 5A:
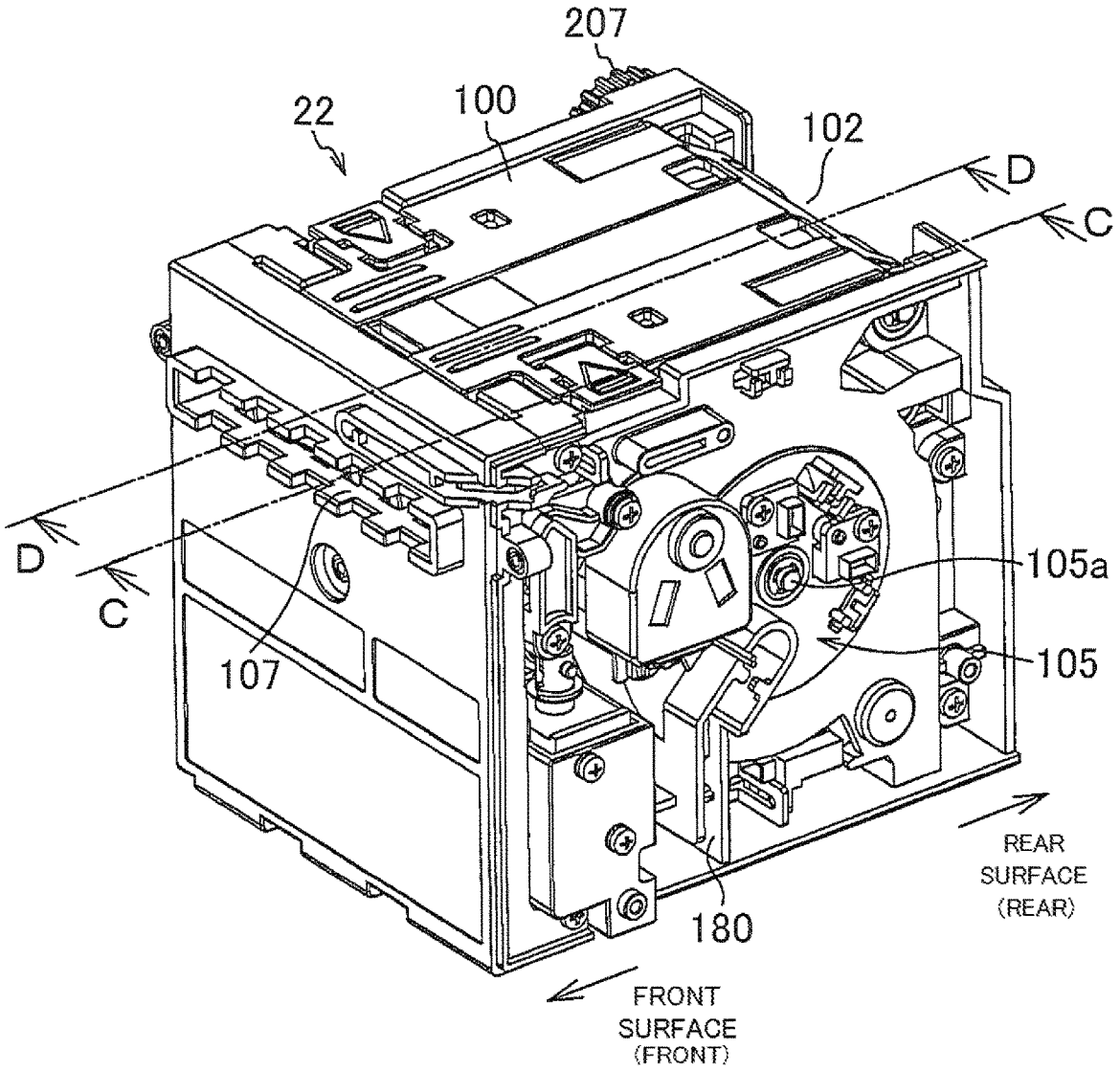
FIG. 5(*a*) is a perspective view illustrating an internal structure of the payout accumulation unit from which a right side plate is removed, (b) is a sectional perspective view taken along a line C-C in FIG. 5(*a*), (*c*) is a sectional perspective view taken along a line D-D in FIGS. 5(*a*), and (*d*) is a sectional side view taken along the line D-D.
Figure 5B:
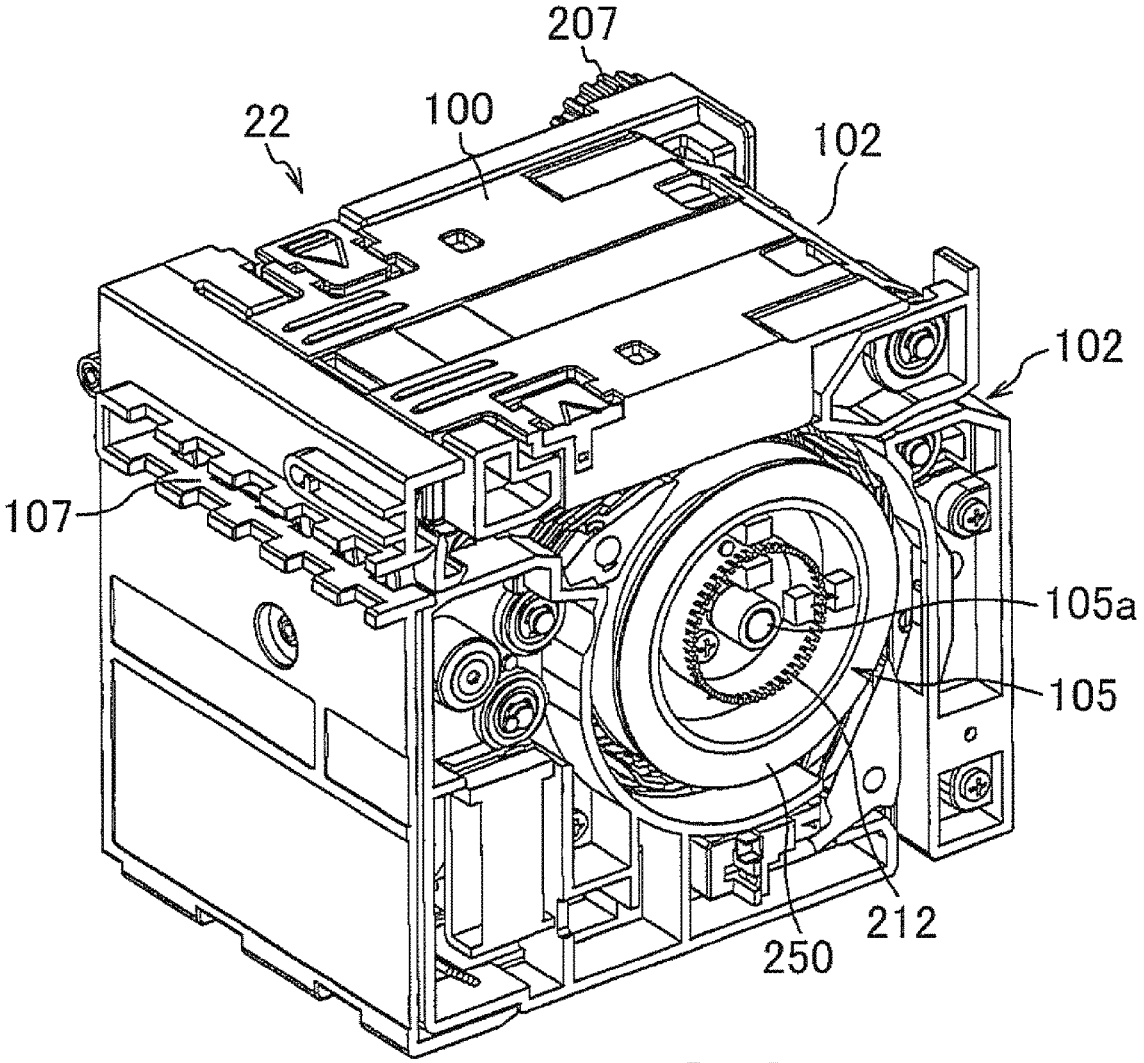
Figure 5C:
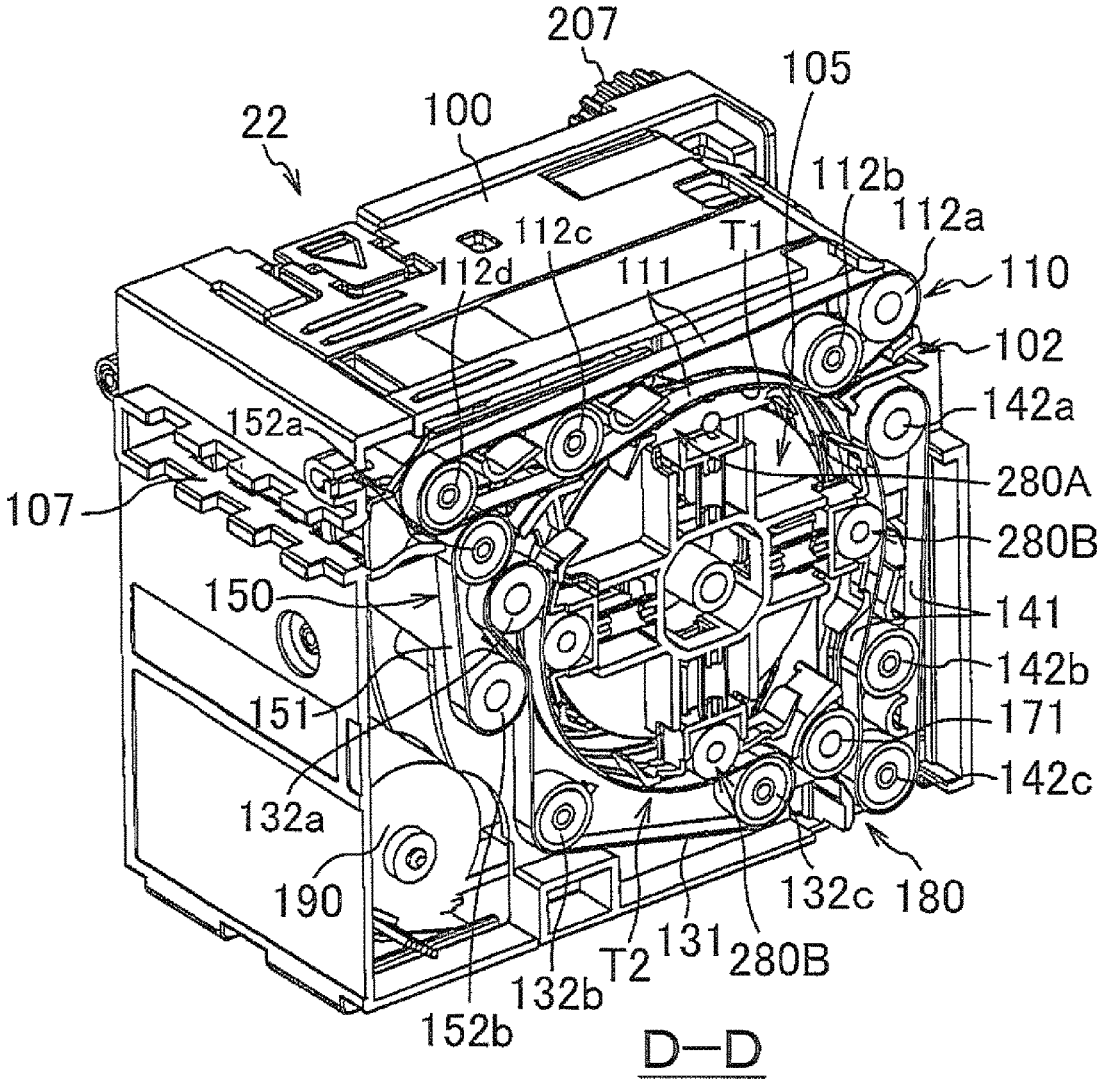
Figure 5D:
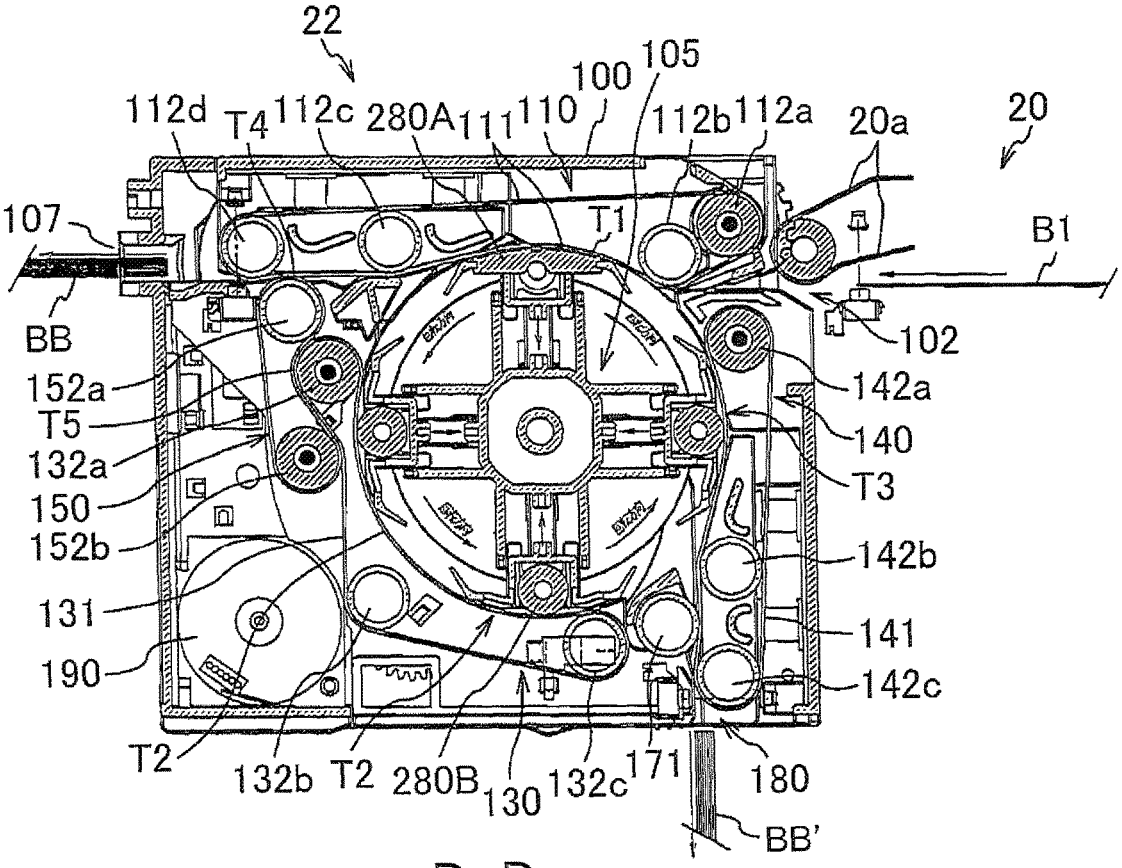
Figure 6:
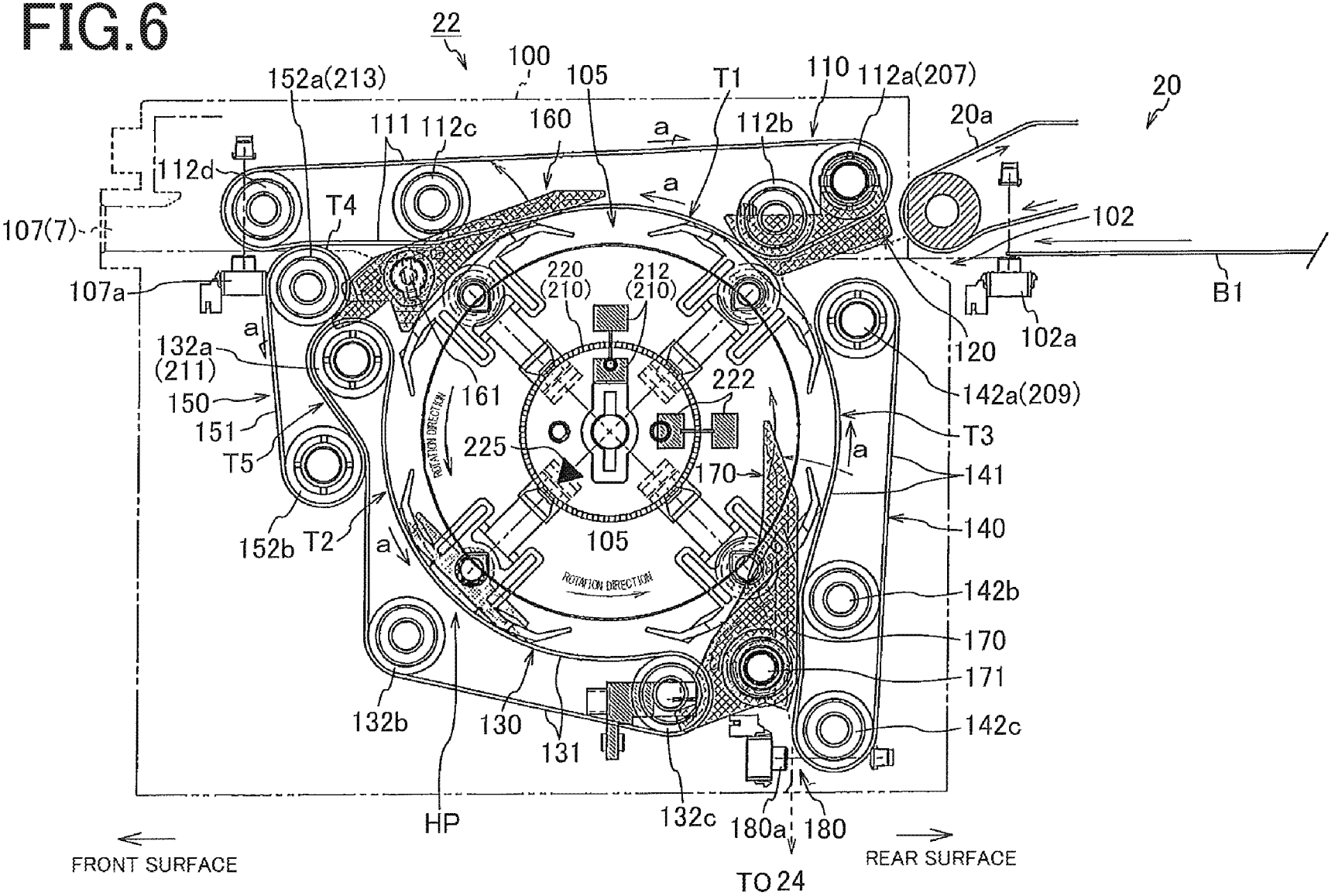
FIG. 6 is a schematic configuration diagram of a transport mechanism mainly illustrating a payout drum.
Figure 7:
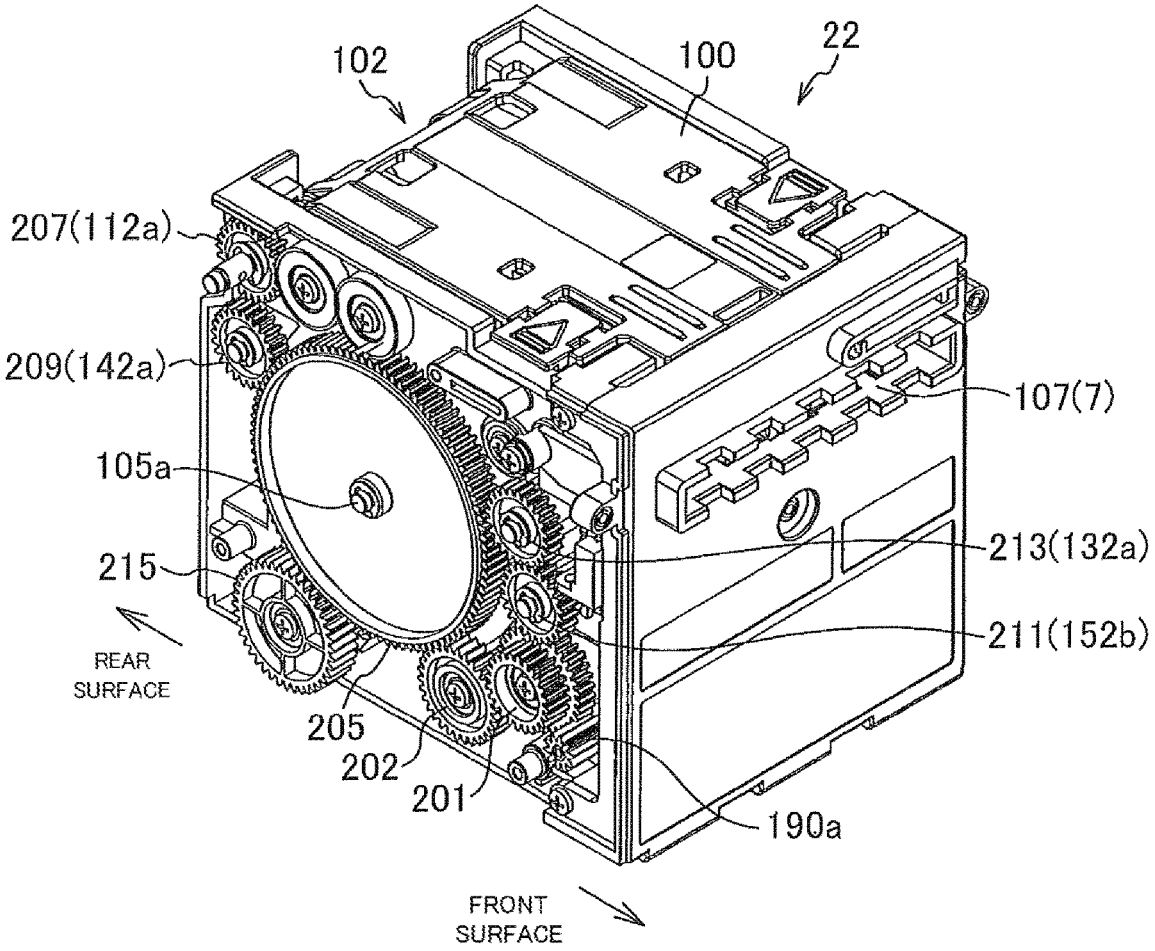
FIG. 7 is a perspective view illustrating an internal structure (a gear mechanism) of the payout accumulation unit from which a left side plate is removed.

FIGS. 4(*a*), (*b*), and (*c*) are a perspective view of an appearance and a cross-sectional view taken along a line B-B of an escrow/accumulation unit and a perspective view illustrating an appearance and a configuration of the payout accumulation unit alone. FIG. 5(*a*) is a perspective view illustrating an internal structure of the payout accumulation unit from which a right side plate is removed, (b) is a sectional perspective view taken along a line C-C in FIG. 5(*a*), (*c*) is a sectional perspective view taken along a line D-D in FIGS. 5(*a*), and (*d*) is a sectional side view taken along the line D-D. FIG. 6 is a schematic configuration diagram of a transport mechanism mainly illustrating a payout drum. FIG. 7 is a perspective view illustrating the internal structure (a gear mechanism) of the payout accumulation unit from which a left side plate is removed.

An escrow/accumulation unit 50 illustrated in FIGS. 4(*a*) and (*b*) is configured to be attachable/detachable to/from the deposit/dispense processing unit M of the case 3 in which the escrow unit 20 and the payout accumulation unit 22 are coupled to each other.

The details of the configuration of the escrow unit 20 are not related to the summary of the present invention, and therefore are not described.

The appearance and the configuration of the payout accumulation unit 22 separated from the escrow unit 20 are illustrated in FIG. 4(*c*).

The payout accumulation unit 22 includes a substantially box-shaped casing 100, a receiving port (a receiving unit) 102 that is formed to be opened in an upper portion of a rear surface of the casing 100 and receives banknotes (rejected banknotes, returned banknotes) B one by one, which are transported one by one along a long-edge direction by a transport belt 20*a* in the escrow unit 20 side, and the payout drum (a banknote (paper sheet) accumulation drum) 105 that is axially supported in the casing 100 to be rotatable in a forward direction and a reverse direction, sequentially accumulates banknotes introduced one by one through the receiving port 102 on its outer circumferential surface in a stacked state while rotating in the forward direction, pays out a batch of the accumulated banknotes through an outlet 107 by rotating in the forward direction at the time of returning after completion of accumulation, and discharges the batch to the forgotten-banknote accommodation unit (the banknote holding unit) 24 through a discharge port 180 by rotating in the reverse direction when forgotten banknotes are collected. The payout accumulation unit 22 also includes the outlet (a first outlet) 107 that serves as a discharge port when the batch of banknotes accumulated on the outer circumferential surface of the payout drum is discharged to outside of the casing (to the return port 7 of the banknote processing device), a first belt mechanism (a first transport guide member, a receiving and discharging belt mechanism) 110 that includes a first belt (a transport guide member) 111 that forms a first contact-traveling region T1 to be in contact with the outer circumferential surface of an upper portion of the payout drum 105 over a predetermined range in the circumferential direction and travels in a receiving direction (a clockwise direction a in FIG. 6) to guide a leading end of a banknote B introduced through the receiving port 102 to the outer surface of the payout drum located at a receiving standby position illustrated in FIG. 6, and a backflow-prevention first flapper (a receiving switching guide member) 120 that is located below one pulley 112*a* of a plurality of pulleys with which the first belt 111 configuring the first belt mechanism 110 is endlessly provided in a tensioned state, is biased by a spring (not illustrated) towards the outer circumferential surface of the payout drum, is pivotable up and down (while being axially supported by a rotation shaft of the pulley 112*a* of the first belt mechanism), and guides the leading end of the banknote immediately after being introduced through the receiving port to the drum outer circumferential surface by cooperating with the first belt 111. The payout accumulation unit 22 also includes a second belt mechanism (a second transport guide member) 130 and a third belt mechanism (a third transport guide member) 140. The second belt mechanism 130 includes a second belt (a transport guide member) 131 that forms a second contact-traveling region T2 that is in contact with the outer circumferential surface of the payout drum 105 over a predetermined range (from a front surface of the outer circumferential surface of the drum to a lower surface) below a front portion of the first belt mechanism 110. The third belt mechanism 140 includes a third belt (a transport guide member) 141 that forms a third contact-traveling region T3 that is in contact with the outer circumferential surface of a rear portion of the payout drum over a predetermined range behind the second belt mechanism 130. The payout accumulation unit 22 also includes a fourth belt mechanism 150 including a fourth belt 151 that is provided endlessly in a tensioned state with pulleys 152*a* and 152*b*, which are respectively arranged above and below an uppermost pulley 132*a* of a plurality of pulleys with which the second belt 131 is endlessly provided in a tensioned state, to form fourth and fifth contact-traveling regions T4 and T5 to be in contact with a lower surface of the first belt and an outer surface of the second belt, respectively, over a predetermined range, a second flapper (a first outlet switching guide member) 160 that is axially supported to be movable up and down at a front-end shaft 161 ahead of the first flapper 120 inside the outlet 107, and is elastically biased in a counterclockwise direction that is apart from the outer circumferential surface of the payout drum 105 at normal times, a solenoid (a swing solenoid, a driving source) (not illustrated) that causes the second flapper to pivot against a spring in the clockwise direction to displace a tip (a right end) of the second flapper radially inward of the payout drum, a third flapper (a switching guide member) 170 that pivots to right and left around a shaft 171 that is arranged at an approximately 180-degree opposite position (in a lower portion on a front-surface side) to the second flapper with the payout drum arranged therebetween, and is biased radially inward of the payout drum illustrated in FIG. 6 by a spring (not illustrated), the discharge port (a second outlet) 180 that discharges a forgotten banknote BB' illustrated in FIG. 17 to the forgotten-banknote accommodation unit 24, and a motor (a driving source) 190 that drives each belt mechanism and the payout drum. A dedicated control unit for the payout accumulation unit 22 may be provided separately from the control unit 300.

The payout drum 105 is a paper sheet accumulation drum that stacks and accumulates banknotes B supplied one by one on its outer circumferential surface while rotating around a rotation shaft 105*a*. The payout drum 105 includes a drum body 250 driven to rotate and a plurality of retractable members (banknote supporting members) 280 (280A and 280B) that are provided on a banknote accumulation portion of an outer circumferential surface of the drum body in a predetermined circumferential arrangement (with an interval), are each configured to be retractable between a most protruding position protruding radially outward and a retreat position retreating radially inward from the most protruding position, are each elastically biased to a protruding direction, and each come in contact with a banknote surface on its outer surface. The banknote wound on the outer circumferential surface of the banknote accumulation drum is accumulated (wound) to spread over the outer surfaces of the retractable members. It is assumed that the position in a radial direction of an outer circumferential surface of each retractable member when being located at the most protruding position illustrated in FIGS. 5(*c*) and (*d*) is uniform and an elastic biasing force is also uniform.

The belt mechanisms (the transport guide members) 110, 130, and 140 are parts that are respectively arranged at a plurality of positions along a turning (rotation) movement path of the outer circumferential surface of the payout drum and bring a banknote surface into contact (close contact) with the outer circumferential surface of the payout drum (the retractable member). Further, the belt mechanisms 110, 130, and 140 are parts that push the respective retractable members radially inward by an equal distance via the banknotes stacked on the drum outer circumferential surface by the respective belts 111, 131, and 141, to keep an outer radial (radial-direction) position of a banknote outer circumferential surface on the outer circumferential surface of the payout drum always constant irrespective of the number of sheets (the thickness) of a batch of banknotes. Therefore, the tension and the hardness of each belt are set to such degrees that the belt can uniformly push the retractable member radially inward against an elastic force that causes the retractable member to protrude radially outward.

The first flapper (a receiving switching guide member) 120 is an openable (pivotable) part that pivots around an axis of the pulley 112*a* and guides the leading end of a banknote immediately after being introduced from a receiving unit to an entrance of the first contact-driving region T1 between the drum outer circumferential surface and the transport guide member. Further, the first flapper 120 is a part that prevents a received banknote from being sent back to the receiving port 102 and is biased by a spring in such a manner that its tip is in contact with the surface of the payout drum at normal times (when not operated). Furthermore, during reverse rotation of the payout drum described later, the first flapper 120 prevents the trailing end of a banknote from being sent back from the receiving port to the escrow unit and guides that banknote to the forgotten-banknote accommodation unit 24.

The second flapper (the first outlet-switching guide member) 160 is driven by a solenoid (a swing solenoid) (not illustrated) and, after completion of accumulation of all banknotes to be returned on the outer circumference of the payout drum, operates to open a path toward the outlet 107, thereby enabling a batch of banknotes to be paid out all at once. That is, the second flapper 160 is a part that selectively switches the transport direction of a banknote entering into the first contact-traveling region T1 between the outer circumferential surface of the payout drum and the first belt 111, to either one of a direction along the outer circumferential surface of the payout drum (a downward direction) and a direction to the first outlet. That is, when being at an opening posture illustrated in FIG. 6 by being biased by a spring, the second flapper 160 opens a path from the first contact-traveling region T1 toward the outer circumferential surface of the payout drum (closes a path toward the first outlet) to enable transport of a banknote (batch) on the outer circumferential surface of the payout drum along the outer circumferential surface of the payout drum in the counterclockwise direction. Further, when being at a closing posture illustrated in FIG. 16(*c*) by being biased by a solenoid, the second flapper 160 opens the path toward the first outlet (closes the path toward the outer circumferential surface of the banknote accumulation drum) and guides the banknote (batch) on the outer circumferential surface of the payout drum body toward the first outlet from the leading end of the banknote.

The control unit 300 rotates the payout drum in the forward direction while not causing the solenoid to operate and continuing to open the second flapper (the first outlet switching guide member) 160 during the period of receiving a banknote introduced from the receiving port 102. When receiving of the banknote is finished and the batch of banknotes on the drum outer circumference is discharged through the first outlet to the outside of the device, the control unit 300 causes the solenoid to operate so that the second flapper 160 transitions to the closing posture, and rotates the payout drum in the forward direction (after the transition).

The second outlet 180 is arranged at a different position from the first outlet 107 and communicates with the forgotten-banknote accommodation unit (the banknote holding unit) 24.

The third flapper 170 is biased toward the payout drum by a spring (not illustrated) to open a path to the forgotten-banknote accommodation unit 24 at normal times (when not operated). Therefore, when the forgotten banknote BB' is discharged through the second outlet 180 by reverse rotation of the payout drum, the third flapper 170 guides this discharge by cooperating with the third belt mechanism 140. That is, the third flapper (the switching guide member) 170 is configured to be switched between the posture of closing the path to the second outlet 180 and the posture of opening that path and guiding the banknote on the drum outer circumferential surface to the second outlet. Although the third flapper is biased by the spring in the counterclockwise direction toward the payout drum at normal times, the third flapper is pushed radially outward by the banknote on the retractable members which passes in the process of the forward rotation of the payout drum, to pivot in the clockwise direction and allow the banknote on the circumferential surface of the payout drum (on the outer surface of the retractable member) to pass.

Furthermore, in a case where the payout drum rotates in the reverse direction and the batch of banknotes on the outer circumferential surface of the payout drum moves in the clockwise direction from its trailing end as described later referring to FIG. 17, the third flapper 170 opens the path to the second outlet because the third flapper 170 is biased by the spring in the counterclockwise direction toward the inside of the payout drum.

In a case where the batch of banknotes paid out through the first outlet once by forward rotation of the payout drum and the like has not been taken out by a customer after a predetermined time passes, the control unit 300 rotates the payout drum in the reverse direction to return the batch of banknotes to the inside of the device and discharge the batch through the second outlet 180 to the forgotten-banknote accommodation unit (the banknote holding unit) 24. At this time, because the third flapper 170 is located at the second-outlet opening position, it is possible to discharge the batch of banknotes through the second outlet in such a manner that its trailing end travels first, by causing the payout drum to continue to rotate in the reverse direction by a predetermined angle.

Furthermore, banknote detection sensors 102*a*, 107*a*, and 180*a* are arranged in the receiving port 102, the outlet 107, and the discharge port 180, respectively.

In the present example, the payout drum 105 is only axially supported to be rotatable in the forward and reverse directions and is driven to rotate by contact with a belt that configures each belt mechanism. However, the payout drum may be driven by a motor directly.

The first belt mechanism (the transport guide member) 110 has a configuration in which the first belt 111 is endlessly provided in a tensioned state with the pulleys 112*a* to 112*d* to be rotatable in the forward and reverse directions, and is driven by the motor 190. The first belt mechanism 110 has a function of introducing the banknote B received through the receiving port 102 from a right end of the first contact-traveling region T1 to guide the leading end of the banknote to the outer circumferential surface of the payout drum (the retractable member) and start to wind the banknote on that outer circumferential surface during forward rotation, and a function of paying out returned banknotes accumulated (stacked) on the outer circumferential surface of the payout drum to the outlet 107 by cooperating with the second flapper 160. Further, the first belt mechanism is configured to allow the pulleys 112*c* and 112*d* to move up and down with respect to the axis of the pulley 112*a* as the center. Therefore, when the banknotes are discharged through the outlet 107, the first belt 111 as a whole can rise in accordance with increase of the thickness of the banknotes passing through the pulleys 112*c* and 112*d*. While the banknotes pass by the second flapper 160 and move to a home position HP because of forward rotation, the first belt 111 between the pulleys 112*a* and 112*c*, which configures the first contact-traveling region T1, does not move up and down. Furthermore, the portion of the first belt between the pulleys 112*a* and 112*c*, which configures the first contact-traveling region T1, has a predetermined tension and therefore has a function of applying a pressing force based on the tension to a banknote surface to push the retractable member of the payout drum radially inward. That is, there is no pulley on the portion of the first belt 111 which forms the first contact-traveling region T1, and even if the thickness of banknotes on the outer circumferential surface of the payout drum facing that region T1 increases, the first belt 111 can continue to push each retractable member radially inward of the payout drum via the banknotes by a strong original-form maintaining force without being largely bent radially outward, thereby keeping the radial-direction position (the peripheral speed) of the outer circumferential surface of the banknotes always constant. This configuration is common to the respective belts 131 and 141 of the following second and third belt mechanisms 130 and 140.

The second belt mechanism 130 has a configuration in which the second belt 131 is endlessly provided in a tensioned state with the pulleys 132*a* to 132*c* to rotate in the forward and reverse directions and, while rotating in the forward direction, guides the leading end of a banknote that has moved from an exit of the first contact-traveling region T1 to the second contact-traveling region T2 by cooperating with the second flapper 160. There is no pulley on a portion of the second belt 131 which forms the second contact-traveling region T2, and even if the thickness of banknotes passing through that region T2 increases, the second belt 131 pushes the retractable members radially inward via the banknotes, thereby keeping the radial-direction position (the peripheral speed) of the outer circumferential surface of the banknotes always constant.

The third belt mechanism 140 has a configuration in which the third belt 141 is provided in a tensioned state with the pulleys 142*a* to 142*c*, contributes to stacking and transport of banknotes onto the outer circumferential surface of the payout drum while rotating in the forward direction, and has a function of discharging the forgotten banknote BB' to the forgotten-banknote accommodation unit 24 by cooperating with the third flapper 170 while rotating in the reverse direction.

The fourth belt mechanism 150 has a configuration in which the fourth belt 151 is provided in a tensioned state with the pulleys 152*a* and 152*b* and, while rotating in the forward direction, aids the operation of discharging banknotes to the outlet 107 through the fourth contact-traveling region T4 by cooperating with the second flapper 160. While rotating in the reverse direction, the fourth belt mechanism 150 returns the remaining forgotten banknotes (batch) left in the outlet 107 to the first contact-traveling region T1 and guides the banknotes to the discharge port 180.

Next, an example of a drive transmission mechanism of the payout accumulation unit is described referring to FIG. 7.

An output gear 190*a* of the motor 190 engages with a large-diameter gear 205, axially supported by the rotation shaft 105*a* of the payout drum 105 at an axial center to be rotatable with respect to each other, via two driven gears 201 and 202. The large-diameter gear 205 is freely assembled with the rotation shaft 105*a*, and is therefore rotatable with respect to the payout drum and the payout drum is not driven by the large-diameter gear. The large-diameter gear is a driven part that relays and transmits a driving force from the motor to driving gears 207, 209, 211, and 213 of the respective belt mechanisms 110, 130, 140, and 150. That is, each of the driving pulleys 112*a*, 132*a*, 142*a*, and 152*a* of the belt mechanisms 110, 130, 140, and 150 is integrated with a corresponding one of the driving gears 207, 211, 209, and 213 coaxially. Because of engagement of each driving gear with the large-diameter gear 205, the driving force from the motor is transmitted to each of the driving pulleys 112*a*, 132*a*, 142*a*, and 152*b* simultaneously to drive the belts 111, 131, 141, and 151, respectively.

The payout drum 105 is driven by friction with each of the belts 111, 131, 141, and 151 that are in contact with the outer circumferential surface thereof, to be rotated together with each of the belts, so that the payout drum and the belts can rotate and travel at the same speed as each other. Because the payout drum is driven to rotate by being rotated by a force of friction with each belt at the same speed and winds a banknote on its outer circumferential surface, there is no difference between the traveling speed of the belts and the speed of the payout drum, so that it is possible to accumulate fed banknotes without misalignment between a winding start portion (a banknote-leading-end positioning portion) on the payout drum side and the position of a leading end of each banknote.

If the payout drum and the group of belts are driven individually of each other while the payout drum and the belts are in contact with each other, it is necessary to synchronize the rotation speed of the payout drum and the feed speed of the group of belts with each other, causing difficulty in speed control, gear adjustment, and the like.

With the configuration of the present invention, there is no such disadvantage or inconvenience.

A medium-diameter gear 215 located at the lowermost position on the receiving port 102 side is a gear that drives a transport mechanism on the forgotten-banknote accommodation unit 24 side. This gear 215 is driven by the motor 190 via the large-diameter gear 205.

Next, configurations and operations of the payout drum and relevant parts are described referring to FIGS. 8 to 11.

Figure 8A:
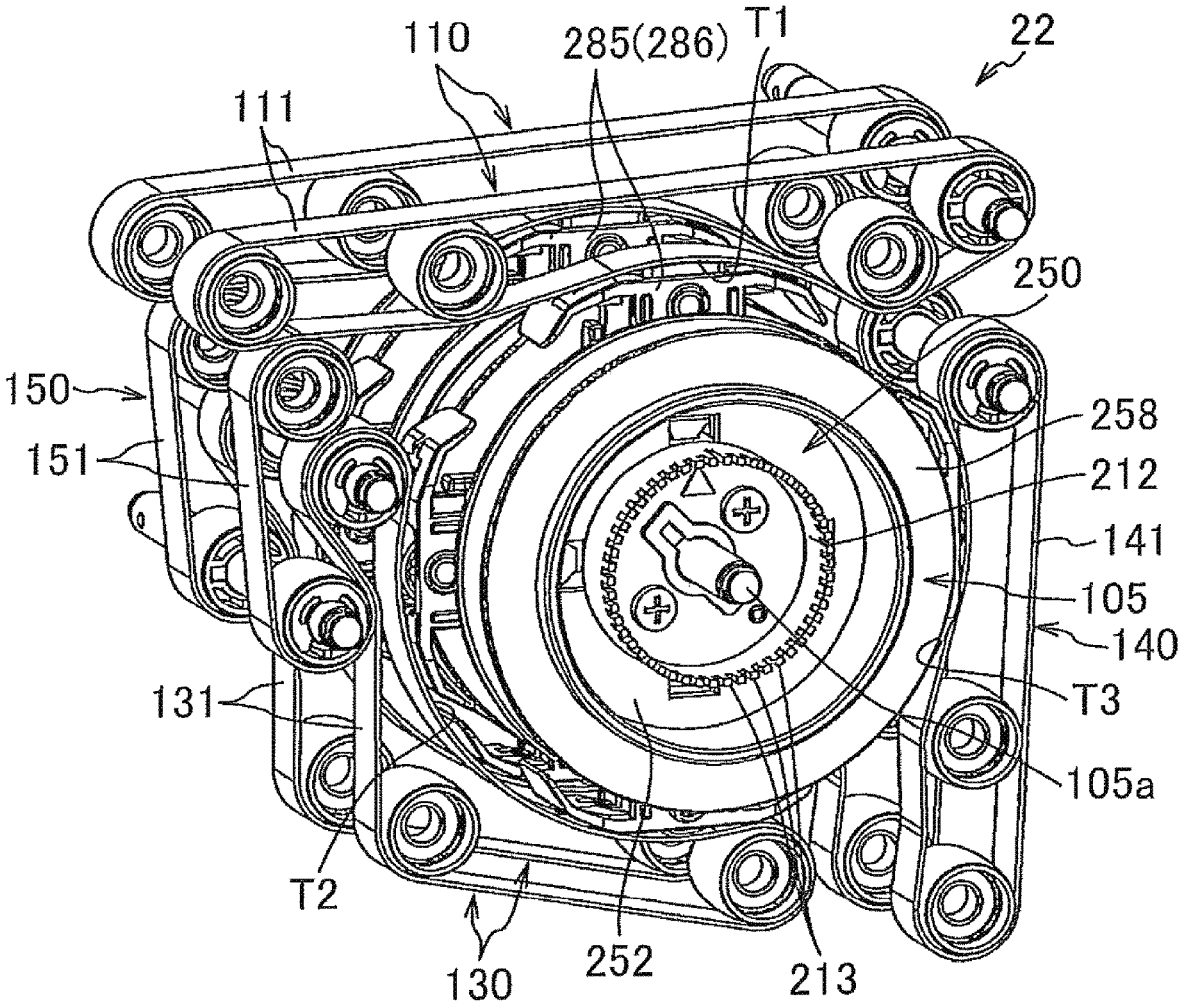
FIGS. 8(*a*), (*b*), and (*c*) are a perspective view illustrating a state where each belt mechanism is arranged with respect to the payout drum, a perspective view of an appearance of the payout drum alone, and a longitudinal sectional perspective view illustrating a support mechanism for a retractable member, respectively.
Figure 8B:
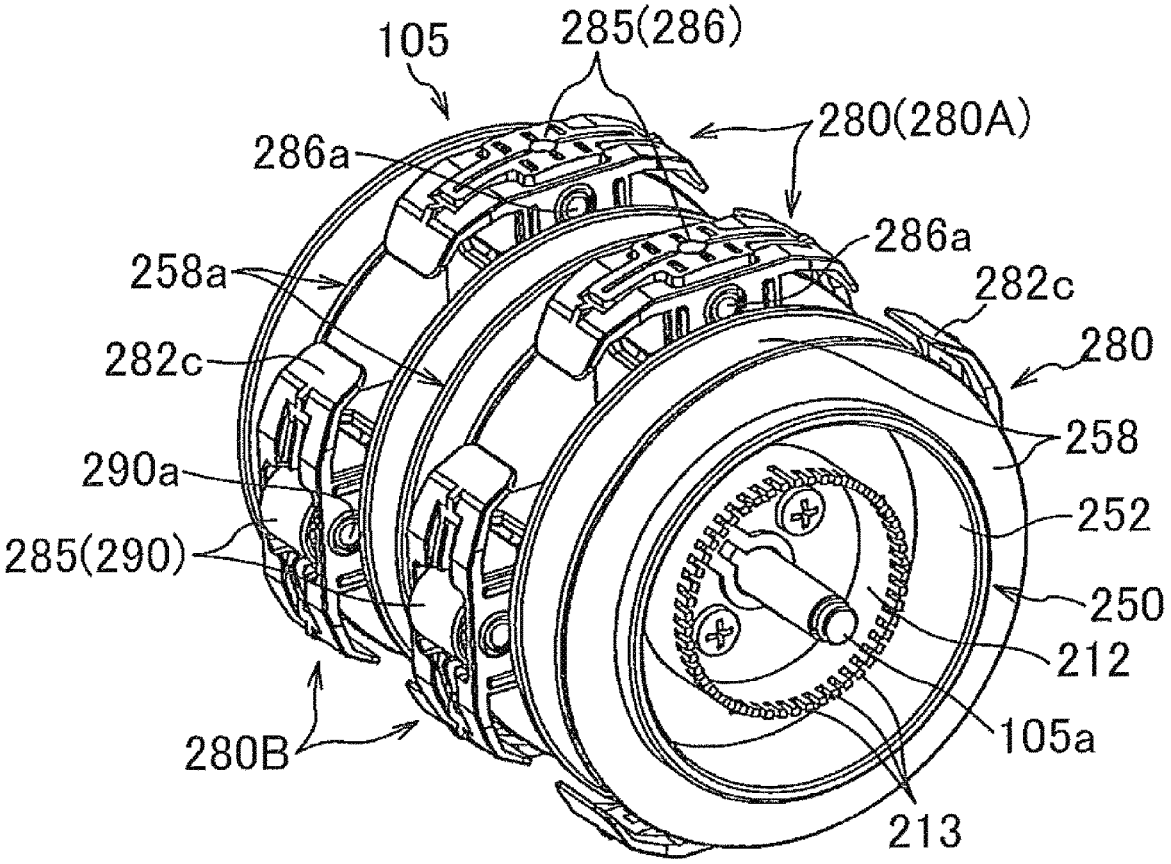
Figure 8C:
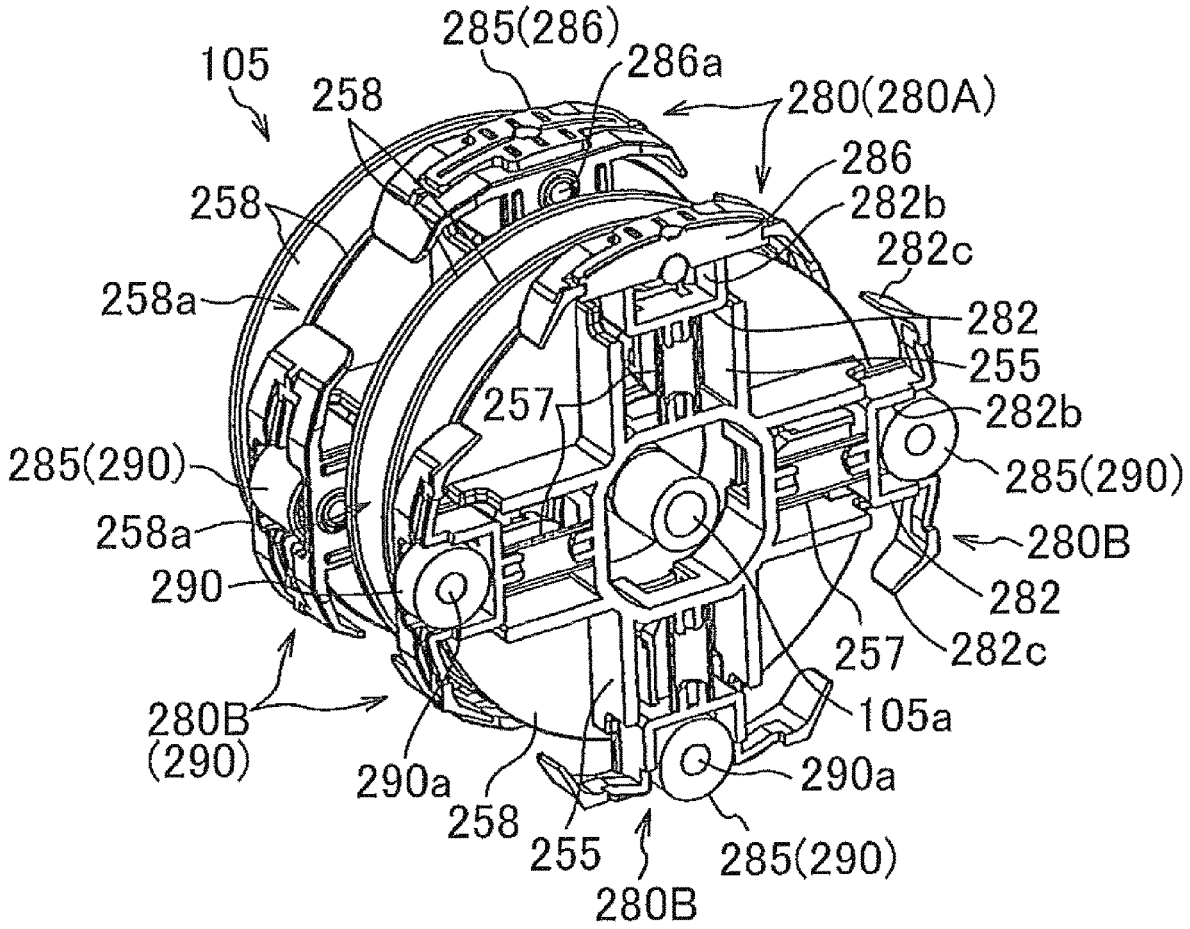
Figure 9A:
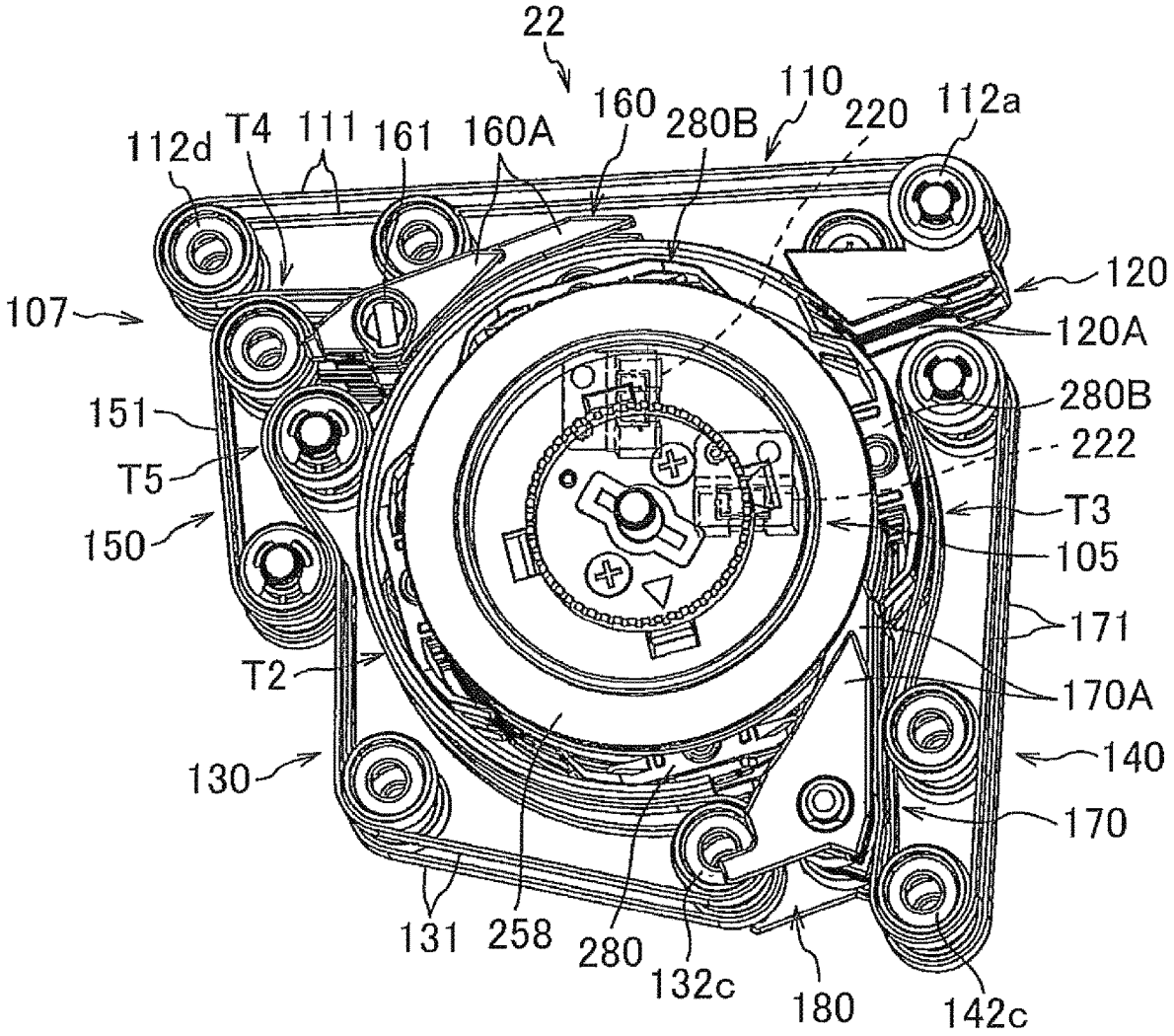
FIGS. 9(*a*) and (*b*) are perspective views illustrating states where each belt mechanism and each flapper are arranged with respect to the payout drum.
Figure 9B:
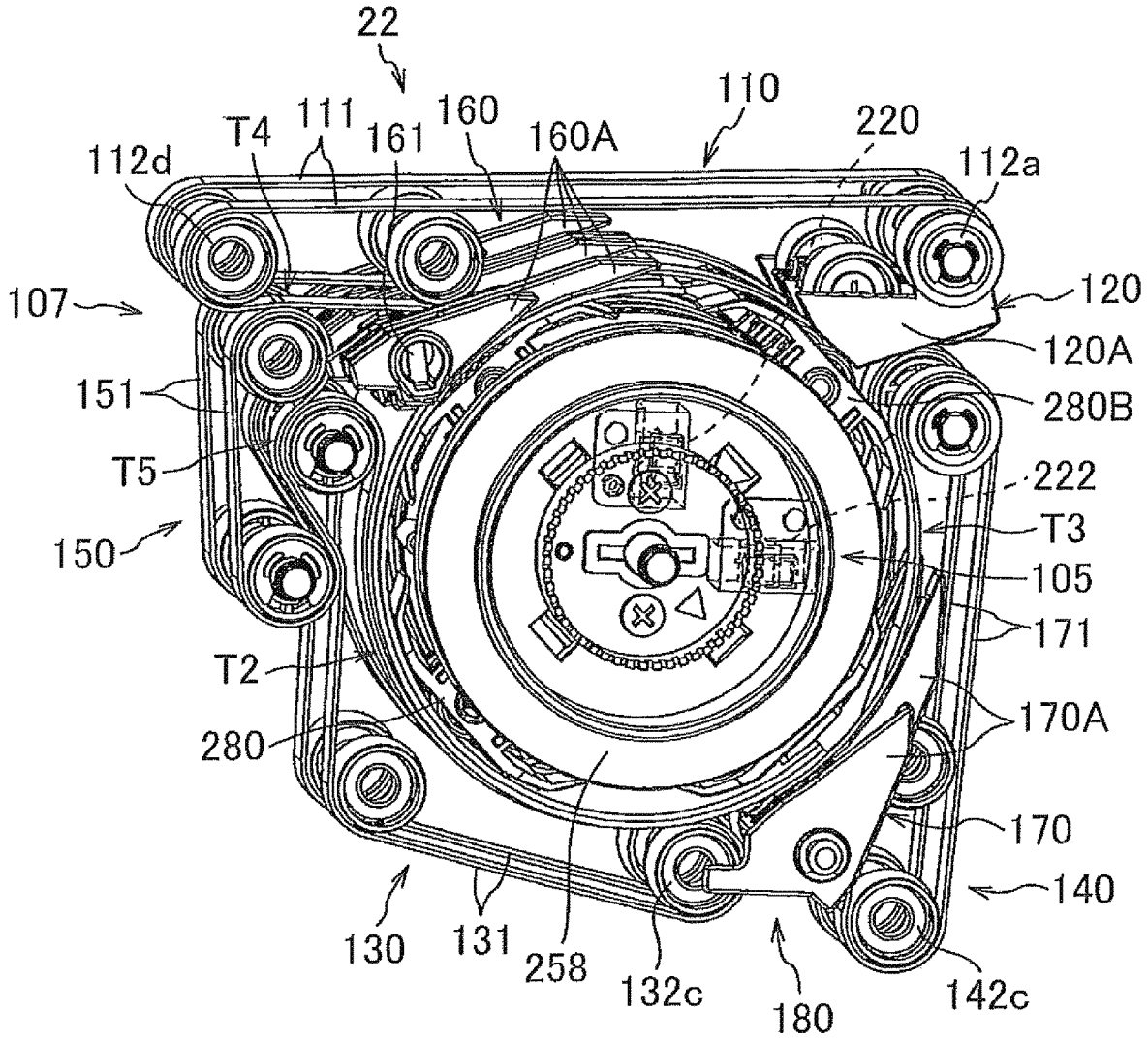
Figure 10A:
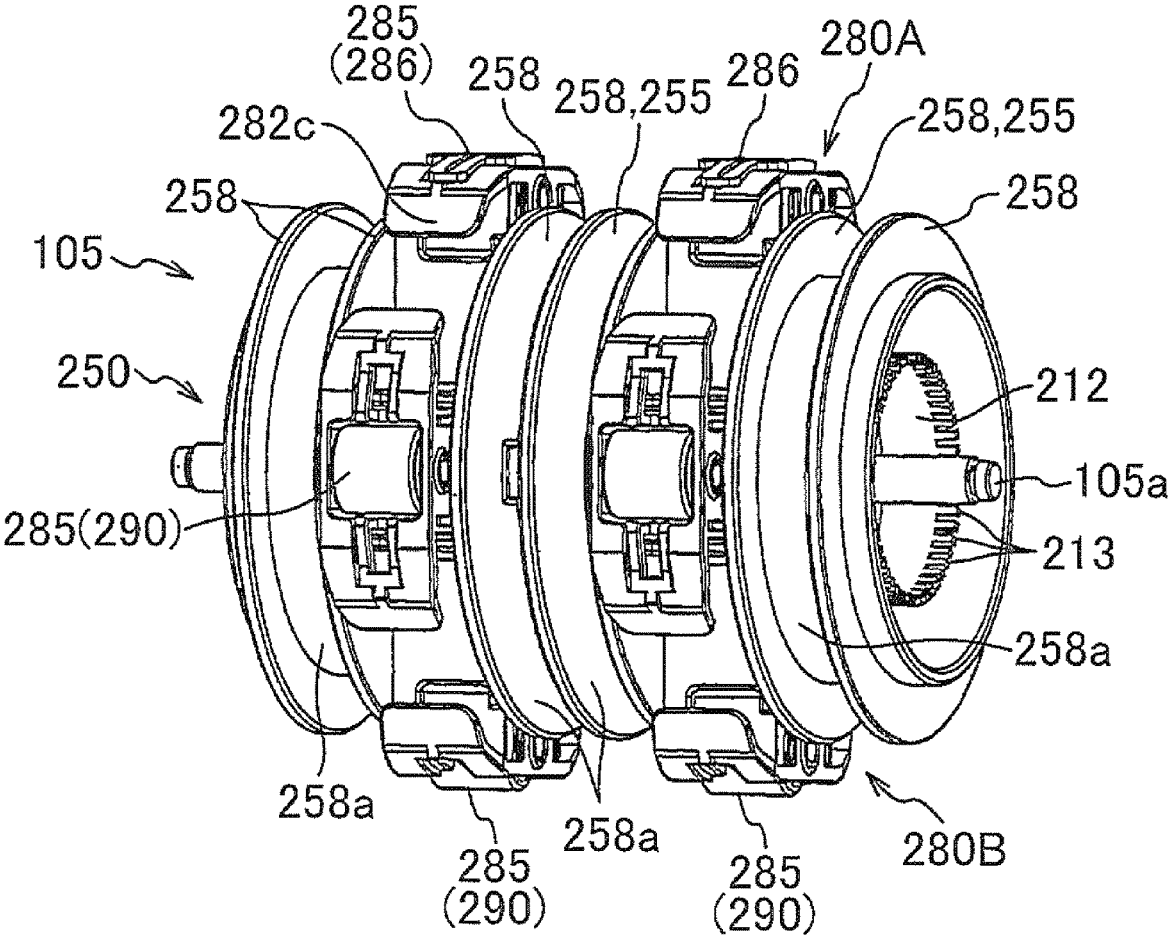
FIGS. 10(*a*), (*b*), and (*c*) are a perspective view of an appearance, a longitudinal sectional perspective view, and a longitudinal sectional side view of the payout drum, respectively.
Figure 10B:
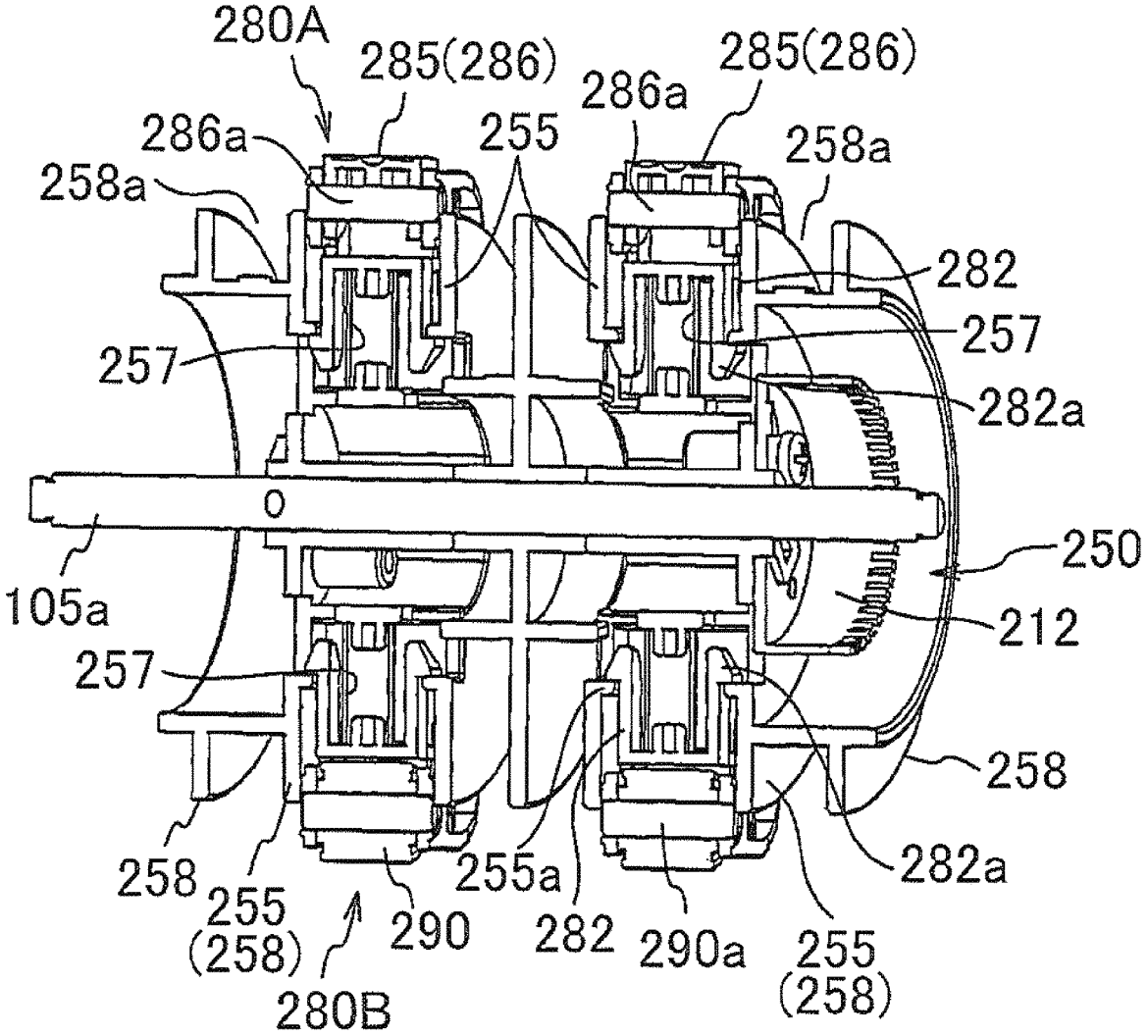
Figure 10C:
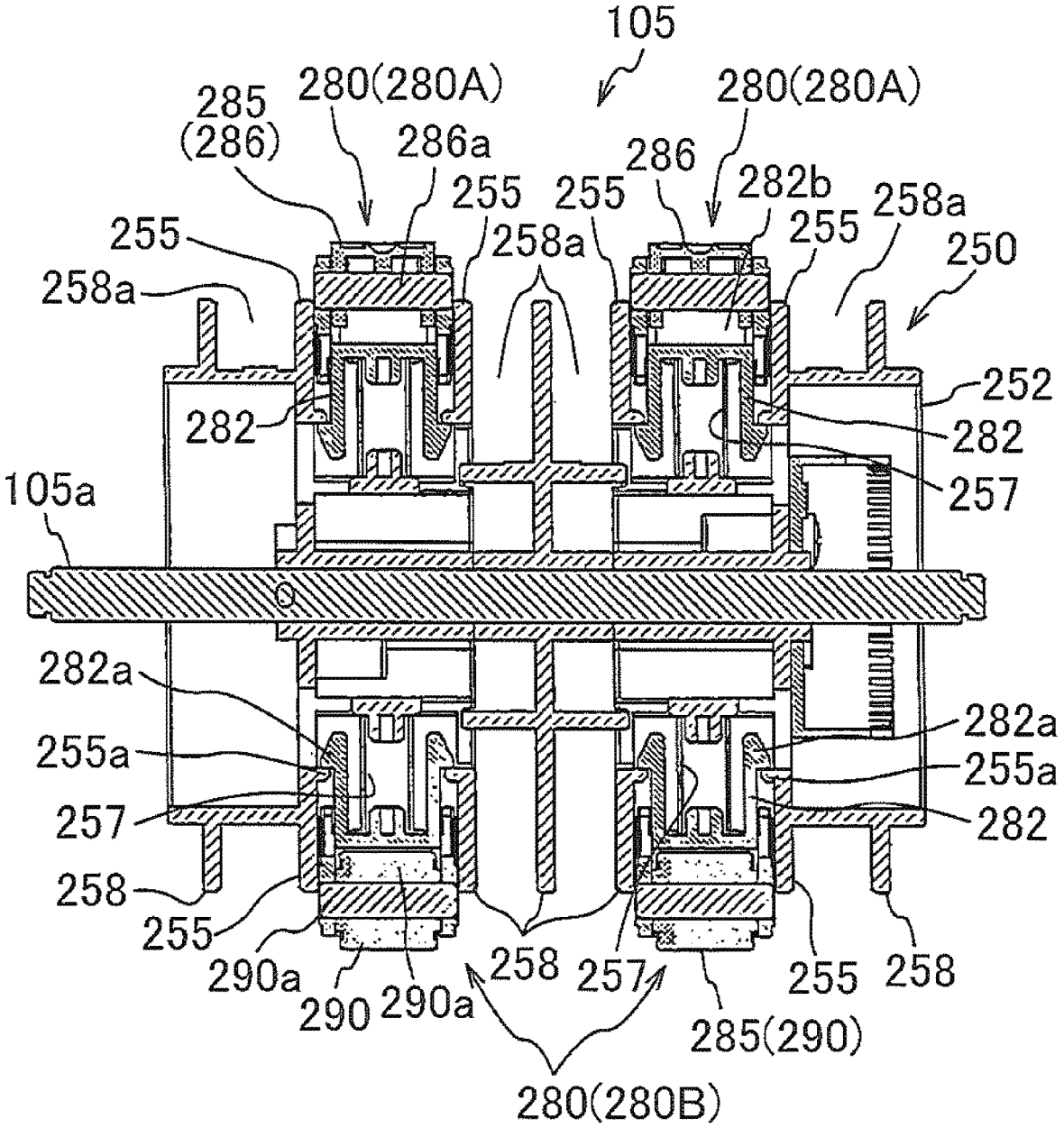
Figure 11A:
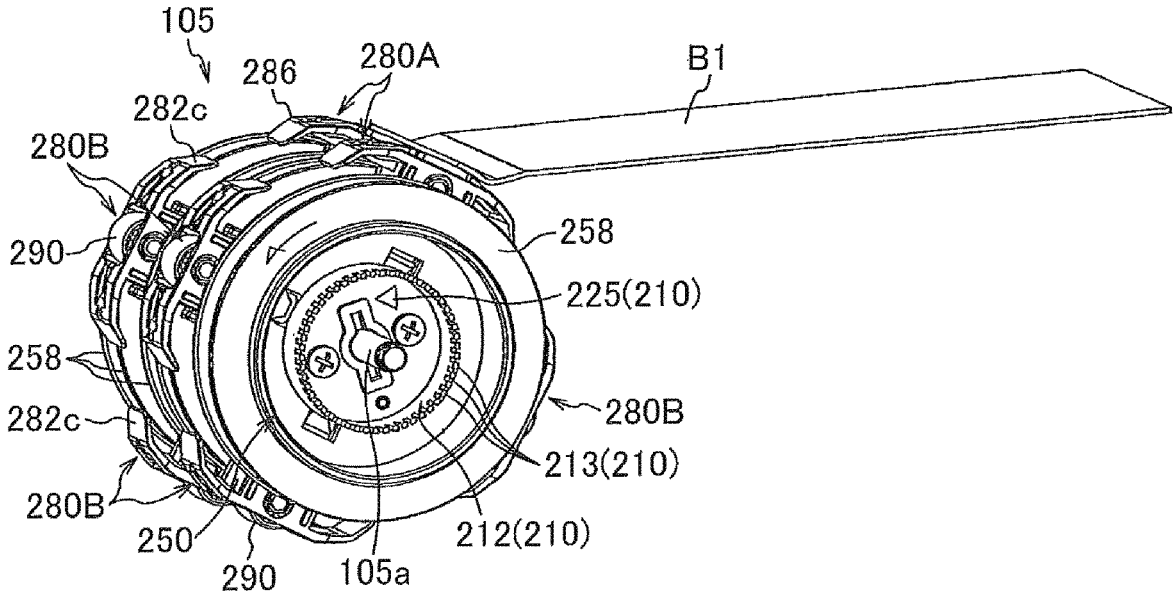
FIGS. 11(*a*), (*b*), and (*c*) are perspective views illustrating a procedure in which a banknote is wound around the payout drum.
Figure 11B:
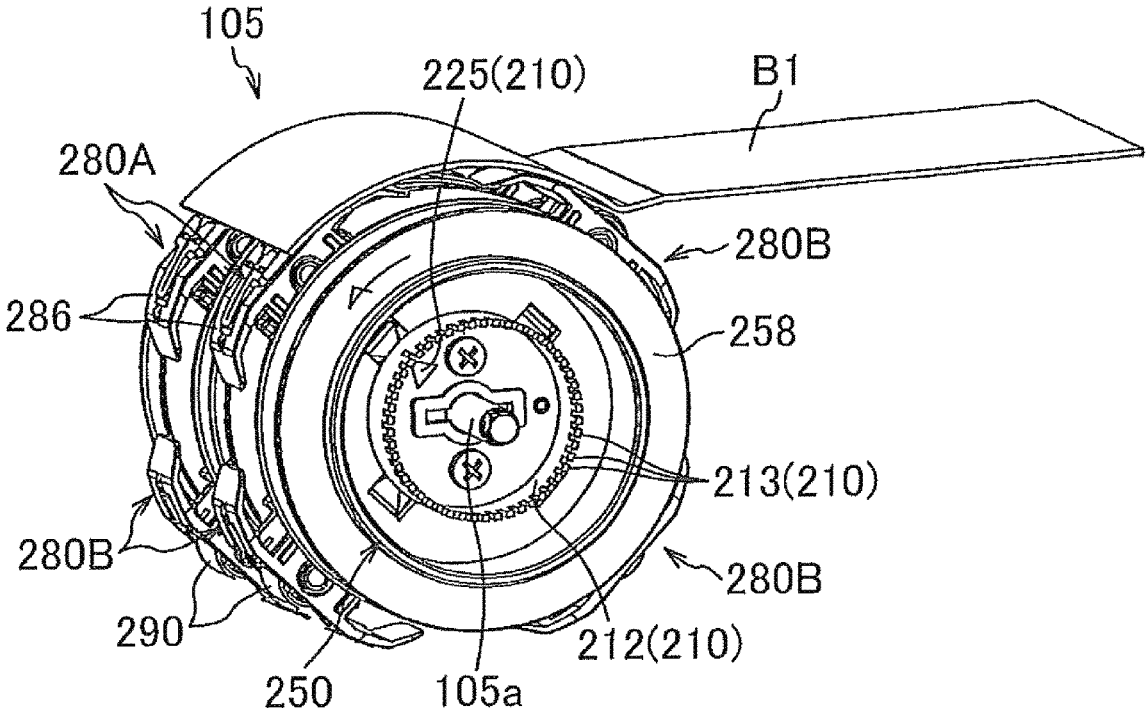
Figure 11C:
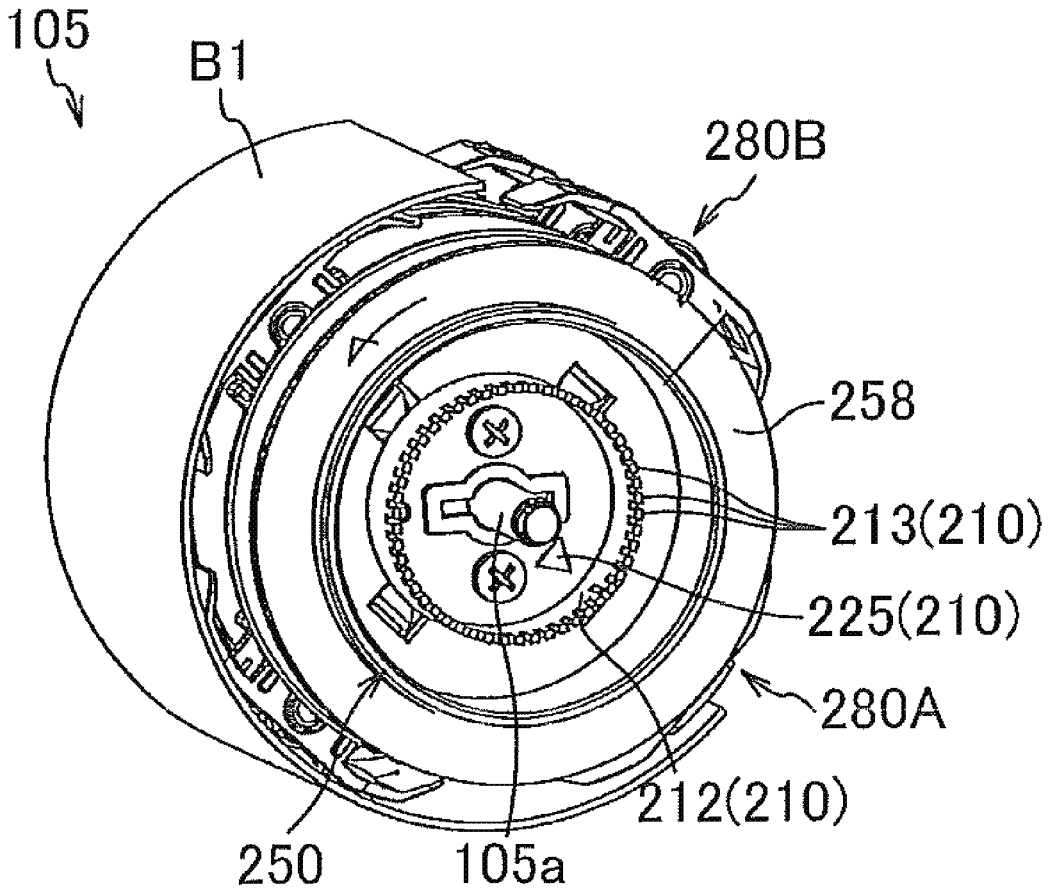

FIGS. 8(*a*), (*b*), and (*c*) are a perspective view illustrating a state where each belt mechanism is arranged with respect to the payout drum, a perspective view of an appearance of the payout drum alone, and a longitudinal sectional perspective view illustrating a support mechanism for the retractable member, respectively. FIGS. 9(*a*) and (*b*) are perspective views illustrating states where each belt mechanism and each flapper are arranged with respect to the payout drum. FIGS. 10(*a*), (*b*), and (*c*) are a perspective view of the appearance, a longitudinal sectional perspective view, and a longitudinal sectional side view of the payout drum, respectively. FIGS. 11(*a*), (*b*), and (*c*) are perspective views illustrating a procedure in which a banknote is wound around the payout drum.

The payout drum (the banknote accumulation drum) 105 is a part that accumulates the banknotes B supplied to its outer circumferential surface from the receiving port 102 one by one in such a manner that the banknotes B are stacked with leading edges thereof aligned with each other, while rotating around the rotation shaft 105*a* in the forward direction (FIG. 11). The payout drum 105 includes the drum body 250 driven to rotate and the retractable members (the banknote supporting members) 280 that are provided on a banknote accumulation portion of an outer circumferential surface of the drum body in a predetermined circumferential arrangement (with an interval), are each configured to be retractable between a most protruding position protruding from the drum body radially outward and a retreat position retreating radially inward from the most protruding position, are each elastically biased to a protruding direction, and each come into contact with a banknote surface on its outer surface. The banknotes accumulated on the outer circumferential surface of the payout drum are wound to spread over the outer surfaces of the retractable members 280.

The drum body 250 includes a base member 252 integrated with the rotation shaft 105*a* of the drum and guide members 255 that are provided integrally with the base member, are arranged with a 90-degree interval in the circumferential direction to protrude radially outward, and guide the retractable members. In the present example, each guide member 255 has a hollow quadrangular prism shape and supports the retractable member 280 by its inner wall in such a manner that the retractable member 280 can move radially inward and outward and do not fall out. Each retractable member 280 is elastically biased radially outward (in the protruding direction) by a uniform force applied by each elastic member 257.

By setting the weight of each retractable member and a spring force of each elastic member to be equivalent to each other, each retractable member can be displaced radially inward by an equal distance by pressure application by a belt.

The base member 252 includes seven disk-shaped partition members 258 arranged in an axial direction of the rotation shaft 105*a* with a predetermined interval and four annular grooves 258*a* that are formed between adjacent partition members to receive four nails 120A, 160A, and 170A (see FIG. 9) configuring the flappers 120, 160, and 170, respectively. The second and third partition members 258 from both sides in the axial direction also serve as the guide members 255. The retractable members 280 and the elastic members 257 are accommodated between the guide members 255 to be displaceable and movable in the axial direction and not to fall out. Hooks 255*a* formed on opposed surfaces of the guide members 255 as illustrated in FIGS. 10(*b*) and (*c*) each catch a hook 282*a* provided on the retractable member to prevent the retractable member from falling out radially outward.

The nail 120A, 160A, or 170A of each flapper can cause its tip (a portion of contact with a banknote) to enter radially inward beyond the outermost circumferential surface of each retractable member because of presence of the annular grooves 258*a* arranged along the axial direction in an outer circumferential surface of the base member 252. Meanwhile, when the banknote surface is in contact with the outer circumferential surface of each retractable member, the banknote closes the annular grooves 258*a*. Therefore, the tip of each nail comes into contact with the banknote and cannot enter radially inward beyond the banknote.

As illustrated in FIG. 10, each retractable member 280 includes a guided member (a sliding member) 282 that moves radially inward and outward along the wall of the guide member 255 and is biased by the elastic member 257, and a contact member 285 that is mounted on the guided member to come into contact with the banknote and support the banknote on its outer surface. Each guided member 282 has a recess 282*b* at the center in the circumferential direction. Banknote guide pieces 282*c* project from both sides in the circumferential direction of the recess symmetrically.

The recess 282*b* is not essential.

The guided members 282 of one pair of retractable members 280A of four pairs of retractable members 280 are different from those of the other three pairs of retractable members 280B in that the winding start portion (a banknote-leading-end positioning portion) 286 formed by a friction pad as the contact member 285 is arranged to be pivotable (swingable). The winding start portion 286 is axially supported by a shaft 286*a* supported by the retractable member to be pivotable in a predetermined small angle range.

It suffices that the shaft 286*a* is supported by the tip of the guided member 282 not to fall out, and the supporting structure for the shaft 286*a* is not limited. The winding start portion 286 may pivot together with the shaft 286*a* or may be configured in such a manner that only the winding start portion pivots with respect to the fixed shaft 286*a*.

In each of the recesses 282*b* of the guided members of the other three pairs of retractable members 280B, a roller (a rotating body) 290 for reducing friction is axially supported by a shaft 290*a* to be rotatable. The supporting structure for this shaft 290*a* may be also any structure, as with the shaft 286*a*.

The winding start portion 286 is a part that transports a banknote while sandwich-pressing and holding the leading end of the banknote between the winding start portion 286 and a belt surface, and is therefore formed as a slip prevention portion (for example, rubber) for which a friction constant of an outer surface that comes into contact with the banknote is set to be large. The winding start portion 286 is supported by the guided member 282 to be pivotable in a seesaw manner, so that it is possible to flexibly change the posture of supporting the leading end of the banknote by being subjected to a pressing force applied from the belt via the banknote, so that application of an excess load to the banknote can be prevented, and it is possible to stably lead the leading end of the banknote to a winding direction.

Meanwhile, the other three pairs of retractable members 280B are each configured in such a manner that sliding can be easily caused by a rotatable roller 290 between the retractable member 280B and the banknotes, because it is necessary to avoid friction with the banknote when the retractable member 280B is retracted radially inward in accordance with increase of the thickness of the banknotes. In place of the rotating roller, a member formed of a material having a small frictional resistance may be supported to be swingable in a predetermined narrow angle range as with the winding start portion 286.

If the slip prevention portion having a large frictional resistance is arranged on the outer surfaces of the three pairs of retractable members 280B, a local portion of a banknote is strongly sandwich-pressed between the slip prevention portion and the belt and therefore cannot slip even when each retractable member 280B moves radially inward by a pressure from the belt in accordance with increase of the thickness of banknotes on the outer circumferential surface of the payout drum. Therefore, the retractable members 280B cannot be smoothly displaced radially inward. On the other hand, by providing the roller 290 in a portion of contact between the three retractable members 280B and a banknote to enable the banknote to be slidable in the circumferential direction as in the present example, it is possible to prevent a sandwich-pressing force by the belt from causing tension of the banknote to prevent radially-inward displacement of the retractable member. Therefore, it is possible to smoothly perform an operation of reducing the diameter of the outer circumferential surface of the banknotes by radially-inward retreat of the retractable member.

Although the four retractable members are equidistantly arranged in the circumferential direction in the present example, the number is merely an example. Further, the banknote guide pieces 282*c* each having both tips inclined radially inward are provided in each guided member 282 that configures the retractable members 280, thereby ensuring a wide area of contact with the banknote to improve stability of supporting and adhesion in winding.

In a process in which a banknote B1 introduced into the outer circumferential surface of the payout drum is sequentially wound around the other roller 290 from the winding start portion 286 as illustrated in FIGS. 11(*a*), (*b*), and (*c*), a belt configuring a belt mechanism (not illustrated) uniformly presses each of the retractable members 280A and 280B radially inward via the banknote B1 by the thickness of the banknote. In this process, each guided member 282 can retreat radially inward while resisting the elastic member 257. Therefore, the radial-direction position of the outermost circumferential surface of banknotes wound in the form of a roll between the retractable members is always constant and the peripheral speed is also constant.

Next, an encoder mechanism 210 is described.

As illustrated in FIGS. 6 and 8 to 13, for example, the encoder mechanism 210 generally includes a code wheel 212 that has a plurality of slits 213 with a predetermined pitch in its outer circumference and is configured coaxially with the payout drum 105 (the drum body) to rotate integrally with the payout drum 105, a first detector 222 for detecting a HP of the payout drum and a second detector 220 for (a rotation-angle detector) detecting a rotational position of the payout drum, each configured by a photo interrupter that includes a light-emitting portion and a light-receiving portion opposed to each other with a movement path of the many slits 213 formed with the predetermined pitch in an edge of the code wheel arranged therebetween, and a home-position mark 225 that is formed by printing on the base member 252 of the drum body.

Each of the detectors 220 and 222 is fixed to a fixing portion of the device body in a state where the light-emitting portion and the light-receiving portion sandwich the movement path of the slits 213 of the code wheel therebetween. Based on a signal that is obtained by receiving detection light from the light-emitting portion, which has passed through the slits 213, by the light-receiving portion, the control unit counts the number of outputs per unit time with regard to each detector to detect the number of revolutions and the rotation speed of the code wheel 212.

While most of the slits 213 have the same length in the axial direction as each other, a specific slit is configured to be longer than the other slits to enable detection that the winding start portion 286 of the payout drum reaches the home position HP. A short slit for detecting a rotational angle is arranged in a range of detection by the second detector 222, and can be detected by the second detector. The moving amount (the amount of rotation, the rotational angle position) of the payout drum is detected based on the number of pulses obtained from the short slit.

Longer portions of long slits for HP detection (portions longer than the short slit) are arranged at axial-direction positions that can be detected by the first detector 220 only. When the payout drum rotates by a predetermined angle after detection of a long slit by the first detector 220, the center in the circumferential direction of the winding start portion 286 reaches the home position. The moving amount of the long slit to the home position is calculated based on the number of pulses obtained by detecting the short slits by the second detector 222.

The home-position mark 225 is formed on a side surface of the base member 252 of the drum body to correspond to a long slit in such a manner that the position of the long slit in the code wheel 212 can be visually confirmed at the time of assembly or the like. That is, the home-position mark 225, the long slit, and the winding start portion 286 are formed and arranged at the same circumferential-direction position, and the home-position mark 225 is formed in order to make the long slit and the winding start portion coincident with each other at the time of assembly.

[Operation of Winding and Accumulating Banknote]

Figure 18:
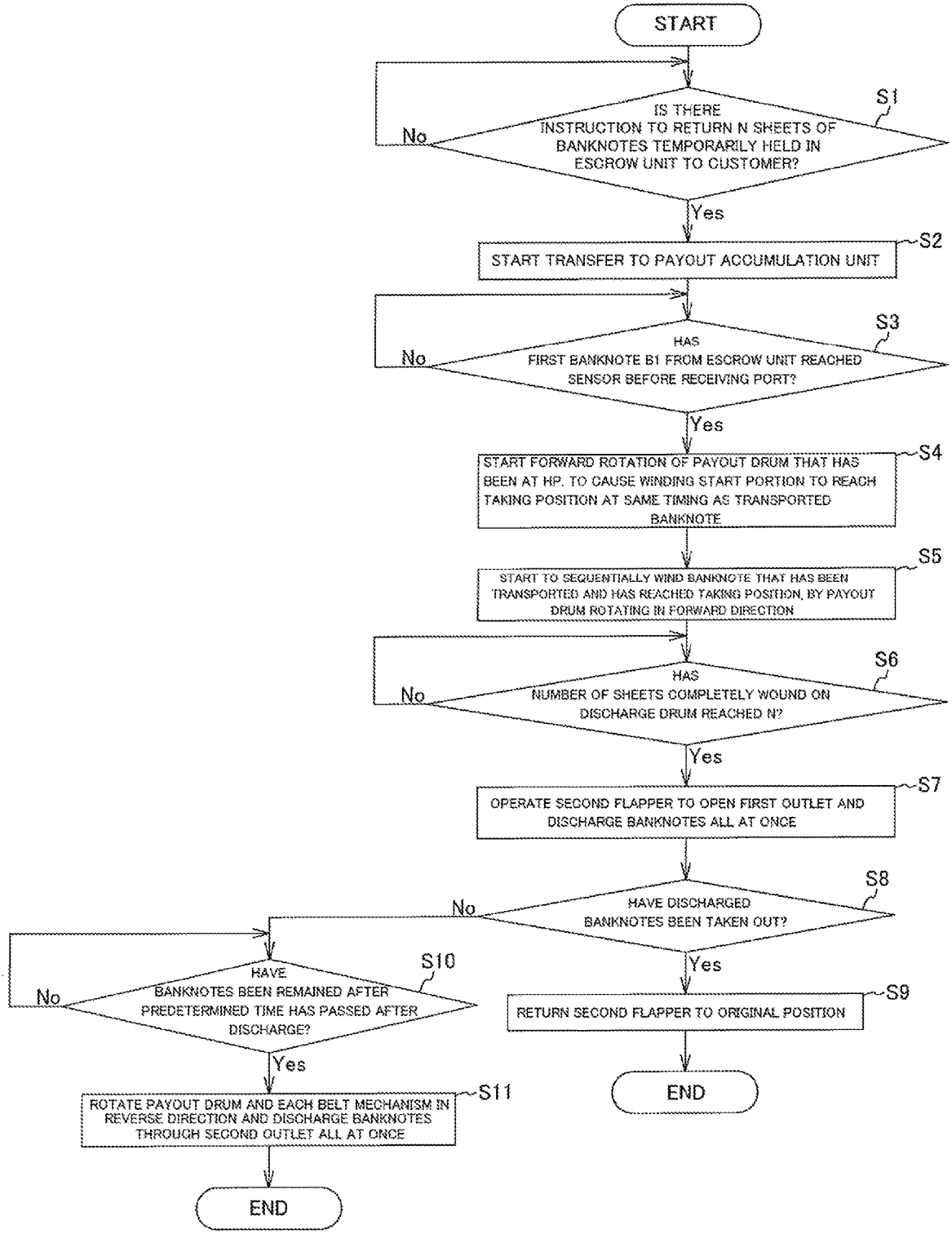
FIG. 18 is a flowchart of the accumulating operation, the batch payout operation, and the forgotten-banknote handling operation.

Next, an example of an operation of winding and accumulating a banknote on an outer circumference of a payout drum is described based on FIGS. 12 to 15 and a flowchart in FIG. 18.

Figure 12A:
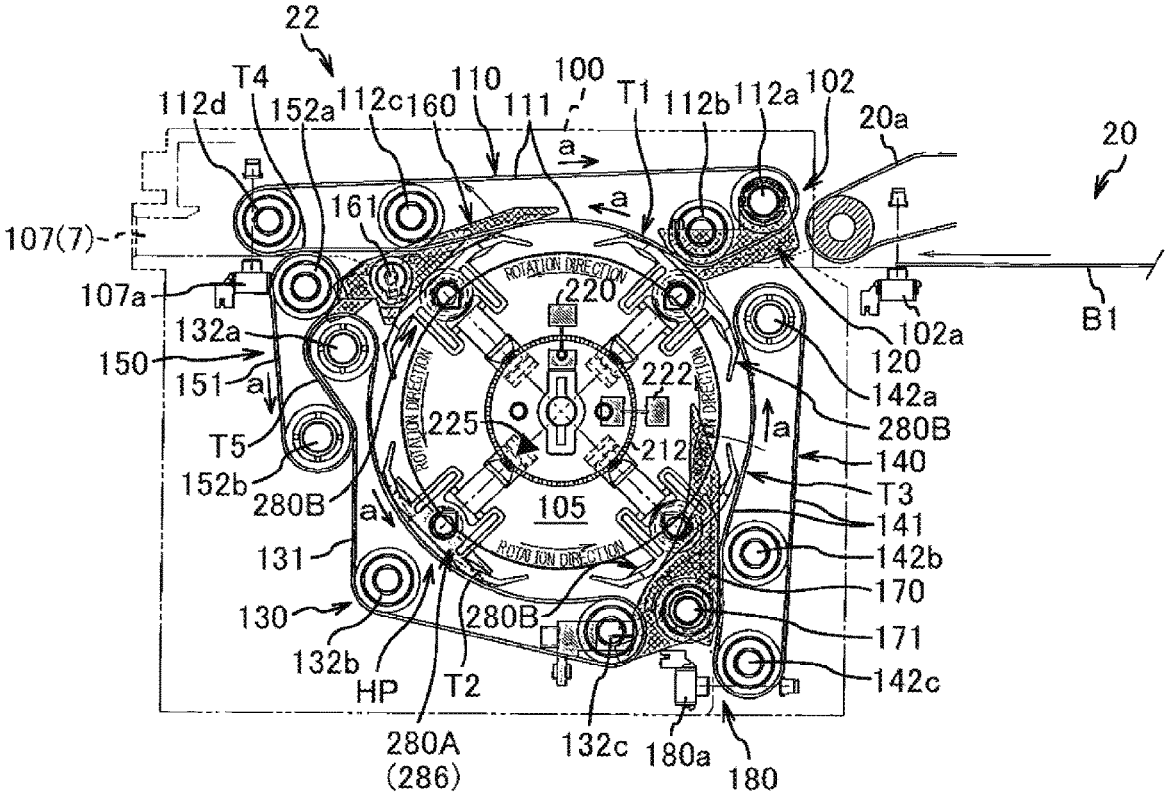
FIGS. 12(*a*) to (*c*) are explanatory diagrams of an accumulating operation that winds a banknote on the outer circumference of the payout drum.
Figure 12B:
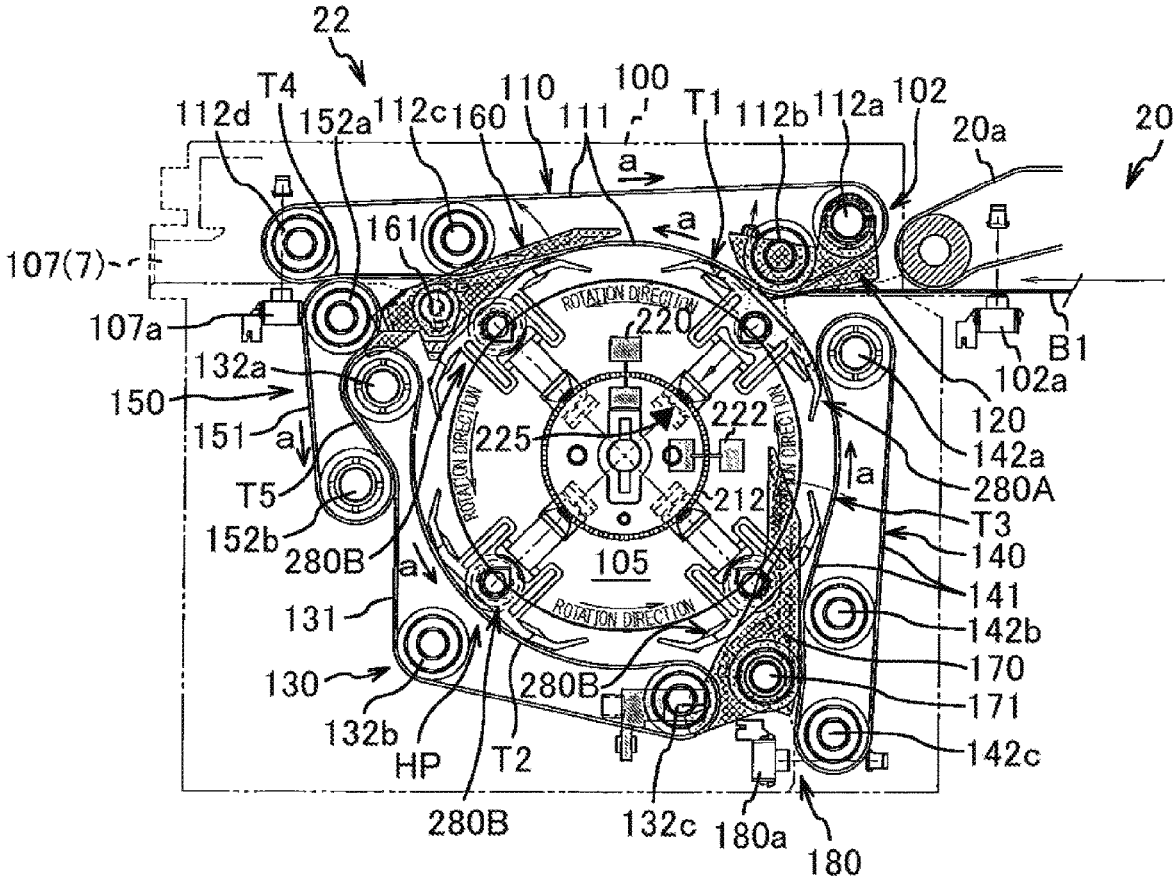
Figure 12C:
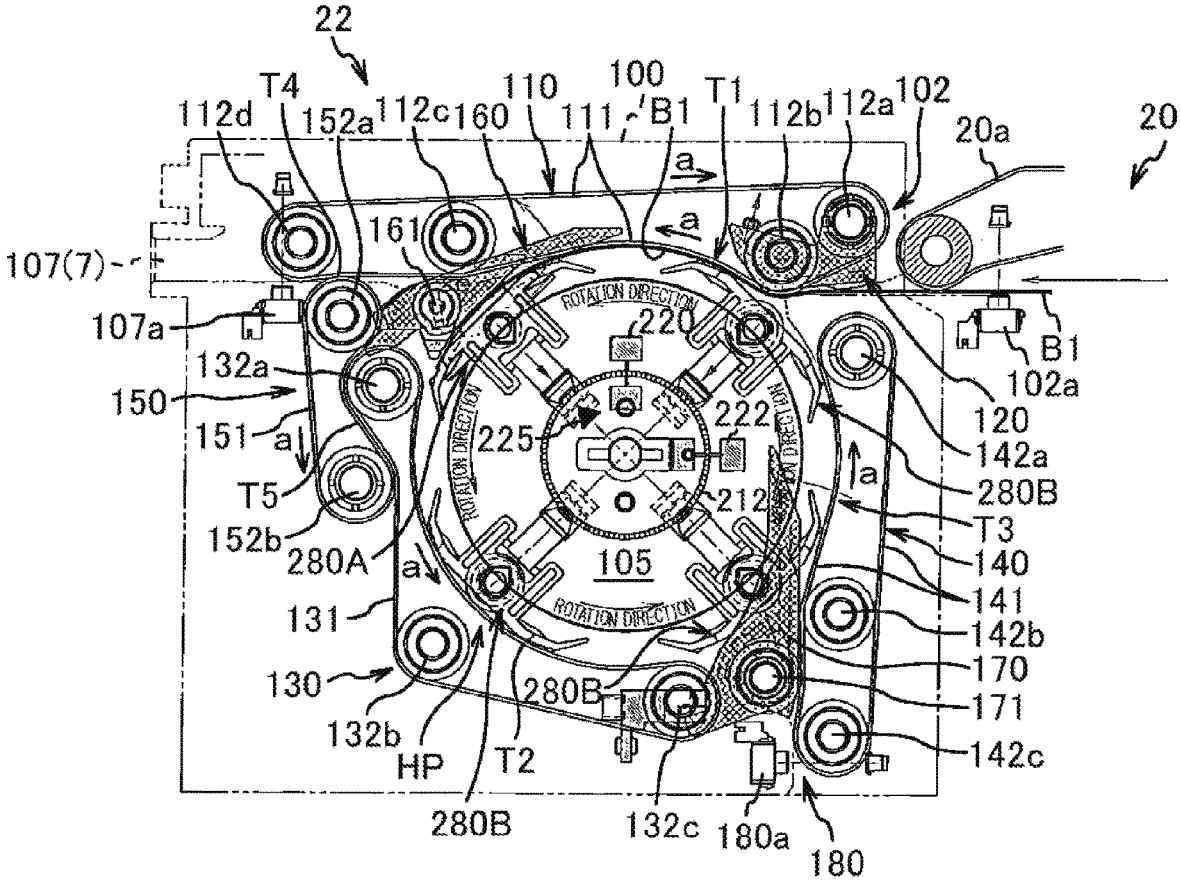
Figure 13D:
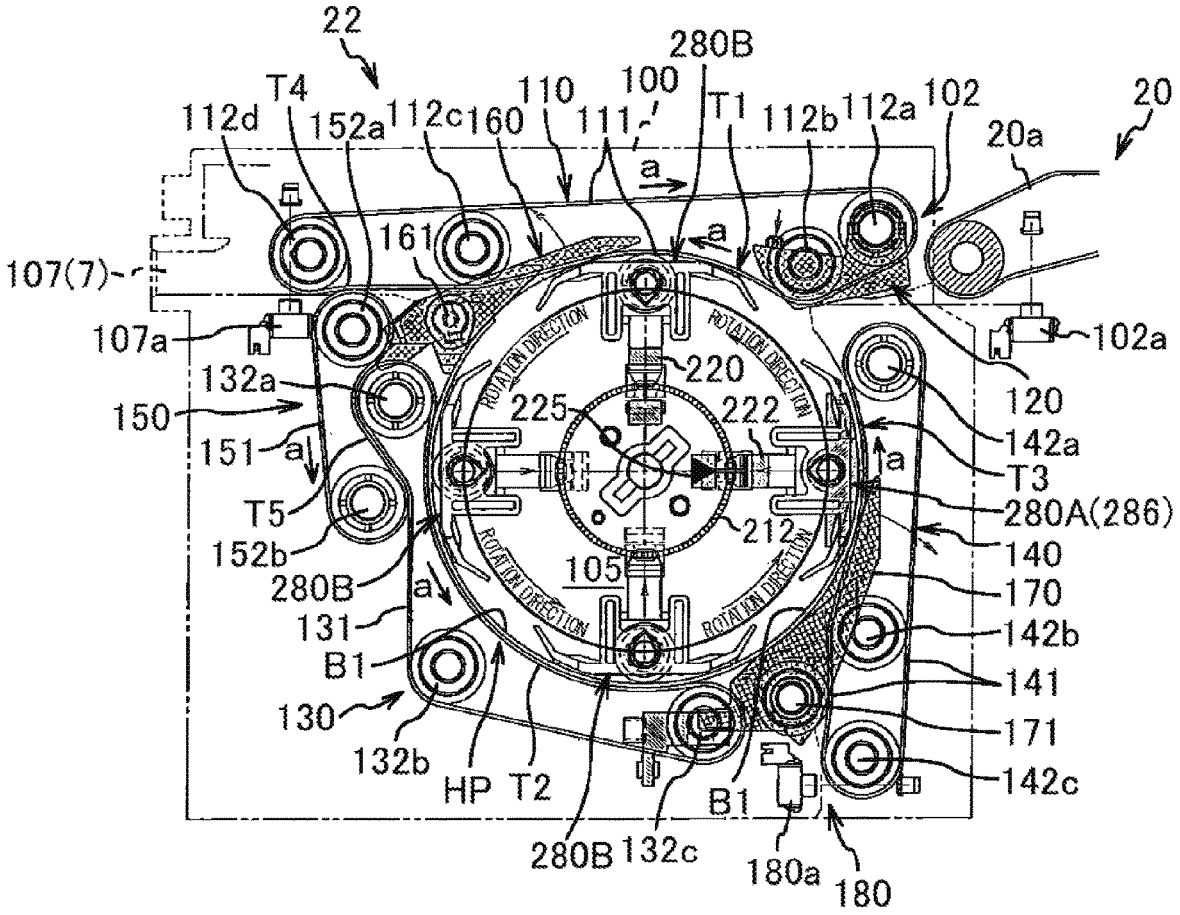
FIGS. 13(*d*) and (*e*) are explanatory diagrams of a procedure following the accumulating operation.
Figure 13E:
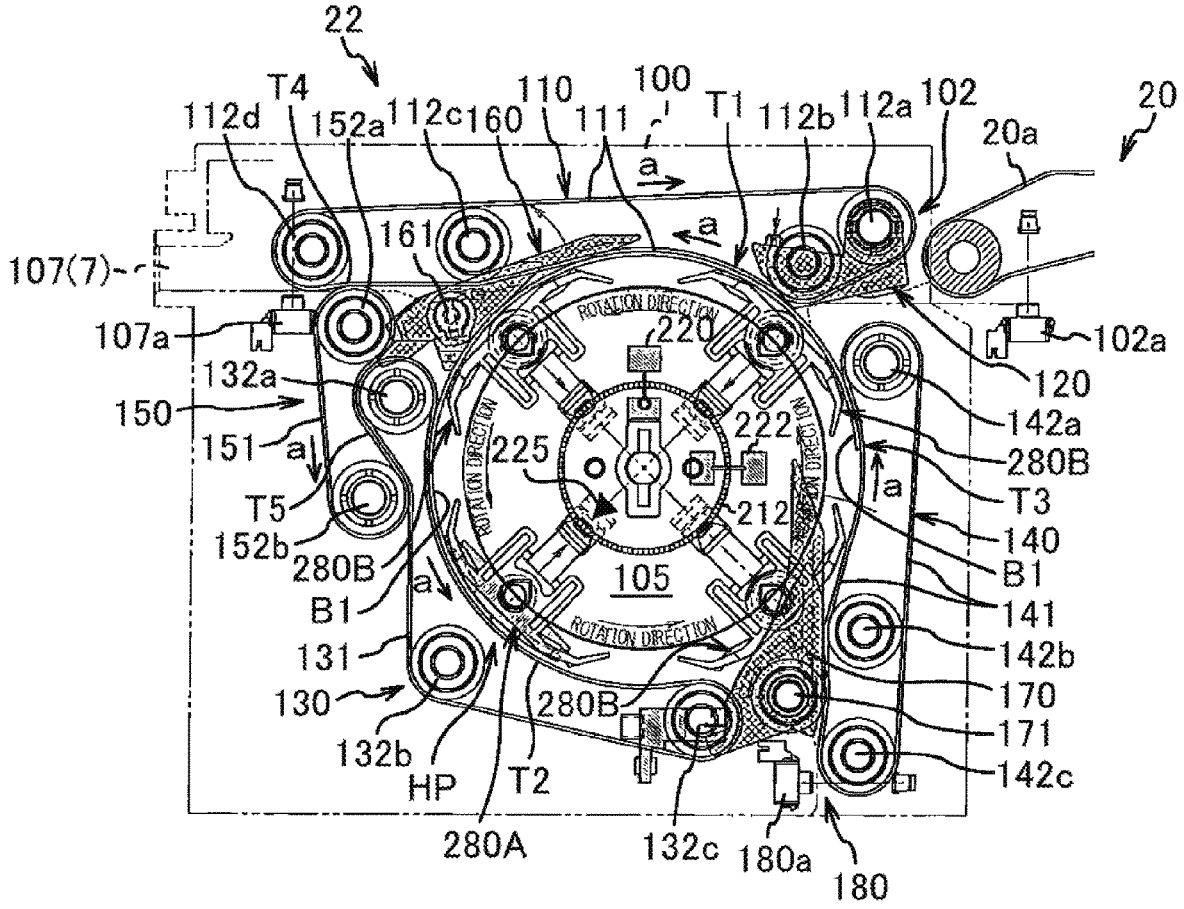
Figure 14F:
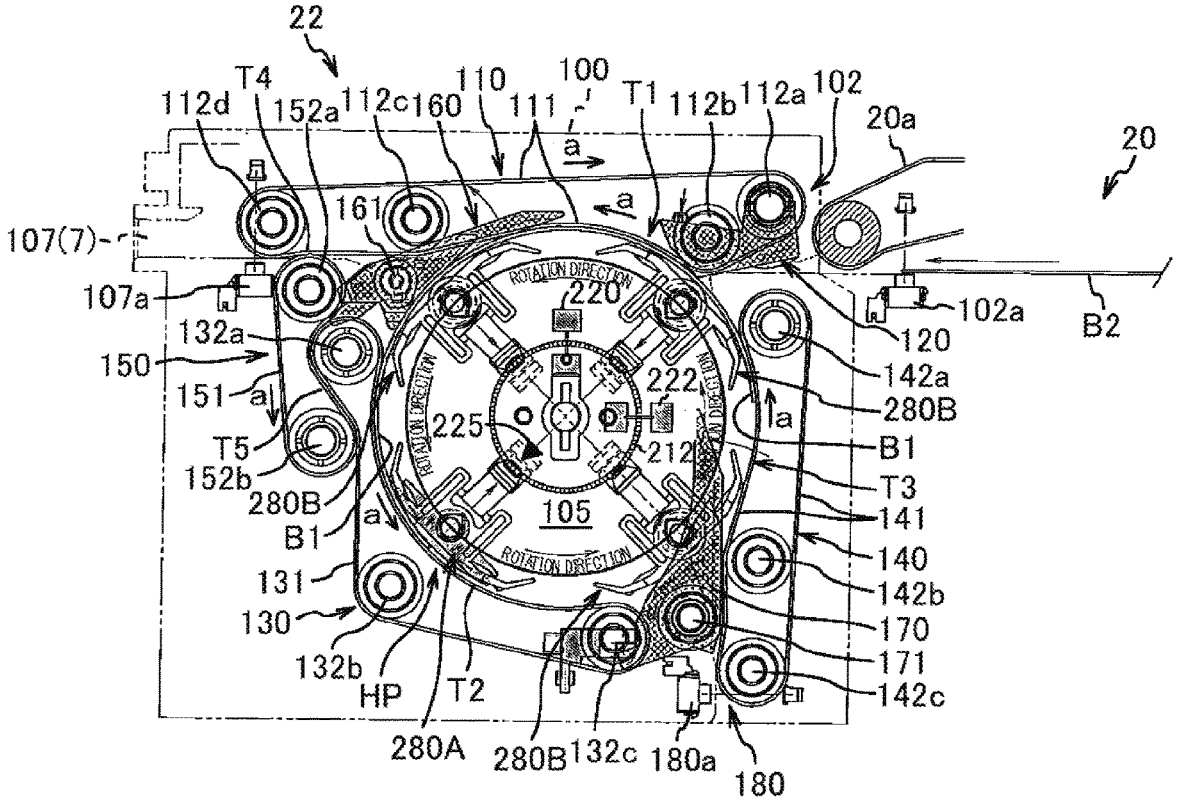
FIGS. 14(*f*) to (*h*) are explanatory diagrams of a procedure following the accumulating operation.
Figure 14G:
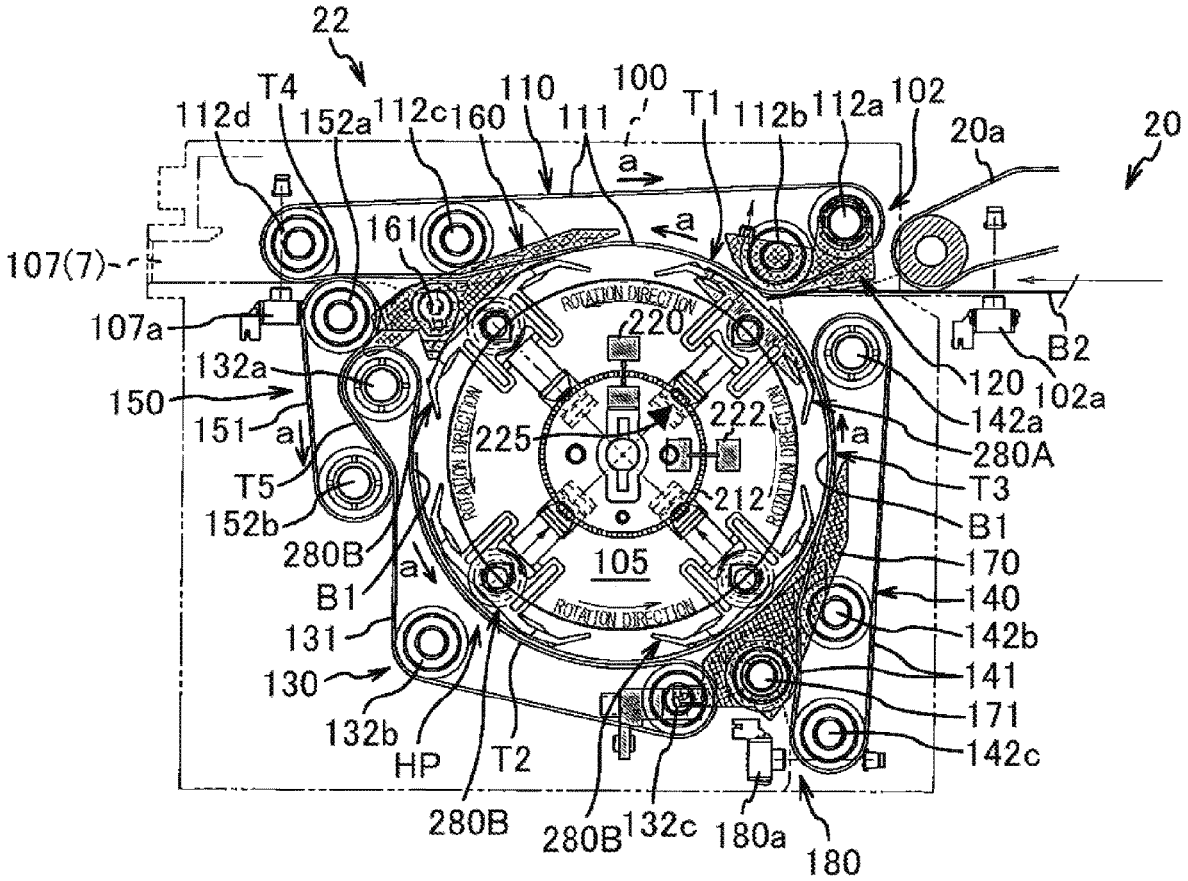
Figure 14H:
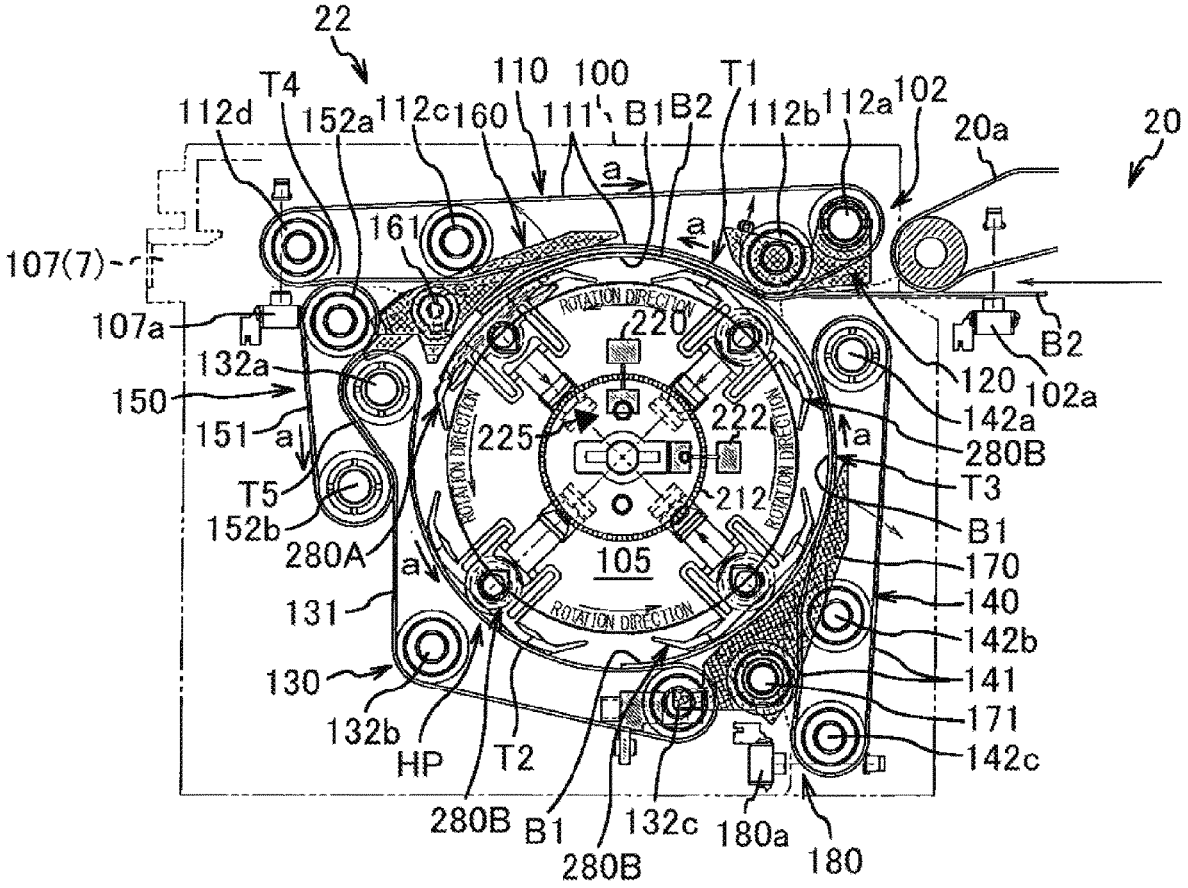
Figure 15I:
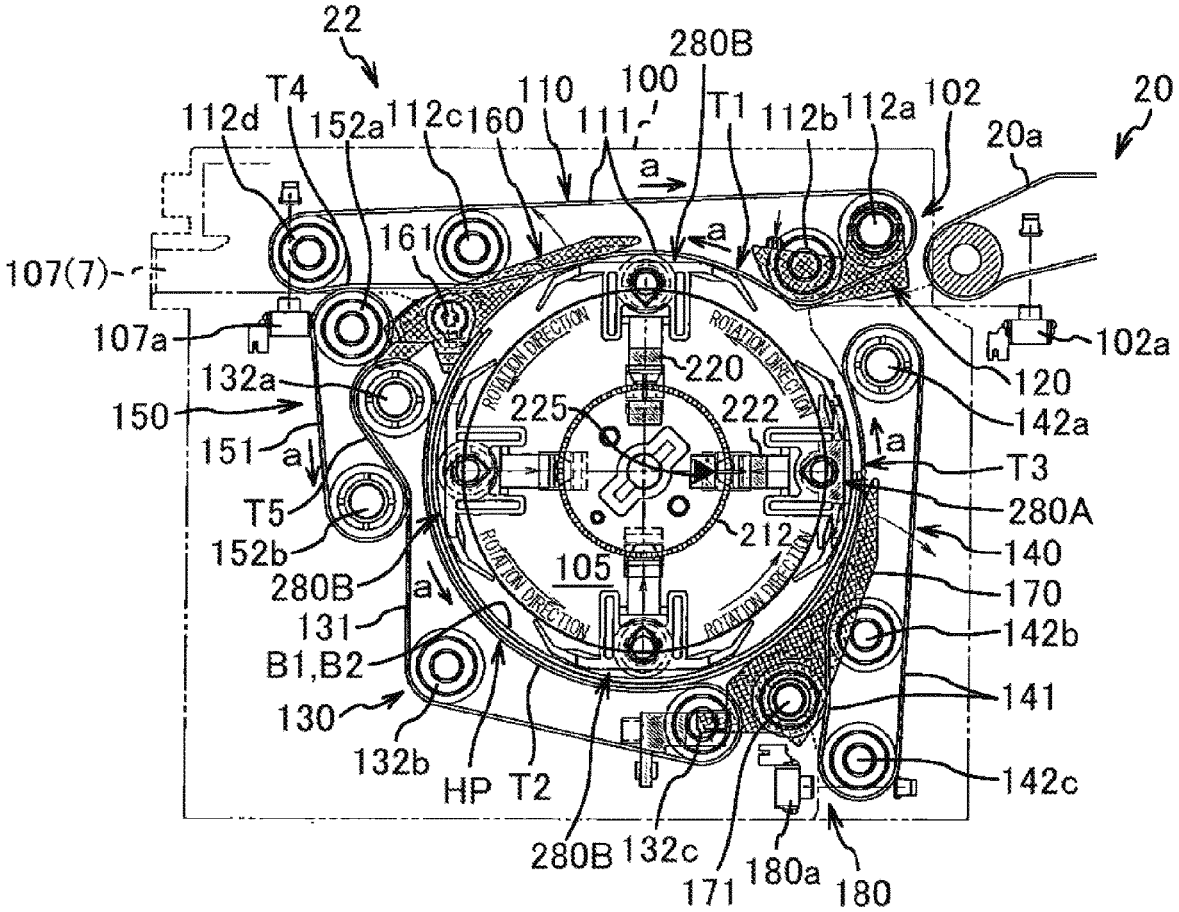
FIGS. 15(*i*) and (*j*) are explanatory diagrams of a procedure following the accumulating operation.
Figure 15J:
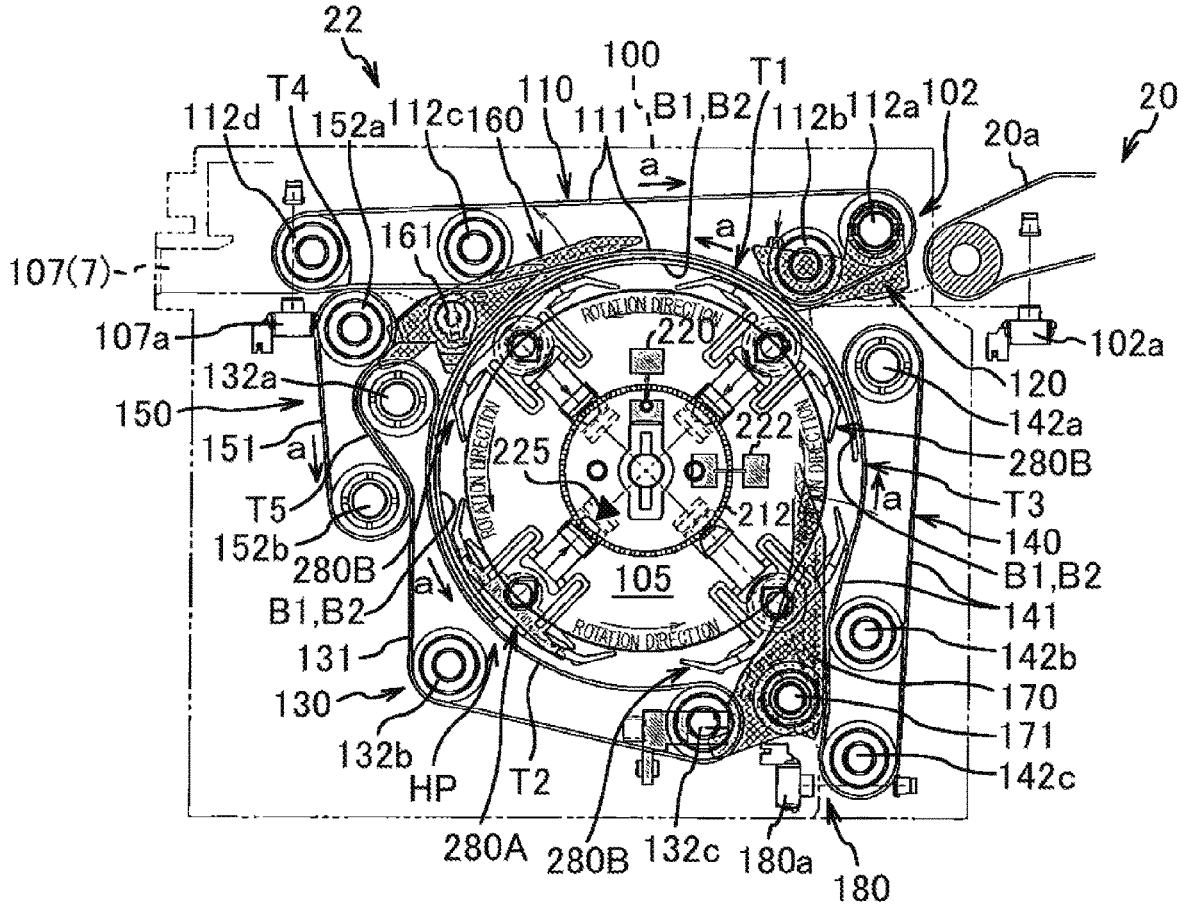

FIGS. 12(*a*) to (*c*), FIGS. 13(*d*) and (*e*), FIGS. 14(*f*) to (*h*), and FIGS. 15(*i*) and (*j*) are explanatory diagrams of the accumulating operation that winds a banknote on the outer circumference of the payout drum, and FIG. 18 is a flowchart of the accumulating operation, a batch payout operation, and a forgotten-banknote handling operation.

Prior to a banknote winding operation, it is checked whether an instruction to return banknotes (a banknote to be returned because of a transaction failure and a rejected banknote) temporarily held in the escrow unit 20 has been issued from the control unit in Step S1. When the instruction has been output, the escrow drum 21, the transport belt 20*a*, and the like are driven, so that transfer of the banknotes one by one from the escrow unit to the payout accumulation unit 22 is started (Step S2).

It is then checked whether the first banknote B1 from the escrow unit has reached the receiving port 102, in Step S3.

FIG. 12(*a*) illustrates a state where the leading end of a banknote has been detected by the banknote detection sensor 102*a*, and a state where one of a plurality of banknotes accommodated on an outer circumference of the escrow drum 21 in the escrow unit 20, that is, the first returned banknote B1 has been transported by the transport belt 20*a* and the leading end of the banknote B1 has reached the banknote detection sensor 102*a* before the receiving port 102 (YES in Step S3). In a standby state before detection of the leading end of the banknote by the banknote detection sensor 102*a*, the winding start portion (the banknote-leading-end positioning portion) 286 (the retractable member 280A) for aligning leading ends of banknotes to be arranged on the outer circumference of the payout drum is stopped at the home position HP (a position opposed to the receiving port 102) as illustrated in FIG. 12(*a*). When each of the belt mechanisms 110, 130, 140, and 150 starts to be driven in the forward-rotation direction to cause the payout drum to rotate in the forward direction (Step S4) at the time of detection of the leading end of the banknote B1 transported by the transport belt 20*a* by the banknote detection sensor 102*a*, a timing at which the leading end of the banknote B1 reaches a taking position (the receiving port 102) and a timing at which the winding start portion 286 of the payout drum 105 reaches from the home position HP to the taking position become the same as each other.

It is possible to control the leading end of the banknote B1 and the winding start portion 286 of the payout drum coincide with each other at the taking position by setting the speed of transport of the banknote by the transport belt 20*a* and the rotation speed of the payout drum to be the same as each other by a configuration of a gear transmission mechanism and by appropriately setting the home position HP of the payout drum in advance, thereby facilitating control.

The winding start portion 286 is provided on one 280A of four retractable members, and only an outer surface of this retractable member as the winding start portion is set to have a large frictional resistance with respect to a banknote surface. The winding start portion is a part that holds the leading end of a banknote immediately after being introduced, without misalignment by cooperation with the first belt 111.

In a state where a banknote has been detected in FIG. 12(*a*), when the motor 190 is driven in the forward-rotation direction, each of the belt mechanisms 110, 130, 140, and 150 starts to be driven in the forward-rotation direction. Therefore, each of the belts 111, 131, 141, and 151 starts to travel in the receiving direction illustrated with an arrow a. Because the payout drum 105 rotates together with each belt because of resistance of contact with the belt, the payout drum 105 starts to rotate in the forward-rotation direction (a winding direction) at the same time as the start of traveling of the belt. The control unit 300 drives a motor in the escrow unit to cause the transport belt 20*a* to travel in such a manner that the leading end of the banknote B1 reaches the taking position at the same timing as the timing at which the payout drum 105 rotates in the counterclockwise direction that is the winding direction and an appropriate position on the outer surface of the winding start portion, that is, the center in the circumferential direction in the present example reaches the taking position (the receiving port 102) illustrated in FIG. 12(*b*) (Step S4). By this control, the leading end of the banknote B1 that has been at the standby position is sandwiched between the outer surface of the winding start portion and the first belt 111, thereby being caught into the first contact-traveling region T1.

Because the outer surface of the winding start portion and a first belt surface each have a large frictional resistance, slipping of the leading end of the banknote does not occur between both the surfaces.

Although the home position HP is set at a position shifted from the taking position by 180 degrees in the circumferential direction in the present example, this setting is merely an example.

The moving speed of the banknote B1 that has been at the position illustrated in FIG. 12(*a*) until it reaches the taking position illustrated in FIG. 12(*b*) is the same as the moving speed (a peripheral speed) of the winding start portion that has been at the home position HP when moving to the taking position, and is 800 msec, for example. According to the present invention, even when the number of banknotes held between retractable members increases, it is possible for the retractable members to uniformly retreat radially inward by the thickness of the banknotes via the banknotes because of cooperation between the characteristic configuration of the payout drum and a pressing force by the belt. Therefore, the linear velocity (a position of an outer side in the radial direction) of an outer circumferential surface of the accumulated banknotes is always constant.

In the state in FIG. 12(*a*), the first flapper 120 is biased by a spring with its tip facing the outer surface of the payout drum 105. At start of introduction of a banknote in FIG. 12(*b*), the winding start portion 286 has rotationally moved to the taking position and the leading end of the banknote is pressed against the outer surface of the winding start portion by the first flapper. At this time, the first flapper 120 is pressed by the banknote to be lifted by the thickness of the banknote. The banknote B1 that has entered from the receiving port 102 passes while being in contact with the tip of the first flapper 120, thereby being guided in the first contact-traveling region T1 in a stable manner. After the start of catching the banknote into the first contact-traveling region T1 in FIG. 12(*b*), the leading end of the banknote moves in the first contact-traveling region T1 in the counterclockwise direction without falling or being misaligned while being held between the winding start portion 286 and the first belt 111 with a necessary and sufficient pressing force. Similarly, a portion of the banknote behind the leading end also moves in the first contact-traveling region T1. In a procedure in which the banknote is wound on the outer circumferential surface of the payout drum, the banknote is wound to spread over the retractable members while being in close contact with the outer surfaces of the retractable members.

FIG. 12(*c*) illustrates a state where winding of the first banknote B1 on the outer circumference of the payout drum has not been finished. After the trailing end of the banknote passes by the banknote detection sensor 102*a*, driving of each belt mechanism in the forward-rotation direction is continued, so that the payout drum continues to rotate until winding of the banknote on the outer circumference of the payout drum (between the retractable members) is finished.

Further, also after the trailing end of the banknote exits from the first contact-traveling region T1 as illustrated in FIG. 13(*d*), the payout drum continues to rotate until the winding start portion (the leading end of the banknote) reaches the home position HP, and stops rotating once at a point in time at which the winding start portion reaches the home position as illustrated in FIG. 13(*e*) and waits until a second banknote B2 reaches the banknote detection sensor 102*a*.

In FIG. 13(*d*), because the banknote B1 passes by the third flapper 170, the third flapper is pressed by the banknote passing along its inner surface to pivot outward around the shaft 171 and allow the banknote to pass, and returns to an original position by a spring after the trailing end of the banknote passes as illustrated in FIG. 13(*e*).

In a process in which the first banknote B1 moves in the winding direction in the first to third contact-traveling regions T1 to T3, the retractable member 280A having the winding start portion and the other retractable members 280B are uniformly retracted radially inward of the payout drum by the thickness of one sheet of banknote because of a pressure applied from each belt 111, 131, or 141 via the banknote. Therefore, the linear velocity of the outer circumferential surface of the banknote B1 is not changed and is coincident with the transport speed of a banknote when the banknote is sent to the taking position. Therefore, in a process in which all banknotes are wound on the outer surface of the payout drum, it is unnecessary to decelerate the rotation speed of the payout drum, so that complicated control of the rotation speed is not required.

FIGS. 14(*f*) to (*h*) and FIGS. 15(*i*) and (*j*) illustrate a procedure following the procedures illustrated in FIGS. 12 and 13, in which the payout drum continues to rotate in the forward direction to wind the second banknote B2 on its outer circumference. In this procedure, the same procedure as that for the first banknote is repeated (Step S5).

FIG. 14(*f*) illustrates a state where the leading end of the second banknote B2 has reached the banknote detection sensor 102*a* and has entered to a standby state. In FIG. 14(*g*), the second banknote B2 is fed at a timing corresponding to the timing at which the leading end of the first banknote B1 located on a taking-start portion reaches the taking position because of rotation of the belt mechanisms and the payout drum, so that it is possible to take both the banknotes B1 and B2 into the first contact-traveling region T1 with the leading ends thereof made coincident with each other. FIG. 14(*h*) and FIGS. 15(*i*) and (*j*) respectively correspond to FIG. 12(*c*) and FIGS. 13(*d*) and (*e*).

Also when the second banknote is stacked on the outer surface of the first banknote, the retractable member 280A having the winding start portion and the other retractable members 280B are uniformly retracted radially inward of the payout drum by the thickness of two sheets of banknotes because of a pressure applied from each belt 111, 131, or 141 via the two sheets of banknotes. Therefore, the linear velocity of the outer circumferential surface of the outermost banknote B2 is not changed and is coincident with the transport speed of the banknote when the banknote is sent to the taking position. Therefore, in a process in which all banknotes are wound on the outer surface of the payout drum, it is unnecessary to decelerate the rotation speed of the payout drum, so that complicated control of the rotation speed is not required. This is also the same for an operation in which the third and subsequent banknotes are wound on the outer circumferential surface of the payout drum.

As for the third and subsequent banknotes, the catching operation that is identical to that for the second banknote is repeated.

In Step S6, it is determined whether the number of banknotes that have been completely wound by the payout drum has reached N. When the number has reached N, the process proceeds to a batch payout operation illustrated in Step S7, which discharges a batch of banknotes through the outlet 107 to the outside of the device all at once.

[Batch Payout Operation]

Figure 16A:
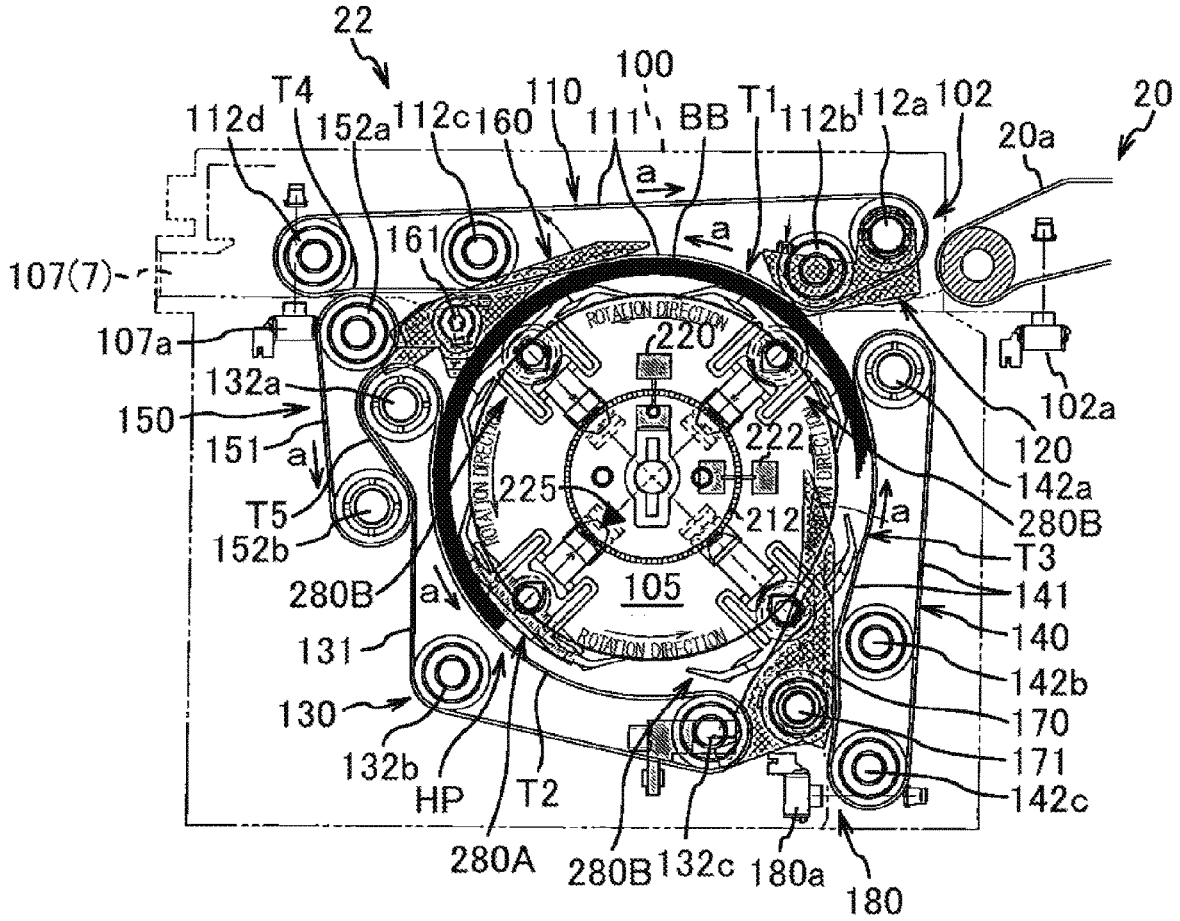
FIGS. 16(*a*) to (*c*) are explanatory diagrams illustrating a procedure of a batch payout operation.
Figure 16B:
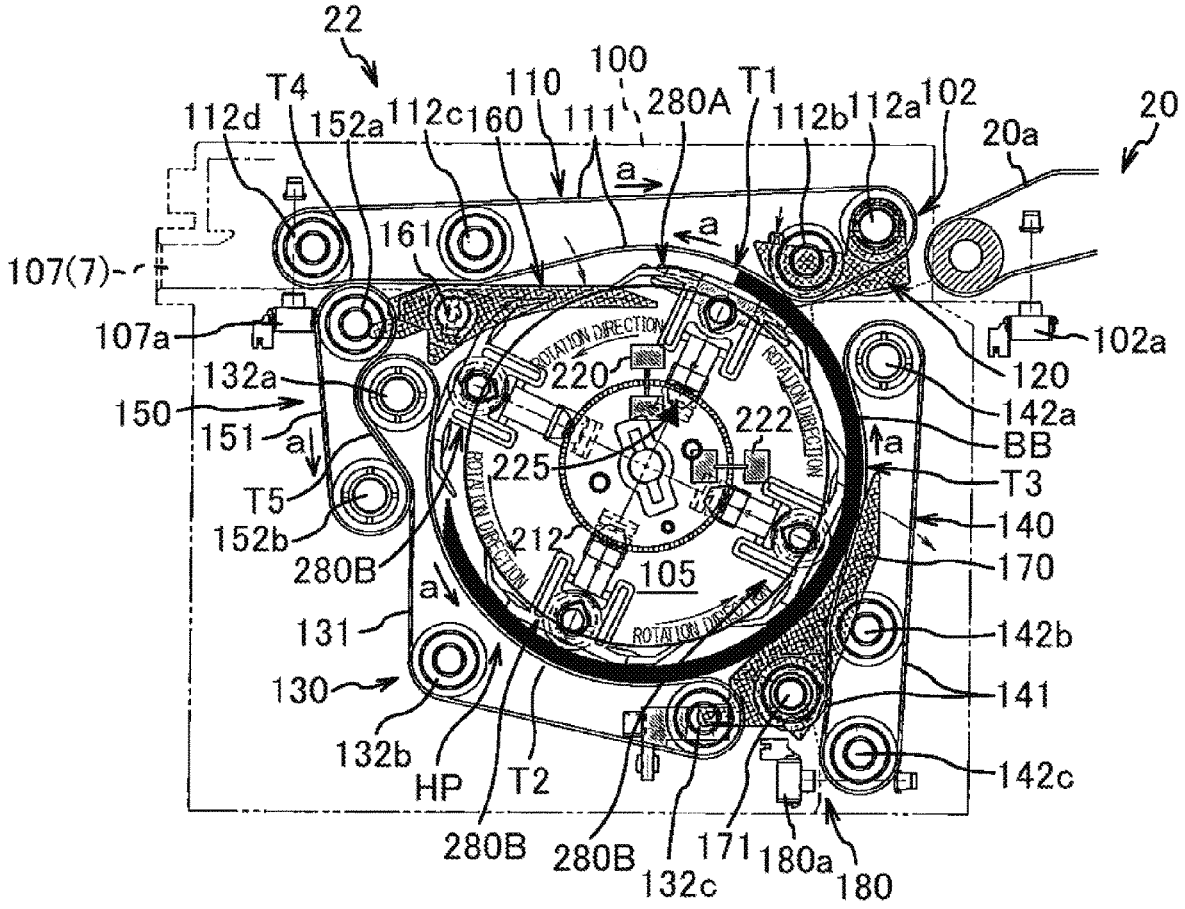
Figure 16C:
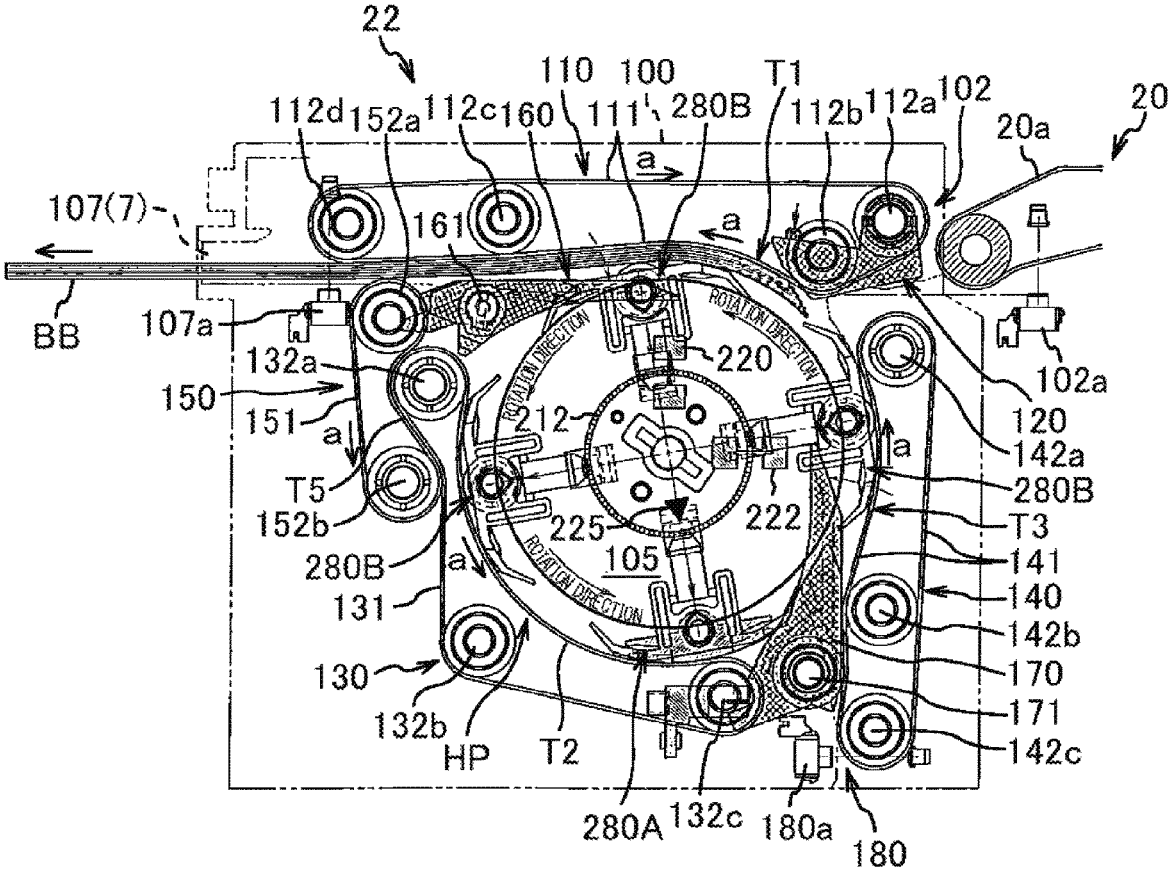

When all banknotes wound on the outer circumference of the payout drum in an arranged state have moved to the outer circumference of the payout drum by the above procedures, the banknotes are placed in a state illustrated in FIG. 16(*a*).

FIGS. 16(*a*) to (*c*) illustrate a procedure of a batch payout operation.

In the accumulation-completion state in FIG. 16(*a*), an operation (the batch payout operation) is then performed which returns a banknote batch BB to be returned through the outlet 107 all at once (Step S7).

Because the leading edge of the banknote batch BB is located at the home position HP in the state in FIG. 16(*a*), the payout drum is rotated in the counterclockwise direction and the banknote batch BB is guided to the outlet 107 by an action of the second flapper 160, in order to pay out the banknote batch BB through the outlet 107.

Because the second flapper 160 is biased radially outward by a spring (not illustrated in FIG. 16(*a*)), the tip portion of the second flapper located on the right of the rotation shaft 161 closes a path to the outlet 107. The control unit 300 causes a solenoid (not illustrated) to operate at a timing at which the trailing end of the banknote batch BB separates from the lower surface of the tip of the second flapper, thereby causing the tip of the second flapper to pivot radially inward (in the clockwise direction, an outlet-opening direction). By this opening operation, an open path to the outlet 107 is formed above the second flapper (FIG. 16(*b*)). The timing at which the trailing end of the banknote batch BB separates from the tip of the second flapper can be set in accordance with the length of a banknote in advance.

The second flapper 160 opens the path to the outlet 107 in the stage in FIG. 16(*b*). Therefore, in a process in which the leading end of the banknote batch enters into the first contact-traveling region T1 and reaches the outlet 107, the leading end of the banknote batch can smoothly move to the outside through the outlet 107 because of rotation of the first belt 111 and the payout drum in a payout direction (FIG. 16(*c*)). Further, the first belt mechanism 110 has a configuration in which the pulleys 112*c* and 112*d* on the outlet side move up and down with respect to an axis of the pulley 112*a* as the center. Therefore, when the banknote batch BB passes, an outlet-side portion of the first belt moves up to allow the banknote batch BB to pass further smoothly.

After the time at which it is detected by the banknote detection sensor 107*a* that the trailing end of the banknote batch is caused to pass through the outlet 107 because the banknote batch discharged from the outlet 107 is taken by a customer, the solenoid is turned off, so that the second flapper can return to its original position illustrated in FIG. 16(*a*) (Steps S8 and S9).

Final discharge of the banknote batch BB to the outside of the device is performed by cooperation between the first belt mechanism 110 and the fourth belt mechanism 150.

[Forgotten-Banknote Processing Operation]

Figure 17A:
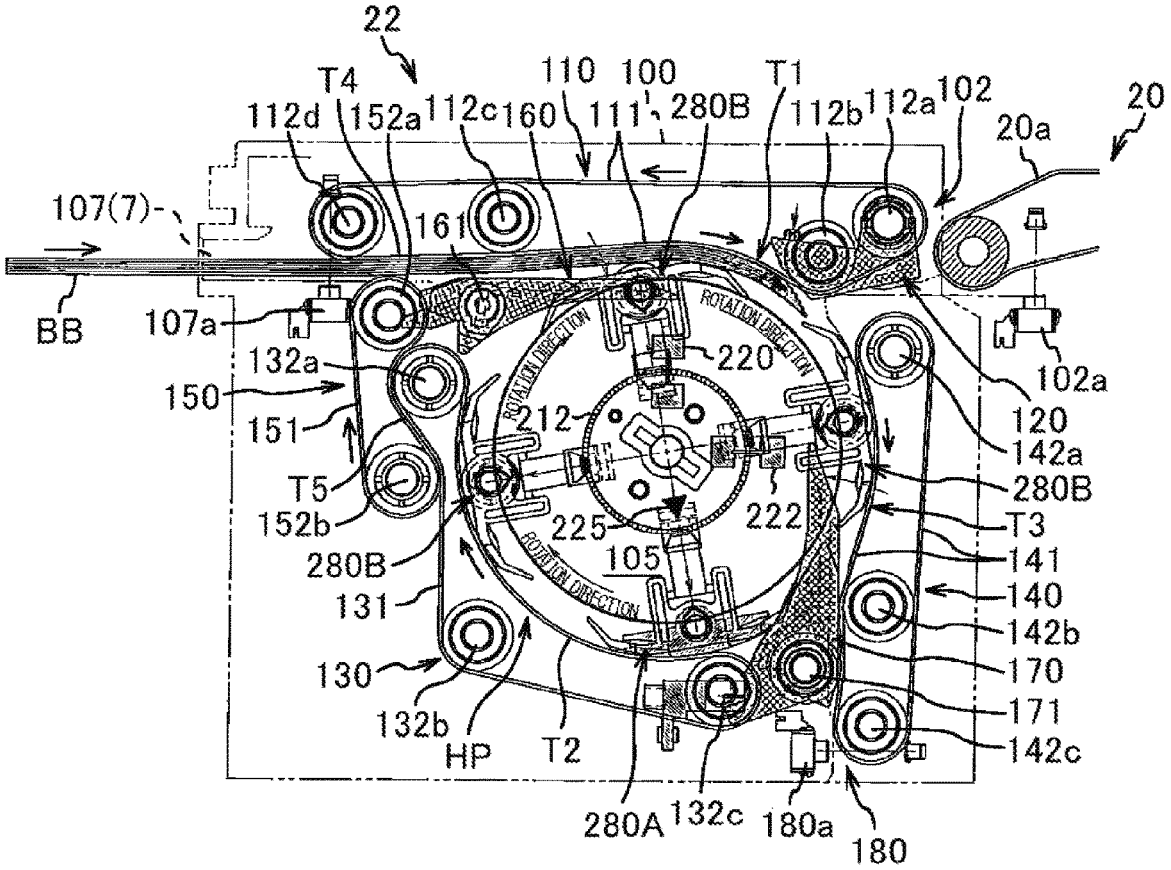
FIGS. 17(*a*) to (*c*) are explanatory diagrams illustrating a procedure of a forgotten-banknote handling operation.
Figure 17B:
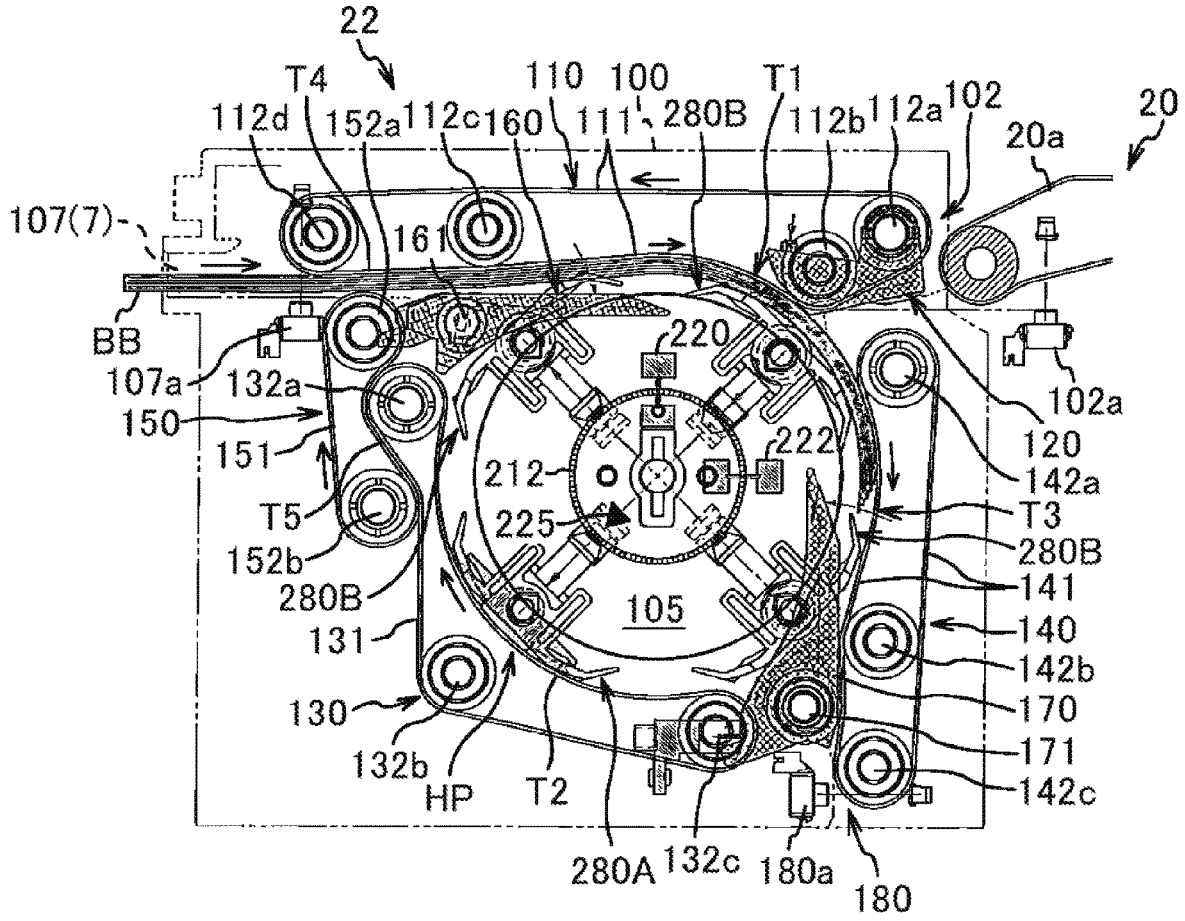
Figure 17C:
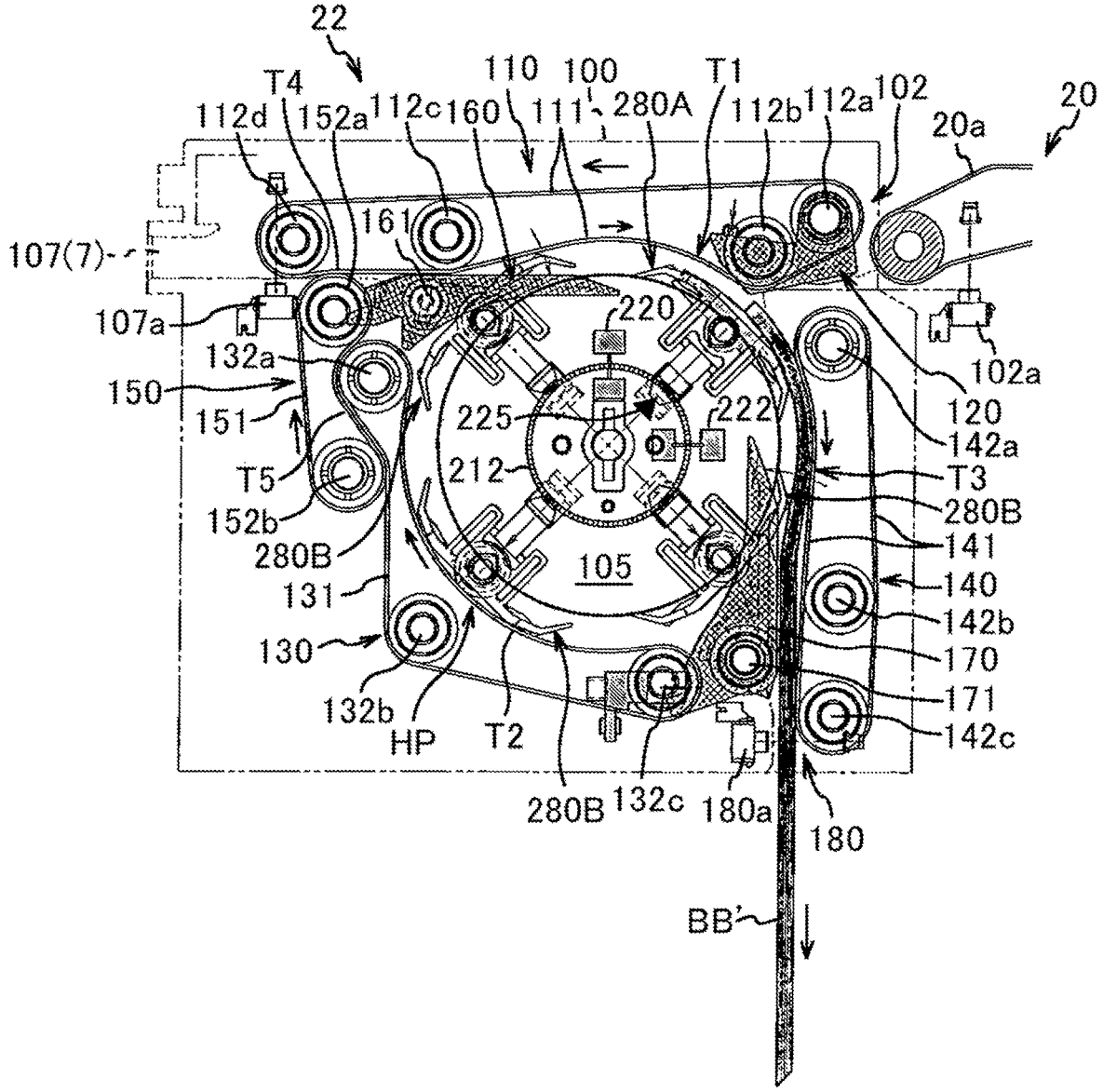

Next, a procedure of discharging a forgotten banknote to the forgotten-banknote accommodation unit 24 is described based on FIG. 17 and the flowchart in FIG. 18 (Steps S10 and S11) that illustrate a forgotten-banknote processing operation.

In a return state in FIG. 16(*c*), only a leading portion of the banknote batch BB to be returned is caused to protrude from the outlet 107 (the returning port 7) to outside, and the trailing portion of the banknote batch is held in the fourth contact-traveling region T4 formed by the first belt 111 and the fourth belt 151. Therefore, it is not possible to take out the banknote batch, unless a customer grasps the leading end of the banknote batch and pulls it out. It is possible to determine that the banknote batch has been taken out or has not been taken out based on information on detection by the banknote detection sensor 107*a*. In a case where the discharged banknote is taken out by a customer, the second flapper 160 is returned to its original position and waits for winding of a next banknote (YES in Step S8, Step S9).

In a case where a state where the banknote batch is not collected by a customer continues for a certain time period as illustrated in FIG. 17(*a*) (YES in Step S10), the control unit 300 causes to the motor 190 to rotate all the belt mechanisms in the reverse direction as illustrated in FIG. 17(*b*), thereby starting to cause a forgotten banknote batch BB' to retreat toward the inside of the device (Step S11). The payout drum rotates together with the reverse rotation of each belt mechanism, to rotate in the reverse direction. On a premise of start of reverse rotation of the belt mechanism, the third flapper 170 has retreated radially inward by an action of a spring as illustrated in FIG. 17(*a*). By this retreat, the discharge port 180 is opened to the forgotten-banknote accommodation unit 24.

Further, each of the belt mechanisms and the payout drum continue to rotate in the reverse direction also after the stage in FIG. 17(*b*) that is in the middle of drawing in the banknote batch, so that the forgotten banknote batch BB' is discharged to and accommodated in the forgotten-banknote accommodation unit 24 from its trailing end via the first contact-traveling region T1, the third contact-traveling region T3, and the discharge port 180 (Step S11). Passing of the forgotten banknote batch BB' through the discharge port 180 can be detected by the banknote detection sensor 180*a*.

In a case where a forgotten banknote paid out to the outlet 107 is not taken out even after a certain time passes, it is possible to enable use of the device by the next customer without delay by collecting this forgotten banknote to the inside, so that reduction of an operation rate can be prevented.

The banknotes accommodated in the forgotten-banknote accommodation unit 24 cannot be taken out unless a staff draws out the payout accumulation unit (a payout accumulation device) 22, opens it, and takes out the banknotes.

When discharge to the forgotten-banknote accommodation unit 24 is completed, the payout drum is returned to the home position illustrated in FIG. 12(*a*) and the outlet 107 is closed by the second flapper 160, to wait for insertion of the next banknote.

[Summary of Configurations, Operations, and Effects of Present Invention]

A paper sheet accumulation drum according to a first aspect of the present invention is the paper sheet accumulation drum 105 that stacks and accumulates paper sheets supplied one by one on its outer circumferential surface while rotating, and includes a plurality of retractable members (paper-sheet supporting members) 280 that are provided on a paper sheet accumulation portion of the outer circumferential surface in a predetermined circumferential arrangement (with an interval), are each configured to be retractable to a retreat position retreating radially inward, are each elastically biased to a protruding direction, and each come in contact with a paper sheet surface on its outer surface. The paper sheets are accumulated (wound) to spread over the retractable members.

For example, in a returned-paper-sheet accumulation device of a drum type that, in a case where it is determined that paper sheets temporarily held after being inserted are to be returned, for example, sequentially supplies the returned paper sheets to an outer circumferential surface of a payout drum, winds and accumulates them in a stacked state, and thereafter returns the paper sheets all at once, even when the number of the paper sheets accumulated on the outer circumference of the payout drum is increased, it is possible to keep the linear velocity of a paper sheet located at an outermost circumference of the payout drum constant and maintain an arranged state of the paper sheets without any particular speed control.

Further, other than the returned paper sheets, the present invention can be generally applied to a device that stacks and accumulates paper sheets on a circumferential surface of a drum with good alignment.

A circumferential surface that connects the outer circumferential surfaces of the retractable members forms the outer circumferential surface of the paper sheet accumulation drum.

In a conventional paper sheet accumulation drum, an outer diameter of a drum increases with increase of the number of accumulated paper sheets, and therefore the peripheral speed of an outermost paper sheet increases. In order to make the speed of a paper sheet supplied to the drum outer circumferential surface at a constant speed coincident with the peripheral speed of the drum, it is necessary to decelerate the rotation speed of the drum. However, the radial-direction position of the outermost circumferential surface is changed and the peripheral speed is also changed, every time the number of paper sheets increases by one. Therefore, high-accuracy deceleration control is required, making it extremely difficult to align the leading end of a subsequent paper sheet with the leading end of the wound paper sheet.

The paper sheet accumulation drum according to the present invention is configured in such a manner that supplied paper sheets are received by the retractable members and supported between the retractable members in the form of a roll and the retractable members are caused to retreat radially inward by increase of the thickness of the paper sheets by a pressing force applied from a belt and the like. Therefore, even when the number of the paper sheets on the drum outer circumferential surface increases, it is possible to make the position of the outer circumferential surface of the outermost paper sheet (the outer diameter) constant, so that the peripheral speed can be made always constant.

Other than an accumulation device for returned paper sheets, this paper sheet accumulation drum can be also applied to a general mechanism that accumulates paper sheets on a drum outer circumferential surface one by one in such a manner that the paper sheets are aligned with each other.

In a second aspect of the present invention, a paper sheet accumulation device includes the receiving unit 102 that receives transported paper sheets, the paper sheet accumulation drum 105 that sequentially stacks and accumulates the paper sheets received through the receiving unit on its outer circumferential surface one by one to form a paper sheet batch while rotating in a forward direction and is rotatable in the forward direction and a reverse direction, the transport guide members 110, 130, and 140 that are respectively arranged at a plurality portions along a turning (rotation) movement path of the outer circumferential surface of the paper sheet accumulation drum (the retractable members 280) and bring a paper sheet surface into contact (close contact) with the outer circumferential surface of the paper sheet accumulation drum (the outer surfaces of the retractable members), the first outlet 107 that discharges the paper sheets accumulated on the outer circumferential surface of the paper sheet accumulation drum (the outer surfaces of the respective retractable members) to outside, the first outlet switching guide member (the second flapper) 160 that selectively switches a transport direction of the paper sheets entering into the contact-traveling region T1 between the outer circumferential surface of the paper sheet accumulation drum (the outer surfaces of the respective retractable members) and one of the transport guide members, to either one of a direction toward the outer circumferential surface of the paper sheet accumulation drum and a direction toward the first outlet, a driving source 190 for the paper sheet accumulation drum, a driving source (a solenoid) for the first outlet switching guide member 160, and the control unit 300 that controls each of the driving sources. The first outlet switching guide member 160 opens a path from the contact-traveling region T1 to the outer circumferential surface of the paper sheet accumulation drum when being at an opening posture, and opens a path to the first outlet when being at a closing posture. Each of the transport guide members push the respective retractable members radially inward via the paper sheets accumulated on the outer circumferential surface of the paper sheet accumulation drum (the outer surfaces of the respective retractable members), thereby keeping the outer radial (radial-direction) position of an outer circumferential surface of the paper sheets on the outer circumferential surface of the paper sheet accumulation drum (the outer surfaces of the respective retractable members) always constant irrespective of the number of the paper sheets. The control unit continues to open the first outlet switching guide member and rotates the paper sheet accumulation drum in the forward direction during a period of receiving a paper sheet introduced from the receiving unit and, when receiving is finished and the paper sheets (batch) on the outer circumference of the paper sheet accumulation drum (the outer surfaces of the respective retractable members) are discharged to outside of the device through the first outlet, causes the first outlet switching guide member to transition to the closing posture and rotates the paper sheet accumulation drum in the forward direction.

It is possible to make the peripheral speed always constant irrespective of increase of the number of the paper sheets on the outer circumferential surface of the accumulation drum because of cooperation between the paper sheet accumulation drum 105 in which the position of the outer circumferential surface (the outer surfaces of the retractable members) can be displaced radially inward in accordance with the thickness of the paper sheets to be wound, and the transport guide members 110, 130, and 140 that press the retractable members. Therefore, it is possible to easily align the positions of leading ends of a preceding paper sheet and a subsequent paper sheet by always rotating the paper sheet accumulation drum at a constant speed.

According to a third aspect of the present invention, a paper sheet accumulation device further includes the second outlet 180 that is arranged at a different position from the first outlet 107 and communicates with the paper sheet holding unit 24, and the switching guide member (the third flapper) 170 that is pivotable and guides the paper sheets on the outer circumferential surface of the paper sheet accumulation drum to the second outlet. The switching guide member is at the posture of opening a path to the second outlet at normal times, and is at the posture of closing the path to the second outlet when the paper sheets on the outer surfaces of the retractable members pass in the forward-rotation direction. When the paper sheets on the outer circumferential surface of the paper sheet accumulation drum (the outer circumferential surfaces of the retractable members) are discharged through the second outlet to the paper holding unit, the control unit 300 rotates the paper sheet accumulation drum in the reverse direction, thereby allowing the paper sheets to be discharged to the outside from a trailing end.

In a case where it becomes apparent that the paper sheets (batch) discharged to the first outlet once is not taken out by a customer, the control unit 300 regards those paper sheets as forgotten paper sheets and rotates the accumulation drum in the reverse direction, so that the paper sheets are collected to inside of the device. The collected paper sheets are sent back to the paper sheet holding unit 24 from the trailing end. It is possible to collect the forgotten paper sheets to the paper sheet holding unit only by rotating the accumulation drum in the reverse direction.

The paper sheets (batch) are transported while being sandwich-pressed from both inner and outer surfaces by cooperation between each of the retractable members and each of the transport guide members, also when being moved in the reverse-rotation direction. Therefore, the paper sheet batch do not fall into pieces.

In the paper sheet accumulation device according to a fourth aspect of the present invention, the outer surface (the contact member 285) of one 280A of the retractable members 280 is configured to have a large frictional resistance on a surface of contact with a paper sheet, and the outer surfaces (the contact member 285) of the other retractable members 280B are configured to have a smaller frictional resistance (a transport resistance) with respect to a paper sheet.

In order to prevent the leading end of a paper sheet that is supplied first to the outer circumferential surface of the accumulation drum from slipping on the drum outer circumferential surface, that is, the outer circumferential surfaces of the retractable members, only the specific retractable member 280A, in which the frictional resistance of the contact member 285 is set to be large, is used as the winding start portion 286. A configuration having a small frictional resistance (a rotating body) or a material having a small frictional resistance is used as the contact members 285 of the remaining retractable members 280B other than this retractable member 280A.

While the leading end of a paper sheet is held by the winding start portion 286 not to be misaligned, the other portion of the paper sheet is supported by the remaining retractable members 280B to be easily slidable in the circumferential direction. Therefore, it is possible to allow the paper sheet to be smoothly wound between the retractable members and be developed. Further, when each of the retractable members 280B is retracted radially inward by a pressure from the transport guide member, the retractable members 280B can be also retracted smoothly because the paper sheet is not attracted by the contact members 285.

In a fifth aspect of the present invention, the transport guide members 110, 130, and 140 in the paper sheet accumulation device are each configured by a belt mechanism in which an endless belt is provided in a tensioned state with pulleys.

As the transport guide members, any configuration may be used as long as it can uniformly apply a pressure to the retractable members to displace them radially inward by a uniform distance. The most convenient configuration is the belt mechanism.

In a sixth aspect of the present invention, the paper sheet accumulation drum in the paper sheet accumulation device is driven to rotate by the transport guide members.

Accordingly, it is easy to completely synchronize the peripheral speed of the accumulation drum and the speed of the transport guide members with each other by using a single driving source.

In a seventh aspect of the present invention, the paper sheet processing device comprises any one of the above described paper sheet accumulation devices.

The paper sheet processing device attains the operations and effects according to the respective exemplified modes by including the paper sheet accumulation device according to the respective exemplified modes.

The paper sheet processing device may be applied to various paper sheet handling apparatuses such as an automatic vending machine such as a ticket-vending machine, a money changer, a depositing/dispensing apparatus, and an ATM.

REFERENCE SIGNS LIST

1 banknote (paper sheet) processing device, 3 case, 3*a* accommodation space, 5 depositing/dispensing slot, 7 return slot, 9*a* deposited-banknote (paper sheet) transport path, 9*b* accommodated-banknote (paper sheet) transport path, 11 batch deposit unit, 13 centering unit, 15 discrimination unit, 20 escrow unit, 20*a* transport belt, 21 escrow drum, 22 payout accumulation unit (payout accumulation device), 24 forgotten-banknote (paper sheet) accommodation unit, 30 circulation-type accommodation unit, 30*a* circulation drum, 40 collection container, 50 escrow/accumulation unit, T1 to T5 contact-traveling region, B banknote, BB returned banknote, 100 casing, 102 receiving port (receiving unit), 102*a* banknote detection sensor, 105 paper sheet (paper sheet) accumulation drum (payout drum), 105*a* rotation shaft, 107 outlet (first outlet), 107*a* banknote detection sensor, 110, 130, 140, 150 belt mechanism (transport guide member), 111, 131, 141, 151 belt, 112*a* to 112*c*, 132*a* to 132*c*, 142*a* to 142*c*, 152*a*, 152*b* pulley, 120 first flapper, 120A nail, 160 first outlet switching guide member (second flapper), 161 rotation shaft, 170 third flapper, 171 shaft, 180 discharge port, 180*a* banknote detection sensor, 190 motor (driving source), 190*a* output gear, 201, 202 driven gear, 205 large-diameter gear, 207, 209, 211, 213 driving gear, 210 encoder mechanism, 212 code wheel, 213 slit, 215 gear, 220, 222 detector, 225 home-position mark, 250 drum body, 252 base member, 255 guide member, 255*a* hook, 257 elastic member, 258 partition member, 258*a* annular groove, 280 (280A, 280B) retractable member, 282 guided member, 282*a* hook, 282*b* recess, 282*c* banknote guide piece, 285 contact member, 286 winding start portion (banknote-leading-end positioning portion), 286*a* shaft, 290 roller, 290*a* shaft, 300 control unit

The invention claimed is:

1. A paper sheet accumulation drum of a paper sheet accumulation device including:

a receiving unit that receives transported paper sheets;

a paper sheet accumulation drum that sequentially stacks and accumulates the paper sheets received through the receiving unit on an outer circumferential surface thereof one by one to form a paper sheet batch while rotating in a forward direction, and is rotatable in the forward direction and a reverse direction; and a transport guide member that is arranged along a turning movement path of the outer circumferential surface of the paper sheet accumulation drum and bring a paper sheet surface into contact with the outer circumferential surface of the paper sheet accumulation drum, the paper sheet accumulation drum comprising:

a drum body which is driven to rotate; and a plurality of retractable members that are provided on a paper sheet accumulation portion of the outer circumferential surface of the drum body in a predetermined circumferential arrangement, are each configured to be retractable between a most protruding position protruding radially outward and a retreat position retreating from the most protruding position radially inward, are each elastically biased in a protruding direction, and each come into contact with the paper sheet surface on an outer surface, wherein the paper sheets are accumulated to spread over the retractable members, wherein each of the retractable members is configured to be retractable independently of each other, wherein one of the retractable members is a slip prevention portion where a contact member which comes into contact with the paper sheets has a frictional resistance which does not cause slipping with respect to the paper sheets, and the other retractable members include either a rotating body for reducing friction where a contact member which comes into contact with the paper sheets is rotatably supported or a material which can easily cause sliding with respect to the paper sheets, and wherein the paper sheets are banknotes, tickets, cash vouchers or securities.

2. A paper sheet accumulation device comprising:

the receiving unit that receives transported paper sheets and the paper sheet accumulation drum according to claim 1 that sequentially stacks and accumulates the paper sheets received through the receiving unit on the outer circumferential surface thereof one by one to form the paper sheet batch while rotating in the forward direction, and is rotatable in the forward direction and the reverse direction;

the transport guide member that is arranged along the turning movement path of the outer circumferential surface of the paper sheet accumulation drum and bring the paper sheet surface into contact with the outer circumferential surface of the paper sheet accumulation drum;

a first outlet that discharges the paper sheets accumulated on the outer circumferential surface of the paper sheet accumulation drum to outside;

a first outlet switching guide member that selectively switches a transport direction of a paper sheet entering into a contact-traveling region between the outer circumferential surface of the paper sheet accumulation drum and the transport guide member to either one of a direction toward the outer circumferential surface of the paper sheet accumulation drum and a direction toward the first outlet;

a driving source for the paper sheet accumulation drum;

a driving source for the first outlet switching guide member; and a control unit that controls each of the driving sources, wherein the first outlet switching guide member opens a path from the contact-traveling region to the outer circumferential surface of the paper sheet accumulation drum when being at an opening posture, and opens a path to the first outlet when being at a closing posture, the transport guide member keeps an outer radial position of an outer circumferential surface of the paper sheets on the outer circumferential surface of the paper sheet accumulation drum always constant irrespective of the number of the paper sheets by pushing the respective retractable members radially inward via the paper sheets accumulated on the outer circumferential surface of the paper sheet accumulation drum, and the control unit continues to open the first outlet switching guide member and rotates the paper sheet accumulation drum in the forward direction during a period of receiving a paper sheet introduced from the receiving unit, and causes the first outlet switching guide member to transition to the closing posture and rotates the paper sheet accumulation drum in the forward direction when receiving is finished and the paper sheets on the outer circumference of the paper sheet accumulation drum are discharged to outside of the device through the first outlet.

3. The paper sheet accumulation device according to claim 2, further comprising:

a second outlet that is arranged at a different position from the first outlet and communicates with a paper sheet holding unit; and a switching guide member that guides the paper sheets on the outer circumferential surface of the paper sheet accumulation drum to the second outlet and is pivotable, wherein the switching guide member is at a posture of opening a path to the second outlet at normal times, and is at a posture of closing the path to the second outlet when the paper sheets on the outer circumferential surfaces of the retractable members pass in a forward-rotation direction, and when the paper sheets on the outer circumferential surface of the paper sheet accumulation drum are discharged to the paper sheet holding unit through the second outlet, the control unit discharges the paper sheets from a trailing end thereof to outside of the device by rotating the paper sheet accumulation drum in a reverse direction.

4. The paper sheet accumulation device according to claim 2, wherein the transport guide member is configured by a belt mechanism in which an endless belt is provided in a tensioned state with pulleys.

5. The paper sheet accumulation device according to claim 2, wherein the paper sheet accumulation drum is driven to rotate by the transport guide member.

6. A paper sheet processing device comprising the paper sheet accumulation device according to claim 2.

* * * * *